US010398961B2

(12) United States Patent
McGowan et al.

(10) Patent No.: US 10,398,961 B2
(45) Date of Patent: Sep. 3, 2019

(54) FOOT-DECK-BASED VEHICLE AND ACCESSORY FOR SAME

(71) Applicant: YVOLVE SPORTS LTD., Dublin (IE)

(72) Inventors: John McGowan, Dublin (IE); Darrell Merino, Dublin (IE)

(73) Assignee: YVOLVE SPORTS LTD., Dublin (IE)

( * ) Notice: Subject to any disclaimer, the term of this patent is extended or adjusted under 35 U.S.C. 154(b) by 0 days.

(21) Appl. No.: 15/862,281

(22) Filed: Jan. 4, 2018

(65) Prior Publication Data

US 2018/0185739 A1 Jul. 5, 2018

Related U.S. Application Data

(60) Provisional application No. 62/519,939, filed on Jun. 15, 2017, provisional application No. 62/507,375, filed on May 17, 2017, provisional application No. 62/442,358, filed on Jan. 4, 2017, provisional application No. 62/442,363, filed on Jan. 4, 2017.

(51) Int. Cl.

| | |
|---|---|
| ***A63C 17/01*** | (2006.01) |
| ***A63C 17/00*** | (2006.01) |
| ***A63C 17/26*** | (2006.01) |
| ***A63C 17/04*** | (2006.01) |

(Continued)

(52) U.S. Cl.

CPC ..... *A63C 17/011* (2013.01); *A63C 17/0046* (2013.01); *A63C 17/0093* (2013.01); *A63C 17/012* (2013.01); *A63C 17/014* (2013.01); *A63C 17/04* (2013.01); *A63C 17/1418* (2013.01); *A63C 17/223* (2013.01); *A63C 17/265* (2013.01); *A63C 2017/1463* (2013.01);

(Continued)

(58) Field of Classification Search

CPC . A63C 17/011; A63C 17/014; A63C 17/0093; A63C 17/0046; A63C 17/265; A63C 2201/02; B62K 21/00; B62K 21/10; B62K 21/20

See application file for complete search history.

(56) References Cited

U.S. PATENT DOCUMENTS 4,214,768 A * 7/1980 Dominy ..... A63C 17/01 280/809

5,879,013 A * 3/1999 Shih ..... A63C 17/01 280/11.28

(Continued)

FOREIGN PATENT DOCUMENTS

CN 204197193 U * 3/2015

*Primary Examiner* — James A Shriver, II
*Assistant Examiner* — Steve Clemmons
(74) *Attorney, Agent, or Firm* — Millman IP Inc.

(57) ABSTRACT

A foot-deck-based vehicle, a front wheel support, and at least one accessory therefor are provided. The foot-deck-based vehicle has a foot-deck with a front end, a rear end, and at least one rear wheel proximal to the rear end. The foot-deck-based vehicle has a front wheel support comprising a pair of wheel interfaces, each of which is couplable to a front wheel, a main body extending between the wheel interfaces and coupled to the foot-deck, and at least one recess in the main body. At least one accessory is snugly securable within the at least one recess of the front wheel support to modify a resistance of the main body to bending under a bending load applied to the front wheel support through the foot-deck when the foot-deck supports a person.

14 Claims, 48 Drawing Sheets

(51) Int. Cl.
*A63C 17/14* (2006.01)
*A63C 17/22* (2006.01)

(52) U.S. Cl.
CPC ..... *A63C 2203/10* (2013.01); *A63C 2203/20* (2013.01)

(56) References Cited

U.S. PATENT DOCUMENTS

| | | | | |
|---|---|---|---|---|
| 6,648,372 | B2 * | 11/2003 | Ojeda, III | A63C 17/0093 150/154 |
| 6,945,542 | B2 * | 9/2005 | Stewart | A63C 17/0093 280/11.27 |
| 7,007,977 | B1 * | 3/2006 | Gallagher | A63C 17/012 280/11.27 |
| 7,628,412 | B2 * | 12/2009 | Colon | A63C 17/01 280/809 |
| 8,002,296 | B2 * | 8/2011 | Meader | A63C 17/01 280/87.041 |
| 8,696,000 | B1 | 4/2014 | Chen | |
| 9,522,710 | B2 * | 12/2016 | Constien | B62H 1/02 |
| 2011/0042913 | A1 * | 2/2011 | Landau | A63C 17/0046 280/87.042 |
| 2016/0129965 | A1 * | 5/2016 | Baron | B62H 7/00 280/87.041 |

* cited by examiner

FOOT-DECK-BASED VEHICLE AND ACCESSORY FOR SAME

CROSS-REFERENCE TO RELATED APPLICATIONS

This application claims priority to and the benefit of U.S. Provisional Patent Application No. 62/442,358 filed Jan. 4, 2017, U.S. Provisional Patent Application No. 62/442,363 filed Jan. 4, 2017, U.S. Provisional Patent Application No. 62/507,375 filed May 17, 2017, and U.S. Provisional Patent Application No. 62/519,939 filed Jun. 15, 2017, the contents of all of which are incorporated herein in their entirety.

FIELD

The specification relates generally to foot-deck-based vehicles and, in particular, in some aspects, to augmenting the usability of foot-deck-based vehicles.

BACKGROUND OF THE DISCLOSURE

Foot-deck-based vehicles such as scooters (also known as kick-scooters) are a popular form of transport and recreation. Some of these foot-deck-based vehicles employ lean-to-steer mechanisms for enabling a rider standing on a foot-deck thereof to steer by shifting their center-of-gravity laterally. Such lean-to-steer mechanisms have a hanger supporting two or more wheels (typically the front) that can pivot about an oblique axis and that is biased by a biasing element towards a neutral steering position in which the rotation axes of the front wheels are normal to a longitudinal (central front-to-back) axis of the foot-deck. The biasing force exerted by the biasing element influences how the hanger responds to shifting of a rider's center-of-gravity.

In addition, the rigidity of the hanger can also influence how responsive the lean-to-steer mechanism is. Traditionally, little consideration is given to the stiffness of the hanger, and attention is focused on reducing the manufacturing cost thereof, and the provisioning of some level of flexibility to provide some suspension between the foot-deck and the front wheels. Further, the rigidity of the hanger influences the shock absorbing ability of the hanger when the front wheels encounter an irregularity in a travel surface, such as a rock or an uneven joint between two sidewalk tiles.

It would be beneficial to at least partially address the above concerns and other issues relating to foot-deck-based vehicles.

SUMMARY OF THE DISCLOSURE

In one aspect, there is provided a foot-deck-based vehicle, which includes a foot-deck with a front end, a rear end, and at least one rear wheel proximal to the rear end, and which further includes a front wheel support. The front wheel support is couplable to the foot-deck and includes a pair of wheel interfaces, each of which is couplable to a front wheel, a main body extending between the wheel interfaces and coupled to the foot-deck, and at least one recess in the main body. The vehicle further includes at least one accessory snugly securable within the at least one recess of the front wheel support, wherein the main body has a first stiffness when the at least one accessory is removed from the at least one recess, and has a second stiffness that is greater than the first stiffness when the at least one accessory is snugly secured within the at least one recess, wherein the first stiffness and the second stiffness are resistances to bending under a bending load applied to the front wheel support through the foot-deck when the foot-deck supports a person.

The at least one accessory can be releasably securable within the at least one recess. The main body can comprise a cellular structure defining the at least one recess. The at least one accessory can be dimensioned to inhibit deformation of the main body when the at least one accessory is fitted in the at least one recess. The at least one accessory can have a portion of uniform profile that engages walls of the at least one recess.

In another aspect, there is provided a front wheel support of a foot-deck-based vehicle, the foot-deck-based vehicle having a foot-deck with a front end, a rear end, and at least one rear wheel proximal to the rear end. The front wheel support includes a pair of wheel interfaces, each of which is couplable to a front wheel, a main body extending between the wheel interfaces and couplable to the foot-deck, at least one recess in the main body, and at least one accessory snugly securable within the at least one recess of the front wheel support, wherein the main body has a first stiffness when the at least one accessory is removed from the at least one recess, and has a second stiffness that is greater than the first stiffness when the at least one accessory is snugly secured within the at least one recess, wherein the first stiffness and the second stiffness are resistances to bending under a bending load applied to the front wheel support through the foot-deck when the foot-deck supports a person.

The at least one accessory can be releasably securable within the at least one recess. The main body can comprise a cellular structure defining the at least one recess. The at least one accessory can be dimensioned to inhibit deformation of the main body when the at least one accessory is fit therein. The at least one accessory can have a portion of uniform profile that engages walls of the at least one recess.

In a further embodiment, there is provided a set of at least one accessory for a front wheel support of a foot-deck-based vehicle, the foot-deck-based vehicle having a foot-deck with a front end, a rear end, and at least one rear wheel proximal to the rear end, the front wheel support comprising a pair of wheel interfaces, each of which is couplable to a front wheel, a main body extending between the wheel interfaces and coupled to the food-deck, and at least one recess in the main body, wherein the main body has a first stiffness when the at least one accessory is removed from the at least one recess, and has a second stiffness that is greater than the first stiffness when the at least one accessory is snugly secured within the at least one recess, wherein the first stiffness and the second stiffness are resistances to bending under a bending load applied to the front wheel support through the foot-deck when the foot-deck supports a person.

The at least one accessory can be releasably securable within the at least one recess. The main body comprises a cellular structure defining the at least one recess. The at least one accessory can be dimensioned to inhibit deformation of the main body when the at least one accessory is fitted in the at least one recess. The at least one accessory can have a portion of uniform profile that engages walls of the at least one recess.

According to yet another aspect, there is provided an accessory for a foot-deck-based vehicle, the foot-deck-based vehicle having a foot-deck with a front end, a rear end, and at least one rear wheel proximal to the rear end, and a front wheel support comprising a pair of wheel interfaces each of which is couplable to a front wheel and a main body extending between the wheel interfaces and coupled to the foot-deck, the accessory comprising at least one engagement element that is securable to the main body of the front wheel support, the at least one engagement element defining at least two securement positions, and a lateral body extending between the at least two securement positions and resisting relative movement of the at least two securement positions.

The at least one engagement element can comprise at least two engagement elements.

In another aspect, there is provided an accessory for a foot-deck-based vehicle, the foot-deck-based vehicle having a handlebar member with a recess extending from a front surface to a rear surface thereof, the accessory comprising a front accessory component and a rear accessory component, the front accessory component and the rear accessory component having complementary coupling interfaces enabling the front accessory component to be coupled to the rear accessory component to retain at least one of the front accessory component and the rear accessory component engaged with the recess to thereby couple the accessory to the handlebar member, at least one of the front accessory component and the rear accessory component comprising a first feature face that is exposed when the front accessory component and the rear accessory component are coupled to the handlebar member.

The complementary coupling interfaces of the front accessory component and the rear accessory component can enable the front accessory component to be releasably coupled to the rear accessory component. The front accessory component can comprise the first feature face, and the rear accessory component can comprise a second feature face that is exposed when the front accessory component and the rear accessory component are coupled to the handlebar member.

The recess can comprise a through-hole in the handlebar member. The through-hole can pass from a front surface of the handlebar member to a rear surface of the handlebar member. At least one of the front accessory component and the rear accessory component can extend at least partially through the through-hole. One of the front accessory component and the rear accessory component can extend through the through-hole. The complementary coupling interfaces of one of the front accessory component and the rear accessory component can comprise a channel that extends generally perpendicularly to a central axis of the through-hole and receives at least one of the complementary coupling interfaces of another of the front accessory component and the rear accessory component.

The through-hole can be tapered and the one of the front accessory component and the rear accessory component can be tapered to limit travel thereof through the through-hole.

The one of the front accessory component and the rear accessory component can comprise a limiting element constructed to abut the handlebar member when the one of the front accessory component and the rear accessory component is inserted into the through-hole to limit travel of the one of the front accessory component and the rear accessory component through the through-hole.

The front accessory component can comprise the first feature face, and the first feature face can comprise at least one light-emitting element.

The first feature face can comprise at least one light-emitting element. The second feature face can comprise a hook.

The first feature face can comprise ornamentation.

In another aspect, there is provided a foot-deck-based vehicle, comprising a handlebar member comprising a recess extending from a front surface to a rear surface thereof, and an accessory, comprising a front accessory component and a rear accessory component, the front accessory component and the rear accessory component having complementary coupling interfaces enabling the front accessory component to be coupled to the rear accessory component to retain at least one of the front accessory component and the rear accessory component engaged with the recess to thereby couple the accessory to the handlebar member, at least one of the front accessory component and the rear accessory component comprising a first feature face that is exposed when the front accessory component and the rear accessory component are coupled to the handlebar member.

The complementary coupling interfaces of the front accessory component and the rear accessory component can enable the front accessory component to be releasably coupled to the rear accessory component.

The front accessory component can comprise the first feature face, and the rear accessory component can comprise a second feature face that is exposed when the front accessory component and the rear accessory component are coupled to the handlebar member.

The recess can comprise a through-hole in the handlebar member. The through-hole can pass from a front surface of the handlebar member to a rear surface of the handlebar member.

At least one of the front accessory component and the rear accessory component can extend at least partially through the through-hole.

One of the front accessory component and the rear accessory component can extend through the through-hole. The complementary coupling interfaces of one of the front accessory component and the rear accessory component can comprise a channel that extends generally perpendicularly to a central axis of the through-hole and receives at least one of the complementary coupling interfaces of another of the front accessory component and the rear accessory component.

The through-hole can be tapered and the one of the front accessory component and the rear accessory component can be tapered to limit travel thereof through the through-hole.

The one of the front accessory component and the rear accessory component can comprise a limiting element constructed to abut the handlebar member when the one of the front accessory component and the rear accessory component is inserted into the through-hole to limit travel of the one of the front accessory component and the rear accessory component through the through-hole.

The front accessory component can comprise the first feature face, and wherein the first feature face can comprise at least one light-emitting element.

The first feature face can comprise at least one light-emitting element. The second feature face can comprise a hook.

The first feature face can comprise ornamentation.

In a further aspect, there is provided a foot-deck-based vehicle, comprising a handlebar member comprising a recess extending from a front surface to a rear surface thereof and constructed to be coupled to an accessory, comprising a front accessory component and a rear accessory component, the front accessory component and the rear accessory component having complementary coupling interfaces enabling the front accessory component to be coupled to the rear accessory component to retain at least one of the front accessory component and the rear accessory component engaged with the recess to thereby couple the accessory to the handlebar member.

The recess can comprise a through-hole in the handlebar member. The through-hole can pass from a front surface of the handlebar member to a rear surface of the handlebar member. The through-hole can be tapered.

In yet another aspect, there is provided an accessory for a foot-deck-based vehicle, the foot-deck-based vehicle having at least one wheel having a hub, a travel surface, and a gapped support structure between the hub and the travel surface, the gapped support structure having at least one gap that is visible when the wheel is mounted on the foot-deck-based vehicle, the accessory comprising a set of at least one wheel inserts, each wheel insert constructed to be securable within one of the at least one gaps.

The wheel inserts can be releasably securable within the visible gaps. The wheel inserts can be constructed to enable at least two of the wheel inserts to be fitted within the one of the at least one gaps and secured therein to prevent separation of the wheel inserts from the one of the at least one gaps. At least one of the set of the wheel inserts can be differently colored than the gapped support structure.

The gapped support structure can have an outer surface, and the wheel inserts can have an outer insert surface that is flush with the outer surface when the wheel inserts are secured in the gaps.

At least one of the set of the wheel inserts can comprise a light-emitting element and a battery for powering the light-emitting element.

Each of the wheel inserts can comprise at least one clip for securing the wheel insert in one of the gaps.

In another aspect, there is provided a foot-deck-based vehicle, comprising at least one wheel comprising a hub, a travel surface, and a gapped support structure between the hub and the travel surface, the gapped support structure comprising at least one gap that is visible when the wheel is mounted on the foot-deck-based vehicle, and at least one clip lock adjacent the at least one cap.

The at least one clip lock can be generally hidden when the at least one gap is empty.

In a further aspect, there is provided an accessory for a foot-deck-based vehicle, the foot-deck-based vehicle having a front wheel assembly, the accessory comprising a nose guard securable to the front wheel assembly.

The nose guard can be releasably securable to the front wheel assembly.

The front wheel assembly can comprise a front axle, and the nose guard can be securable to the front axle.

The front axle can comprise at least one through-hole, and the accessory can further comprise at least one nose guard anchor securable within the at least one through-hole, and the nose guard can be securable to the at least one nose guard anchor.

Each of the at least one nose guard anchor can comprise a post sized to fit through one of the at least one through-hole, a stop coupled to a first end of the post and dimensioned to limit travel of the post through the through-hole, and a coupling interface at a second end of the post distal from the first end for coupling to the nose guard.

In yet another aspect, there is provided a wheel structure for a foot-deck-based vehicle, comprising a rim comprising a tire support structure and having a first rigidity, and a rim support structure secured to the rim and extending towards a wheel support around which the rim support structure freely rotates, the rim support structure having a second rigidity that is less than the first rigidity.

The rim support structure can comprise a hub portion and a set of radially extending spokes extending radially outward from the hub portion.

The rim support structure can comprise a peripheral surface that has a profile that is generally uniform axially, and the rim can comprise at least one recess sized to snugly receive the rim support structure.

The peripheral surface of the rim support structure can have a uniform radius from a rotation axis of the rim support structure.

The rim support structure can further comprise a central recess dimensioned to receive at least one bearing.

The set of radially extending spokes and the rim can comprise mating engagement structures to enable the rim to be secured to the rim support structure.

The rim support structure can comprise polyurethane. The rim support structure and the rim can be light transmissive.

In another aspect, there is provided a foot-deck-based vehicle, comprising a foot-deck, and at least one wheel structure rotatably secured to the foot-deck, each wheel structure comprising a rim comprising a tire support structure and having a first rigidity, and a rim support structure secured to the rim and extending towards a wheel support around which the rim support structure freely rotates, the rim support structure having a second rigidity that is less than the first rigidity.

The rim support structure can comprise a hub portion and a set of radially extending spokes.

The rim support structure can have a uniform peripheral profile, wherein the rim comprises at least one recess sized to snugly receive the rim support structure.

The peripheral surface of the rim support structure can have a uniform radius from a rotation axis of the rim support structure.

The rim support structure can comprise a central recess, and the foot-deck-based vehicle can further comprise at least one bearing secured to the rim support structure, the bearing having a through-hole to rotatably receive the wheel support.

The at least one bearing can comprise at least two bearings securing the rim support structure therebetween.

The set of radially extending spokes and the rim can comprise mating engagement structures to enable the rim to be secured to the rim support structure.

The rim support structure can comprise polyurethane. The rim support structure and the rim can be light transmissive.

BRIEF DESCRIPTIONS OF THE DRAWINGS

For a better understanding of the various embodiments described herein and to show more clearly how they may be carried into effect, reference will now be made, by way of example only, to the accompanying drawings in which.

DETAILED DESCRIPTION

Figure 1:
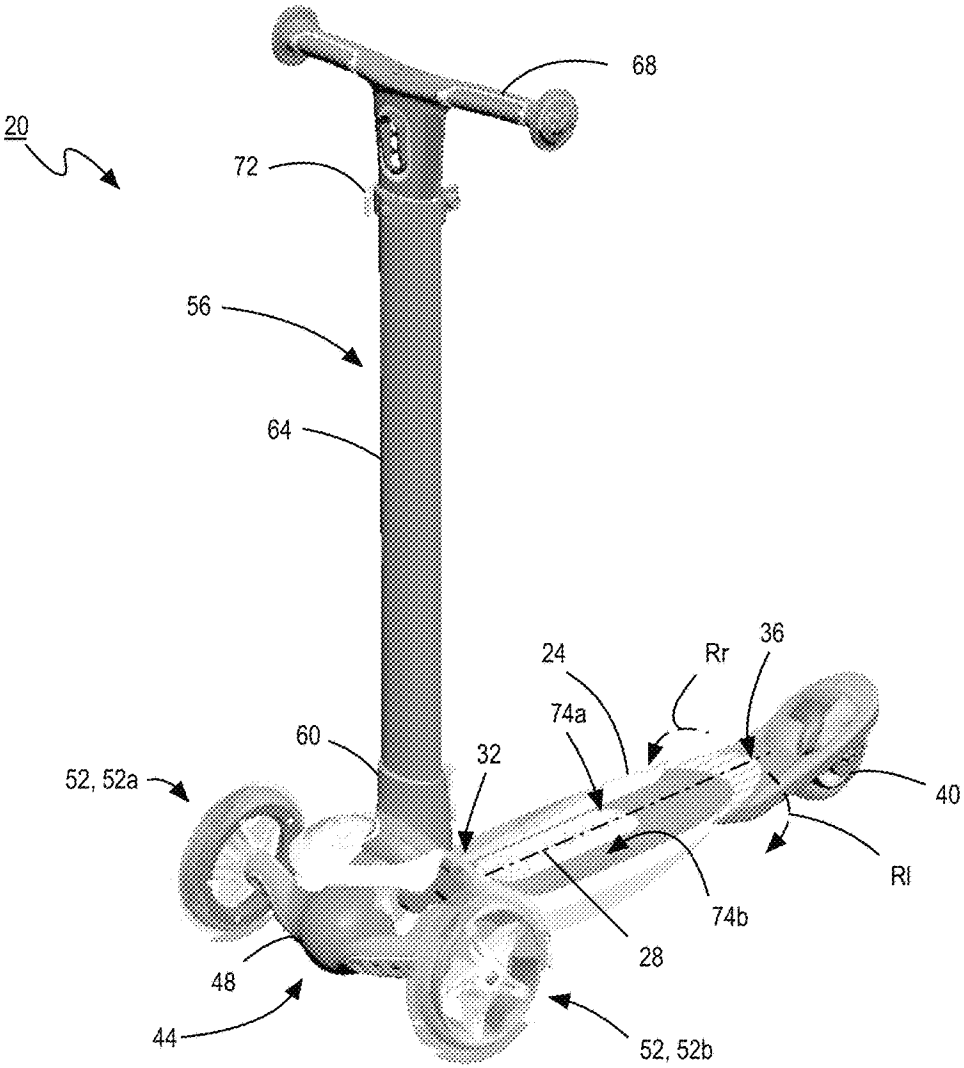
FIG. 1 is an isometric view of a foot-deck-based vehicle that is, in particular, a scooter in accordance with an embodiment.

For simplicity and clarity of illustration, where considered appropriate, reference numerals may be repeated among the Figures to indicate corresponding or analogous elements. In addition, numerous specific details are set forth in order to provide a thorough understanding of the embodiments described herein. However, it will be understood by those of ordinary skill in the art that the embodiments described herein may be practiced without these specific details. In other instances, well-known methods, procedures and components have not been described in detail so as not to obscure the embodiments described herein. Also, the description is not to be considered as limiting the scope of the embodiments described herein.

Various terms used throughout the present description may be read and understood as follows, unless the context indicates otherwise: "or" as used throughout is inclusive, as though written "and/or"; singular articles and pronouns as used throughout include their plural forms, and vice versa; similarly, gendered pronouns include their counterpart pronouns so that pronouns should not be understood as limiting anything described herein to use, implementation, performance, etc. by a single gender; "exemplary" should be understood as "illustrative" or "exemplifying" and not necessarily as "preferred" over other embodiments. Further definitions for terms may be set out herein; these may apply to prior and subsequent instances of those terms, as will be understood from a reading of the present description.

Examples of systems, devices, assemblies, apparatuses, and methods are described below. No example described below limits any subject matter claimed in this patent application. The claims in this patent application may cover mechanical devices, assemblies, methods, and apparatuses that differ from those described below. The subject matter claimed in this patent application is not limited to systems, devices, assemblies, apparatuses, and methods having all of the features of any one embodiment described below. Patentable subject matter described below that is not claimed in this patent application may be claimed in another patent or other application for the protection of intellectual property in the subject matter.

It is also understood that the terms "couple", "coupled", "connect", "connected" are not limited to direct mating between the described components, but also contemplate the use of intermediate components to achieve the connection or coupling.

Embodiment Group 1

Foot-deck-based vehicles, front wheel supports, and accessories therefor are provided herein. The foot-deck-based vehicle has a foot-deck with a front end, a rear end, and at least one rear wheel proximal to the rear end. A front wheel support of the foot-deck-based vehicle has a pair of wheel interfaces each of which is couplable to a front wheel. A main body of the front wheel support extends between the wheel interfaces and is coupled to the foot-deck. At least one accessory is securable to the main body of the front wheel support to increase a rigidity thereof. By using accessories that can be secured to the front wheel support, the rigidity of the front wheel support, and thus its steering responsiveness to leaning of a rider and the stiffness of the suspension of the front end of the foot-deck-based vehicle, can be adjusted as desired.

FIG. 1 shows a foot-deck-based vehicle in the form of a scooter 20 in accordance with an embodiment. The scooter 20 has a foot-deck 24 that has a central longitudinal axis 28 along which the foot-deck 24 extends, a front end 32 and a rear end 36. A single rear wheel 40 is positioned proximal to the rear end 36 of the foot-deck 24.

A front wheel assembly 44 is pivotally coupled to the foot-deck 24 proximal the front end 32 to pivot relative to the foot-deck about a front wheel assembly pivot axis. The front wheel assembly 44 includes a front wheel support 48 (alternatively referred to as a hanger in this embodiment) having a pair of front wheels 52*a*, 52*b* (collectively, front wheels 52) that are rotatably coupled to the front wheel support 48 and are spaced laterally apart.

A handlebar assembly 56 extends generally vertically from a top surface of the foot-deck 24 when the scooter 20 is upright. The handlebar assembly 56 includes a handlebar assembly base 60 that is secured to the foot-deck 24, a handlebar post 64 that is fitted into and secured to the handlebar assembly base 60 via any suitable method, such as bonding, clamping, etc. A handlebar member 68 has a stem that is slidably received within the handlebar post 64 and can be clamped via a quick-release clamp 72 at any position along a range, thereby allowing the handlebar member 68 to be adjusted in height as desired for a rider.

The scooter 20 is a lean-to-steer type vehicle. Steering is achieved by a rider by shifting their center-of-gravity laterally left or right of the central longitudinal axis 28. Thus, the handlebar assembly 56 is provided for the safety of a rider and not to directly steer the scooter 20. Due to the configuration of the scooter 20 described herein, a shift in a rider's center-of-gravity to a right lateral side 74*a* of the foot-deck 24 causes the foot-deck 24 to roll in a direction Rr and the front wheel assembly 44 to pivot right (i.e., clockwise, when viewed from a rider's perspective on the foot-deck 24), causing the scooter 20 to turn right. Similarly, a shift in a rider's center-of-gravity to a left lateral side 74*b* of the foot-deck 24 causes the foot-deck 24 to roll in a direction Rl and the front wheel assembly 44 to pivot left (i.e., counter-clockwise, when viewed from a rider's perspective on the foot-deck 24), causing the scooter 20 to turn left.

The sensitivity of the steering mechanism to rolling of the foot-deck 24 is a steering characteristic. Additionally, the resistance to the pivoting of the front wheel assembly 44 to turn is also a steering characteristic. Further, the pivot range of the front wheel support 44 is another steering characteristic.

Figure 2:
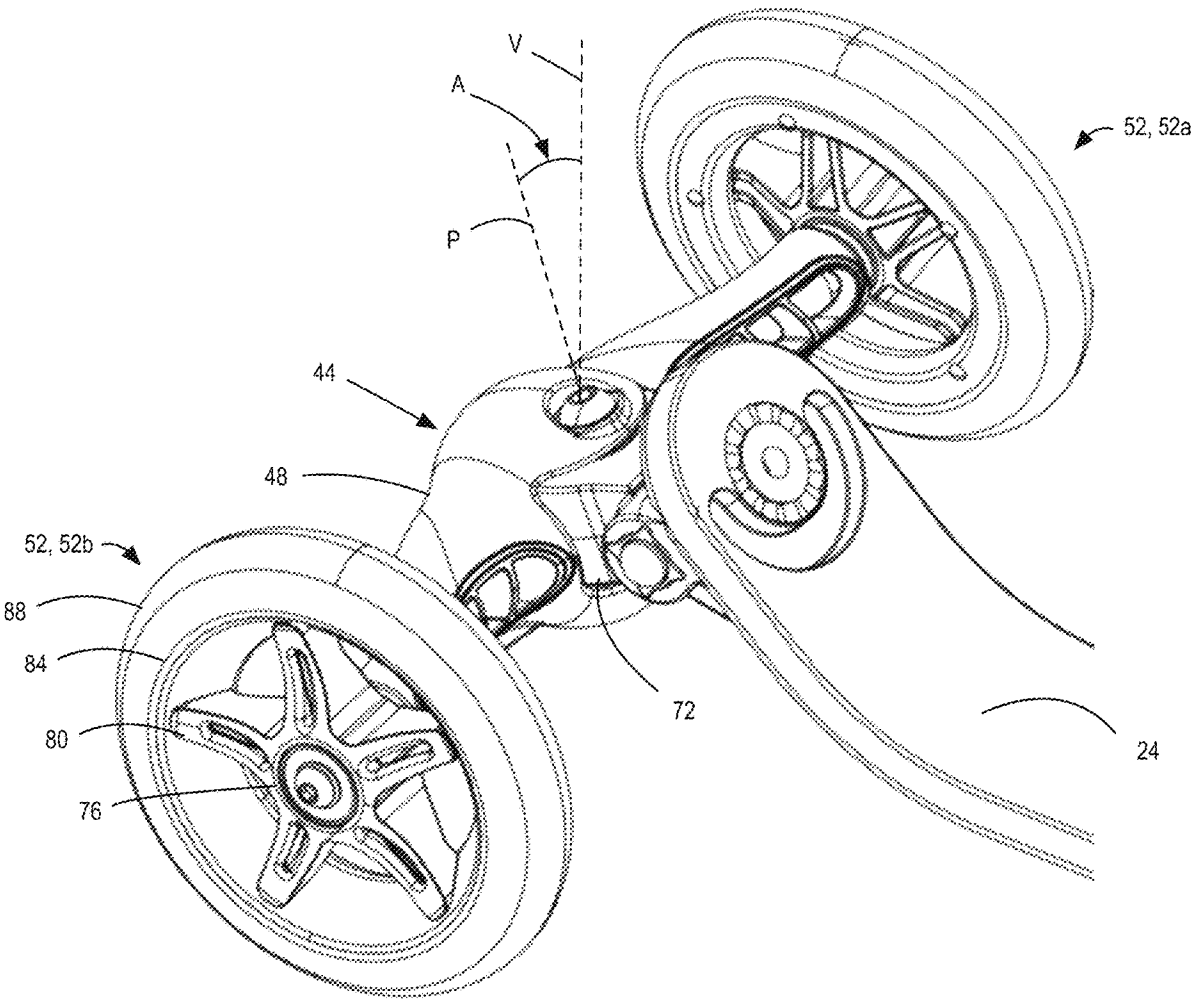
FIG. 2 is an isometric view of a front part of the scooter of FIG. 1 with the steering assembly removed.

Referring now to FIGS. 1 to 3, the front wheel support 48 is elongated and spans between the two front wheels 52. The front wheels 52 are rotatably mounted on the front wheel support 48. The construction of the front wheels 52 can be any suitable construction for a foot-deck-based vehicle. In the illustrated embodiment, the front wheels 52 have a plastic hub 76 and spokes 80 supporting a rim 84. A tire 88 is fitted over the rim 84 and made of a suitable material such as polyurethane or the like.

The front wheel assembly 44 is coupled to the foot-deck 24 via a pivot coupler 72 that enables the front wheel assembly 44 to pivot about a front wheel assembly pivot axis P that is at an acute angle A to a vertical axis V when the scooter 20 is upright, thereby enabling a rider to steer the scooter 20 by leaning to a lateral side (either the right lateral side 74*a* or the left lateral side 74*b*) of the foot-deck 24 corresponding to the direction of the turn sought. In particular, the front wheel support 48 has a pivot coupler recess 92 that occupies most of a central part of the front wheel support 48. A top pivot through-hole 96 passes fully through the front wheel support 48.

The pivot coupler 72 has a generally round front surface 100, a generally flat top surface 104, and a generally flat bottom surface 108 that is parallel to the top surface 104. A centering spring recess 112 in the front surface 100 receives a part of a steering characteristic adjustment structure in the form of an adjustable centering structure; in particular, a coil portion 116 of a resilient torsion member in the form of a centering spring 120, with biasing ends 124 that extend out of the centering spring recess 112. The centering spring 120 is a coil spring that generally resists being coiled and uncoiled, and maintains its characteristics during normal use over the expected lifetime of the scooter 20 due to its resilience. A generally central through-hole 128 passes through the top surface 104 and the bottom surface 108 of the pivot coupler 72.

During assembly, the biasing ends 124 of the centering spring 120 are inserted into the pivot coupler recess 92 of the front wheel support 48 and fitted against features therein. The coil portion 116 of the centering spring 120 is aligned with the centering spring recess 112 and the pivot coupler 72 is concurrently inserted inside of the pivot coupler recess 92 until the coil portion 116 is aligned with the central through-hole 128 of the pivot coupler 72 and the top pivot through-hole 96 of the front wheel support 48. A nut 132 is inserted into the top pivot through-hole 96 and a bolt (not shown) is inserted into a bottom pivot through-hole, through the central through-hole 128 of the pivot coupler 72 and the coil portion 116 of the centering spring 116, and fastened to the nut 132 to secure the front wheel support 48 to the pivot coupler 72. The front wheel assembly pivot axis P extends coaxially through the bolt and the nut 132.

As will be understood, the centering spring 120 is part of a centering structure that exerts an adjustable centering force on the front wheel assembly 44 when the front wheel assembly 44 is urged away from a neutral steering position to urge the front wheel assembly 44 to the neutral steering position. The centering force generated by the centering spring 120 is torsional as the centering spring 120 resists being coiled further or uncoiled, and the centering spring 120 is resilient in that it returns to its original state as shown in FIG. 3.

Figure 3A:
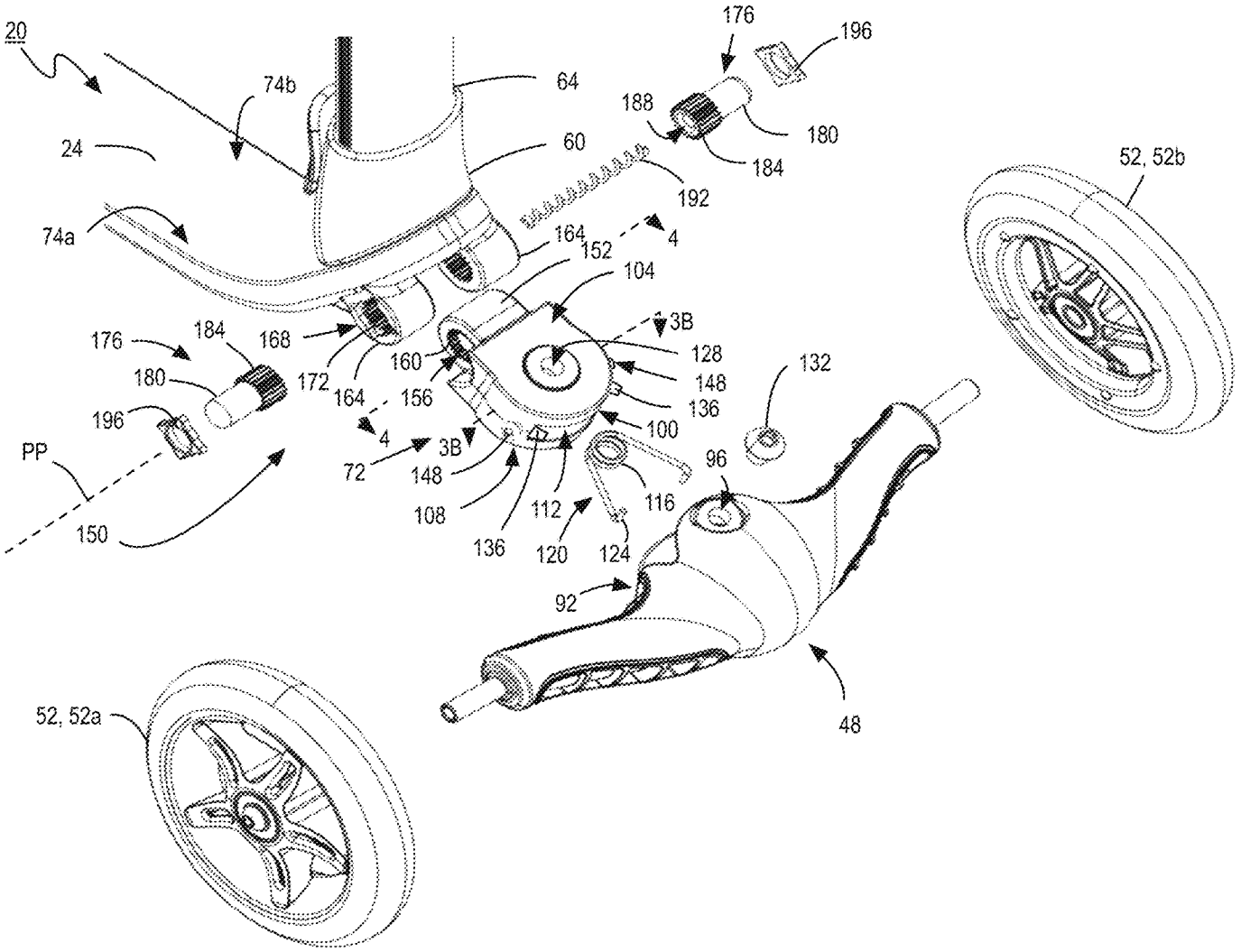
FIG. 3A is an exploded isometric view of the front part of the scooter of FIG. 1, showing a centering structure for biasing a front wheel assembly to a neutral steering position.
Figure 3B:
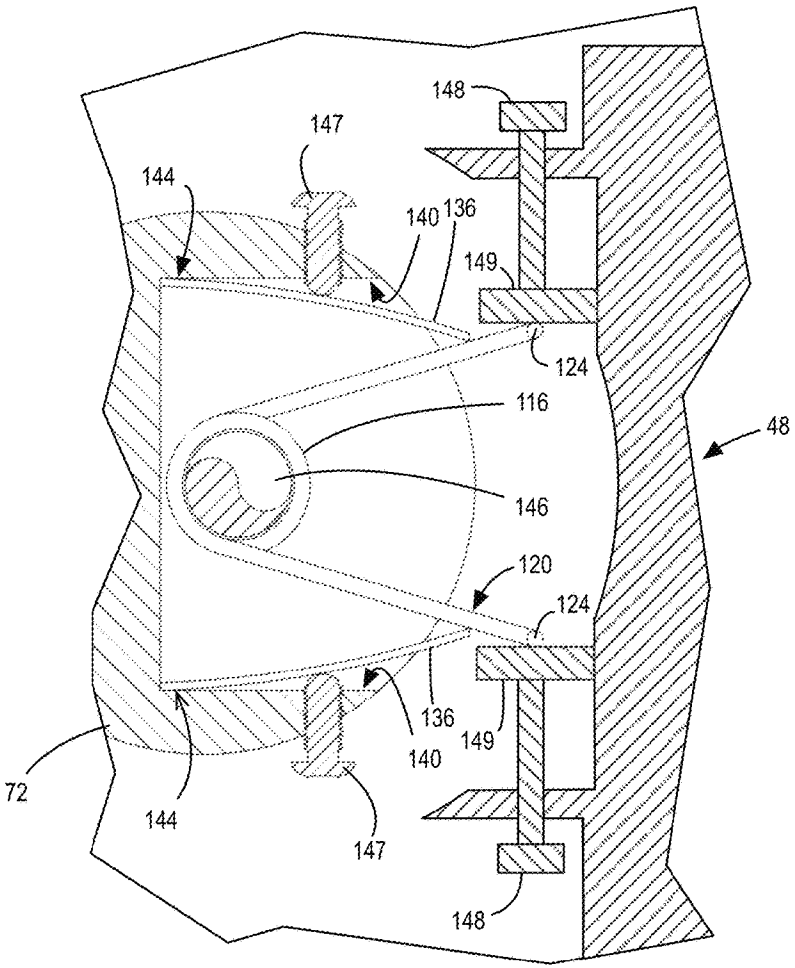
FIG. 3B is a top section view of a front wheel support of the scooter of FIG. 1, taken along line 3B-3B of FIG. 3A, showing a portion of the centering structure.

Referring now to FIGS. 3A and 3B, a first steering characteristic adjustment structure is shown. The steering characteristic adjustment structure is, in this case, a centering structure that includes a pair of pre-torsion leaves 136 that are positioned inside of the centering spring recess 112. The pre-torsion leaves 136 are held in place against side walls 140 of the centering spring recess 112 between the centering spring 120 and corners 144 of the centering spring recess 112. The coil portion 116 of the centering spring 120 is shown secured by a bolt 146 that is secured to the nut 132. Two adjustment screws 147 enable deflection of the pre-torsion leaves 136 away from the side walls 140 so that the pre-torsion leaves 136 impinge upon and deform the centering spring 120, thereby further coiling the centering spring 120 to pre-torsion it. Two compensation screws 148 position two abutment surfaces 149 of the front wheel support 48 that impinge upon the biasing ends 124 of the centering spring 120 when the front wheel support 48 is pivoted away from a neutral steering position. The compensation screws 148 are adjusted to compensate for the position of the biasing ends 124 after pre-torsioning via the adjustment screws 147 so that any pivoting of the front wheel support 48 causes one of the abutment surfaces 149 to impinge upon a corresponding one of the biasing ends 124 of the centering spring 120.

When the centering spring 120 is pre-torsioned, it exerts a greater centering force on the front wheel assembly 44. By adjusting both adjustment screws 147 and both compensation screws 148, the centering force of the centering spring 120 can be adjusted while maintaining a neutral steering position in which the torsion forces exerted by the centering spring 120 on the front wheel assembly 44 are laterally balanced.

The positions of the abutment surfaces define a pivot range of the front wheel assembly 44. Pivoting of the front wheel assembly 44 to one side torsions the centering spring 120 via movement of one of the biasing ends 124 thereof by the corresponding abutment surface 149. Once the corresponding abutment surface 149 has pivoted about the front wheel assembly pivot axis and encounters the other biasing end 124, the other biasing end 124, which is urged by the pre-torsion leaf 136 into a position, inhibits further pivoting of the front wheel assembly 44 via abutment with the corresponding abutment surface 149. In this manner, the centering structure also serves a pivot range control structure.

A pitch adjustment structure 150 of the scooter 20 is configured to enable adjustment of the pitch of the front wheel assembly pivot axis P relative to the vertical axis V when the scooter 20 is upright. The pitch of the front wheel assembly pivot axis P influences how responsive the steering of the scooter 20 is to rolling of the foot-deck 24. The pitch adjustment structure 150 includes a pivotable joint enabling the front wheel assembly 44 to pivot relative to the foot-deck 24 about a pitch pivot axis PP that is generally horizontal and perpendicular to the central longitudinal axis 28 of the foot-deck 24 when the scooter 20 is upright.

The pitch adjustment structure 150 includes a laterally aligned barrel section 152 of the pivot coupler 72 that is generally coaxial with the pitch pivot axis PP when the scooter 20 is assembled. The barrel section 152 has a smooth outer surface and a generally cylindrical hole 156 with a set of features on an inside surface thereof in the form of laterally extending teeth 160. Two laterally aligned barrel sections 164 extend forward from the front end 32 of the foot-deck 24 and are generally coaxial to the pitch pivot axis. Each of the two barrel sections 164 has a smooth outer surface and a generally cylindrical hole 168 with a set of features on an inside surface thereof in the form of laterally extending teeth 172 that correspond to the pattern of the laterally extending teeth 160 in the generally cylindrical hole 156 of the barrel section 152 of the pivot coupler 72. The two barrel sections 164 are spaced apart to enable the barrel section 152 of the pivot coupler 72 to fit between them. The patterns of laterally extending teeth 160 of the barrel sections 152, 164 enable the internal profile of the holes 156, 168 of the barrel sections 152, 164 respectively to align laterally at a discrete number of relative pivotal orientations.

The pivot adjustment structure 150 is releasably lockable in one of a set of discrete pivot orientations via at least one locking member that take the form in this embodiment of a pair of locking plungers 176 that are positioned within the holes 156, 168 of the barrel sections 152, 164. Each of the locking plungers 176 has a generally cylindrical body 180 with a toothed band 184 around a portion of its length. The toothed band 184 has teeth that correspond to the teeth 160, 172 of the holes 156, 168 of the barrel sections 152, 164 respectively so that when the locking plunger 176 is placed within the holes 156, 168, the teeth of the toothed band 184 mesh with those of the holes 156, 168 of the barrel sections 152, 164 respectively. Further, each locking plunger 176 has an end opening 188 adjacent the toothed band 184.

The locking plungers 176 are oriented within the holes 156, 168 such that the end openings 188 face one another. A separating spring 192 is positioned between the locking plungers 176 and is seated within the end openings 188 thereof. An apertured end-cap 196 is secured within an indentation on each external lateral wall of the barrel sections 152, 164. An aperture of the apertured end-cap 196 is dimensioned to permit the generally cylindrical body 180 to extend therethrough, but restrict the toothed band 184 from passing therethrough.

The centering force adjustment structure can further adjust the centering force on the front wheel assembly 44 by enabling more than one centering spring 120 to be deployed simultaneously, or by swapping the centering spring 120 for one with a different resistance to torsion. In this manner, the force-displacement relationship of the one or more centering springs can be adjusted.

Figure 4:
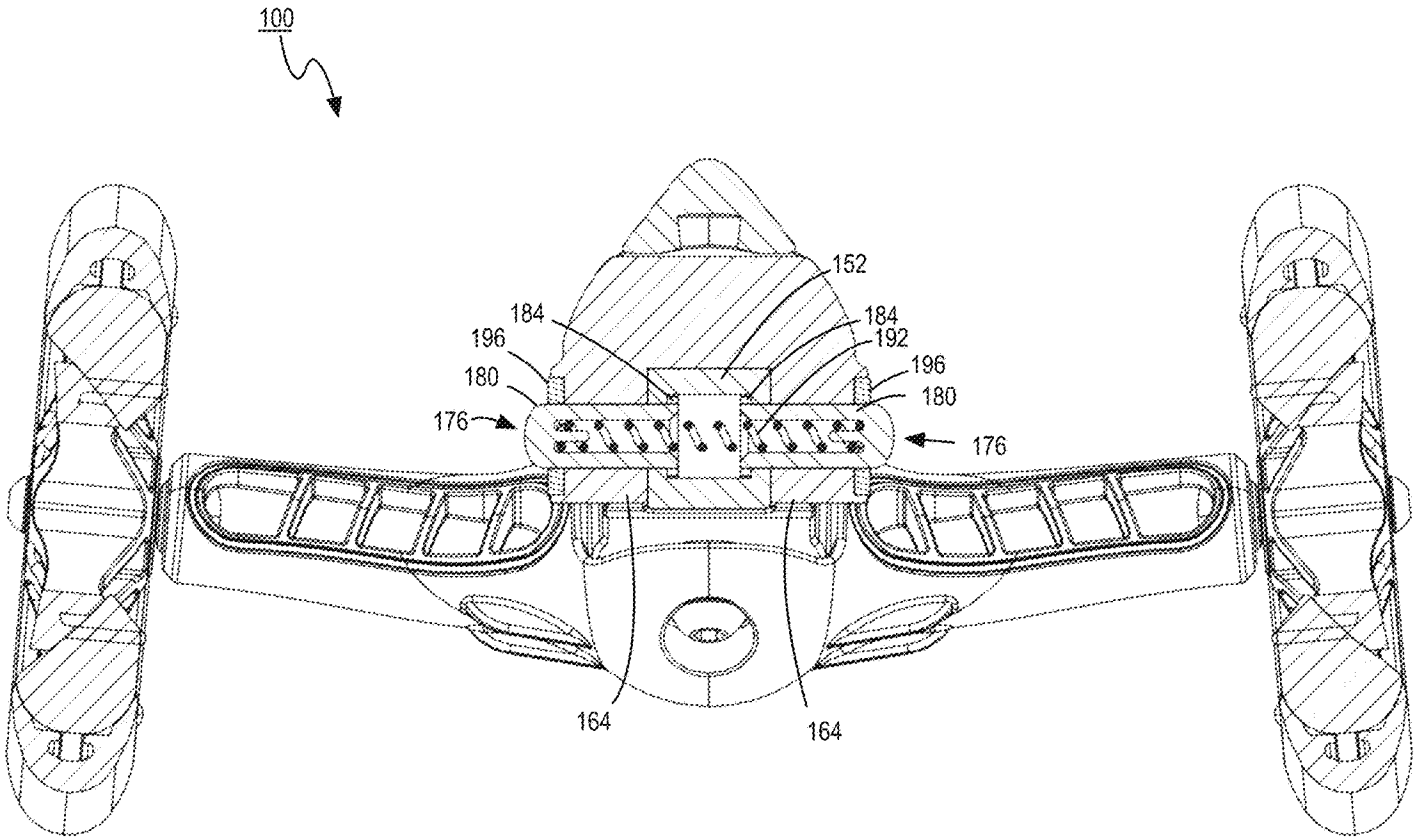
FIG. 4 is a rear section view of a part of the scooter along line 4-4 of FIG. 3A.
Figure 5A:
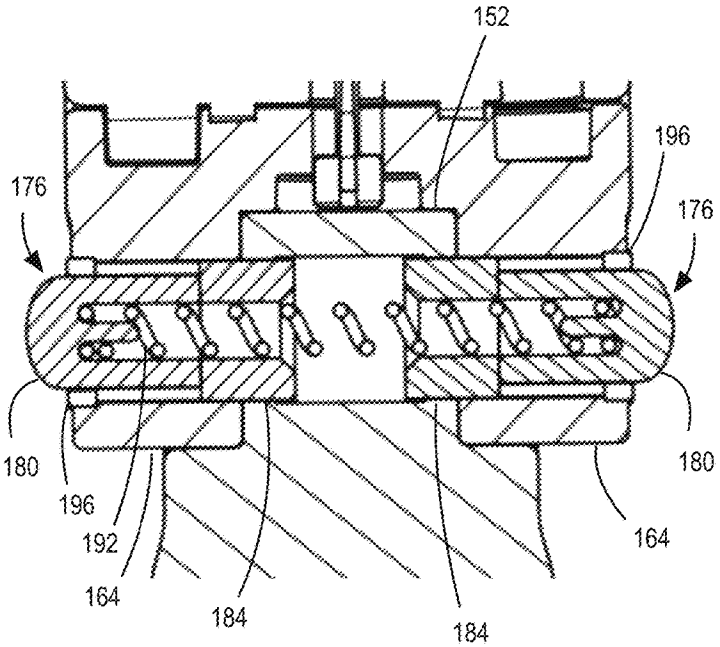
FIG. 5A is a rear section view of a pitch adjustment structure of the scooter of FIG. 1 taken along line 4-4 of FIG. 3, showing locking plungers thereof in a locking position.

As shown in FIGS. 4 and 5A, when assembled, the separating spring 192 sits in the end openings 188 of the locking plungers 176 and urges the locking plungers 176 away from one another so that the generally cylindrical bodies 180 extend through the apertures of the aperture end-caps 196. In this position, the toothed bands 184 of the locking plungers 176 spans the barrel sections 152, 164 and extend into the barrel section 152 of the pivot coupler 72, thus engaging both the teeth 160 of the barrel section 152 and the teeth 172 of the barrel sections 164 and locking the pivotal orientation of the pivot coupler 72 relative to the foot-deck 24.

Figure 5B:
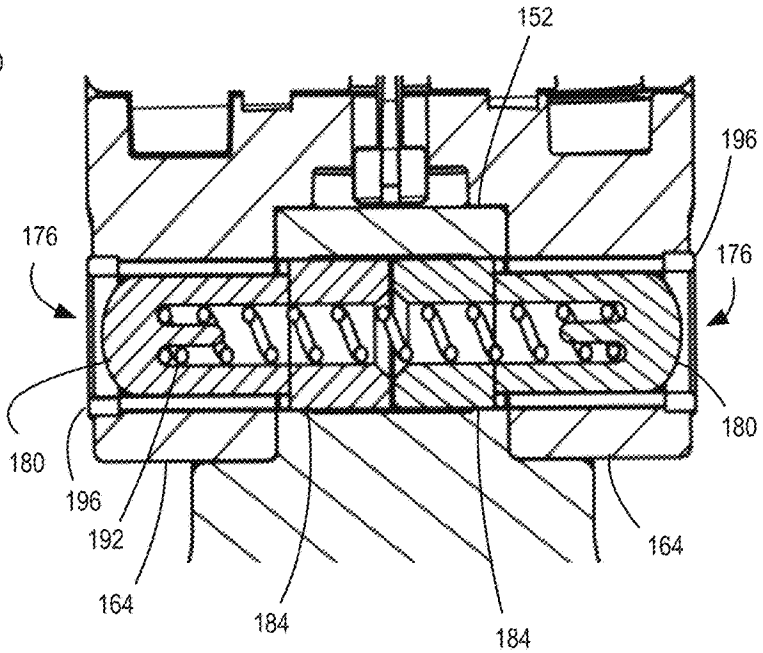
FIG. 5B is a rear section view of the pitch adjustment structure of the scooter of FIG. 1 taken along line 4-4 of FIG. 3, showing the locking plungers thereof in a releasing position.

When it is desired to adjust the pitch of the front wheel assembly pivot axis P relative to the vertical axis V, the locking plungers 176 can be urged inwardly until the toothed bands 184 of the locking plungers 176 disengages the teeth 172 of the barrel sections 164 of the foot-deck 24 and they are both fully housed within the barrel section 152 of the pivot coupler 72, as shown in FIG. 5B. At this point, the pivot coupler 72 can be pivoted relative to the foot-deck 24. Upon achieving the desired pitch of the front wheel assembly pivot axis P relative to the vertical axis V, the locking plungers 176 are released, enabling the generally cylindrical bodies 180 thereof to be urged by the separating spring 192 through the aperture end-caps 196 and locking the pivotal orientation of the pivot coupler 72 relative to the foot-deck 24 and, thus, the pitch of the front wheel assembly pivot axis P relative to the vertical axis V.

Adjustment of the front wheel assembly pivot axis P relative to the vertical axis V modifies how sensitive the steering is in response to rolling of the foot-deck 24. The larger the angle is between the front wheel assembly pivot axis P and the vertical axis V, the more sensitive the steering is in response to rolling of the foot-deck 24.

Thus, by adjusting the adjustment screws 148, and/or by pivoting the pivot coupler 76 relative to the foot-deck 24, the sensitivity of the steering mechanism of the scooter 20 can be easily and safely adjusted.

Figure 6A:
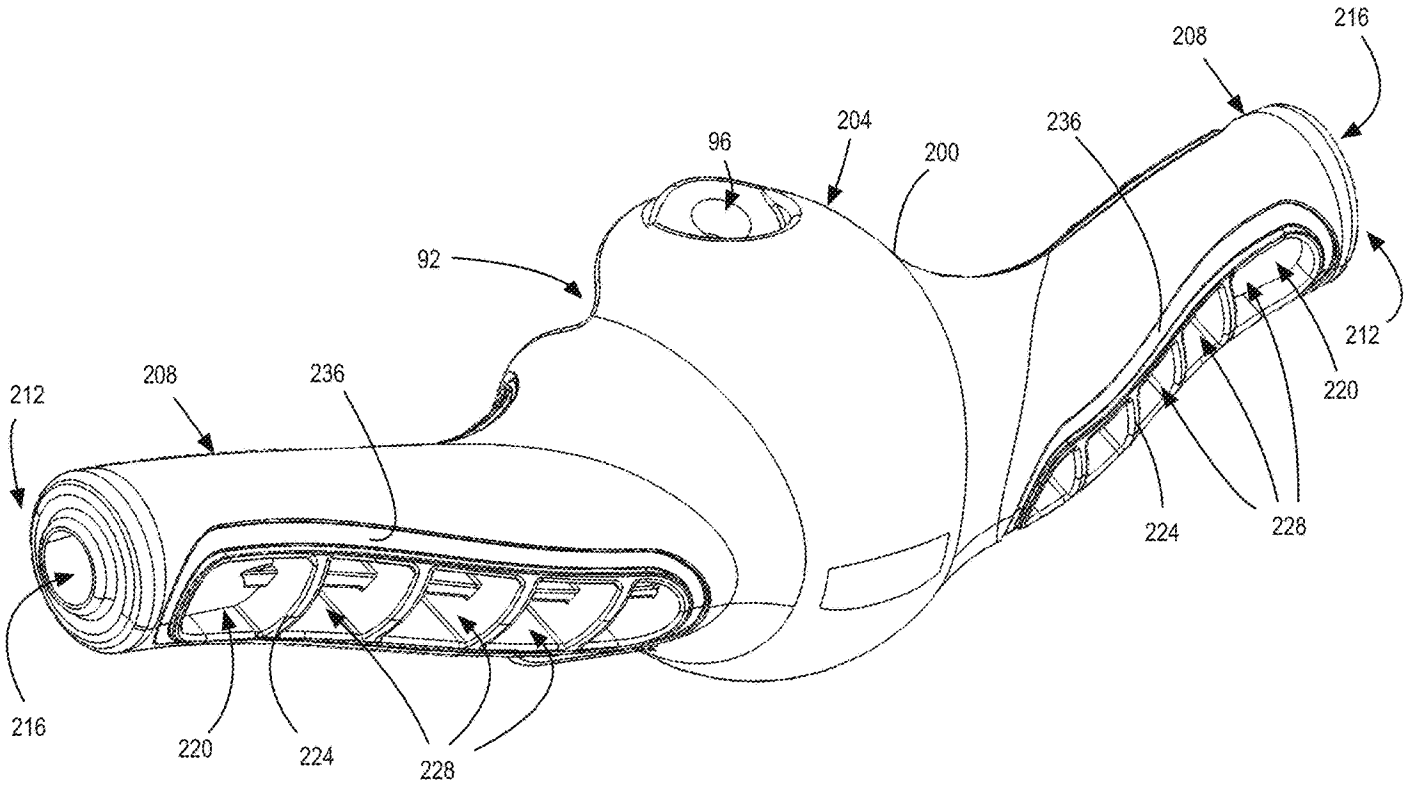
FIG. 6A is a top side perspective view of the front wheel support of the scooter of FIG. 1.
Figure 6B:
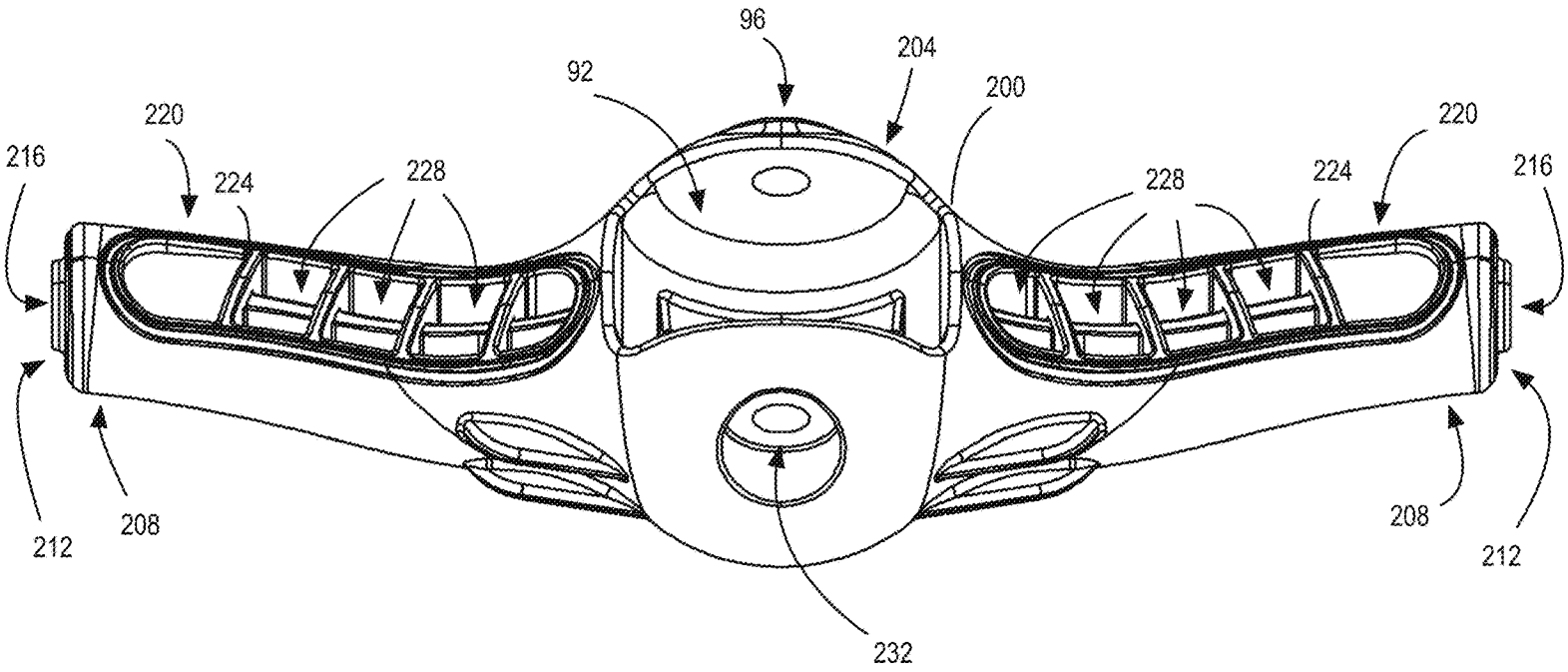
FIG. 6B is a rear bottom perspective view of the front wheel support of FIG. 6A.

FIGS. 6A and 6B show the general structure of the front wheel support 48 in greater detail. The front wheel support 48 includes a main body 200 that has a central hub 204 from which extend two lateral arms 208. At the distal end of each of the lateral arms 208 is a wheel interface 212. In particular, each of the wheel interfaces 212 includes a bore 216 for receiving an axle upon which each front wheel 52 is rotatably mounted.

The front wheel support 48 has two large openings 220 that extend therethrough. Each opening 220 is divided by a cellular structure 224 into a plurality of recesses 228. The cellular structures 224 and the walls of the openings 220 generally extend along a common dimension, causing each recess 228 to be generally uniform in profile as it extends through the front wheel support 48. A bottom pivot through-hole 232 aligns coaxially with the top pivot through-hole 96 for insertion of a bolt.

The front wheel support 48 is made of a material that enables it to be somewhat flexible. The large openings 220 and the cellular structure 224 reduce the material thickness of the lateral arms 208, and increase the flexibility of the lateral arms 208 relative to their flexibility were they solid in construction.

Four recess caps 236 are releasably secured via clips about the large openings 220 on either side of the lateral arms 208. The recess caps 236 are shaped to follow the contour of the large openings 220 while extending slightly into the large openings 220. They are made of a suitable material such as plastic or rubber.

Figure 7A:
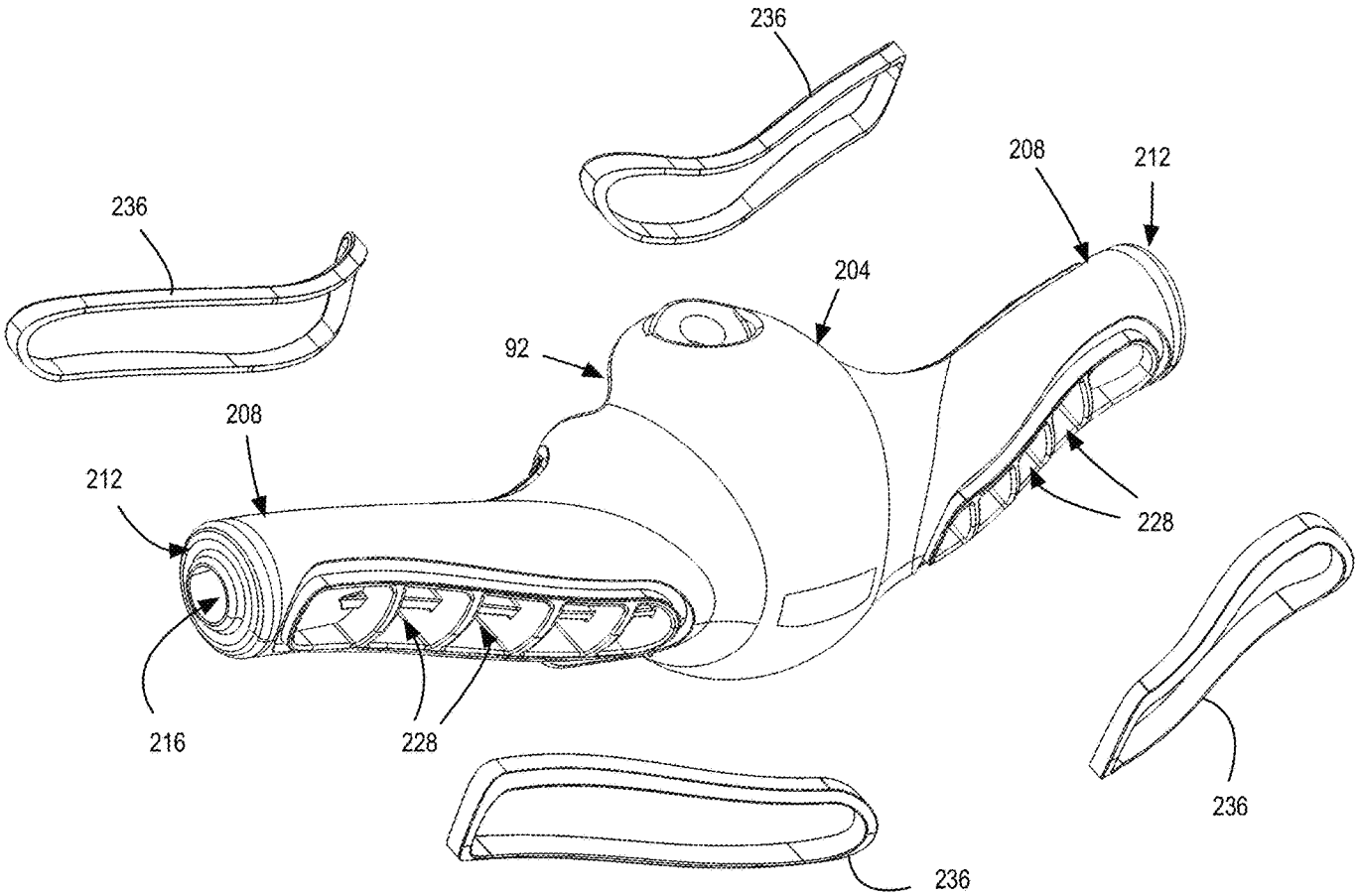
FIG. 7A is an exploded perspective view of the front wheel support of FIGS. 6A and 6B after removal of the recess caps.
Figure 7B:
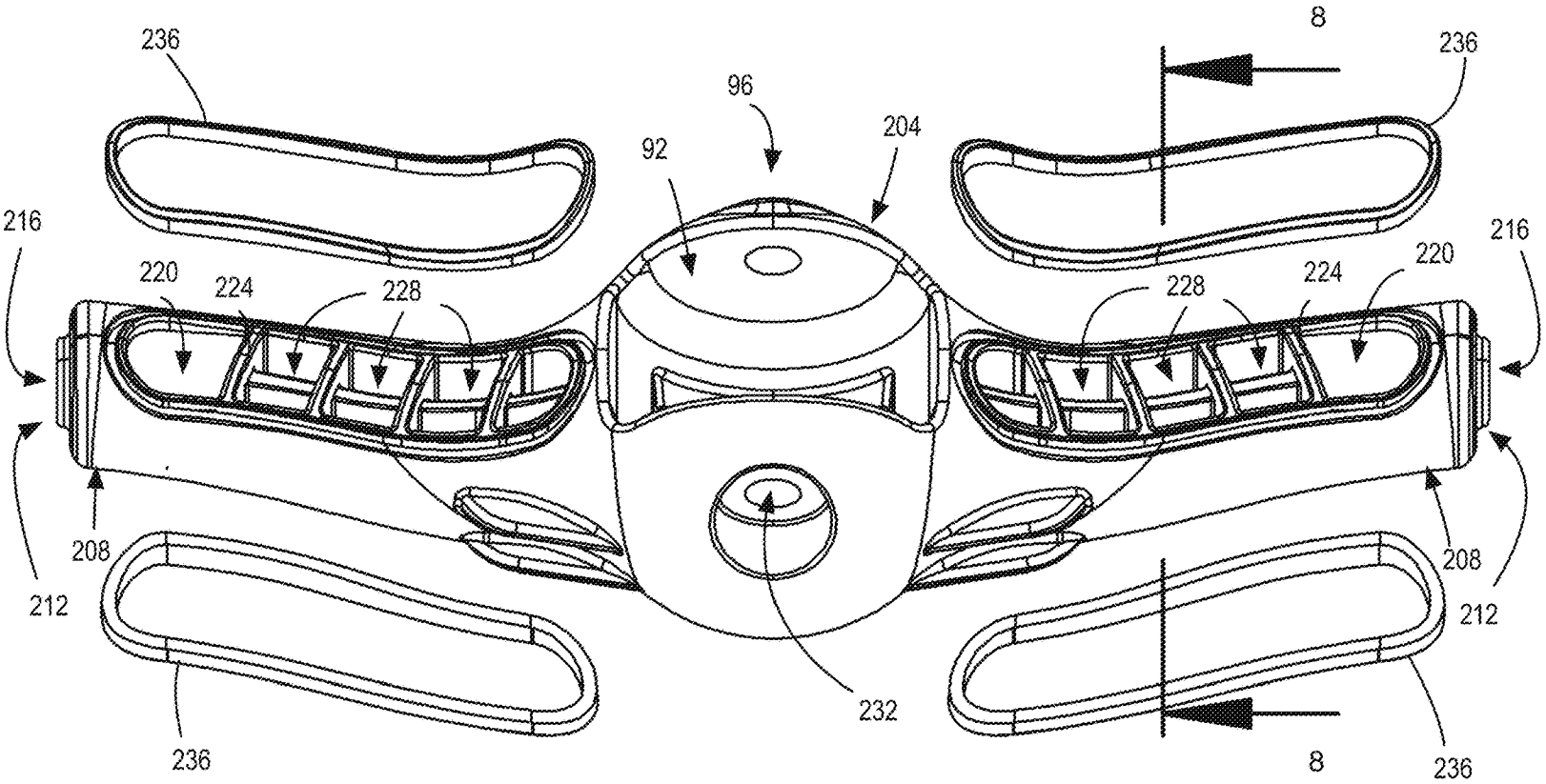
FIG. 7B is an exploded rear perspective view of the front wheel support of FIGS. 6A and 6B after removal of the recess caps.
Figure 8:
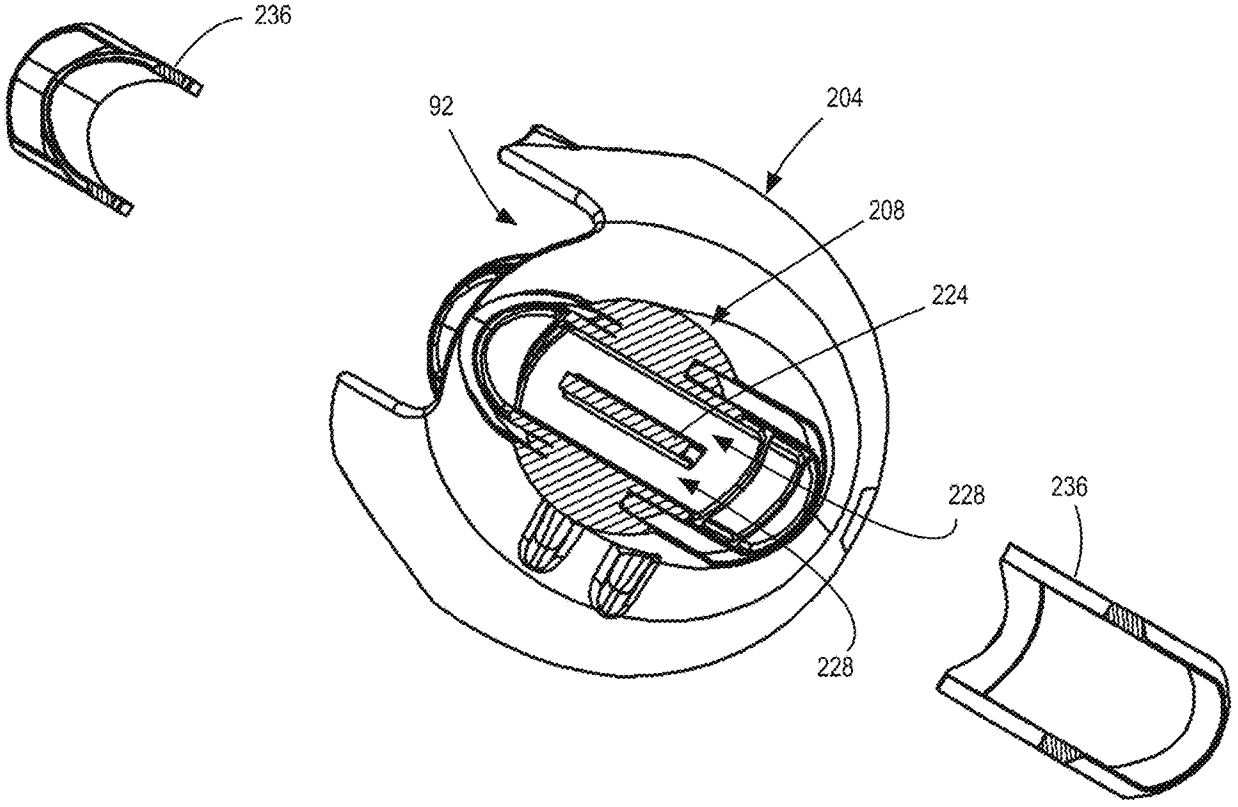
FIG. 8 is a section view of the front wheel support and recess caps of FIG. 7B along line 9-9.

FIGS. 7A, 7B and 8 show the recess caps 236 after being unclipped from the main body 200 of the front wheel support 48. In order to gain full access to the recesses 228, the recess caps 236 are removed.

Figure 9:
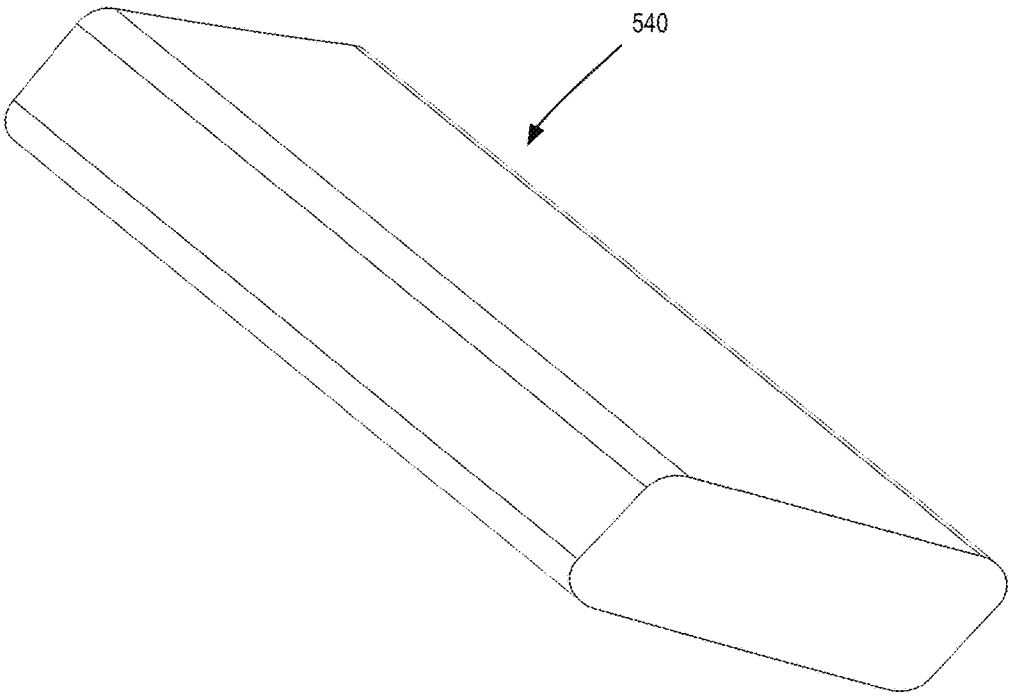
FIG. 9 is a perspective view of an accessory for use with the front wheel support of FIGS. 6A to 8.

FIG. 9 shows an exemplary stiffening accessory in the form of an insert 240 designed for use with the front wheel support 48. The insert 240 has a uniform profile that is dimensioned to snugly fit within one of the recesses 228. When the insert 240 is inserted into a recess 228 and snugly fits therein, deformation of the recess 228 is inhibited as the walls of the recess 228 abut against the insert 240, thereby reducing the flexibility of the main body 200 of the front wheel support 48.

Figure 10:
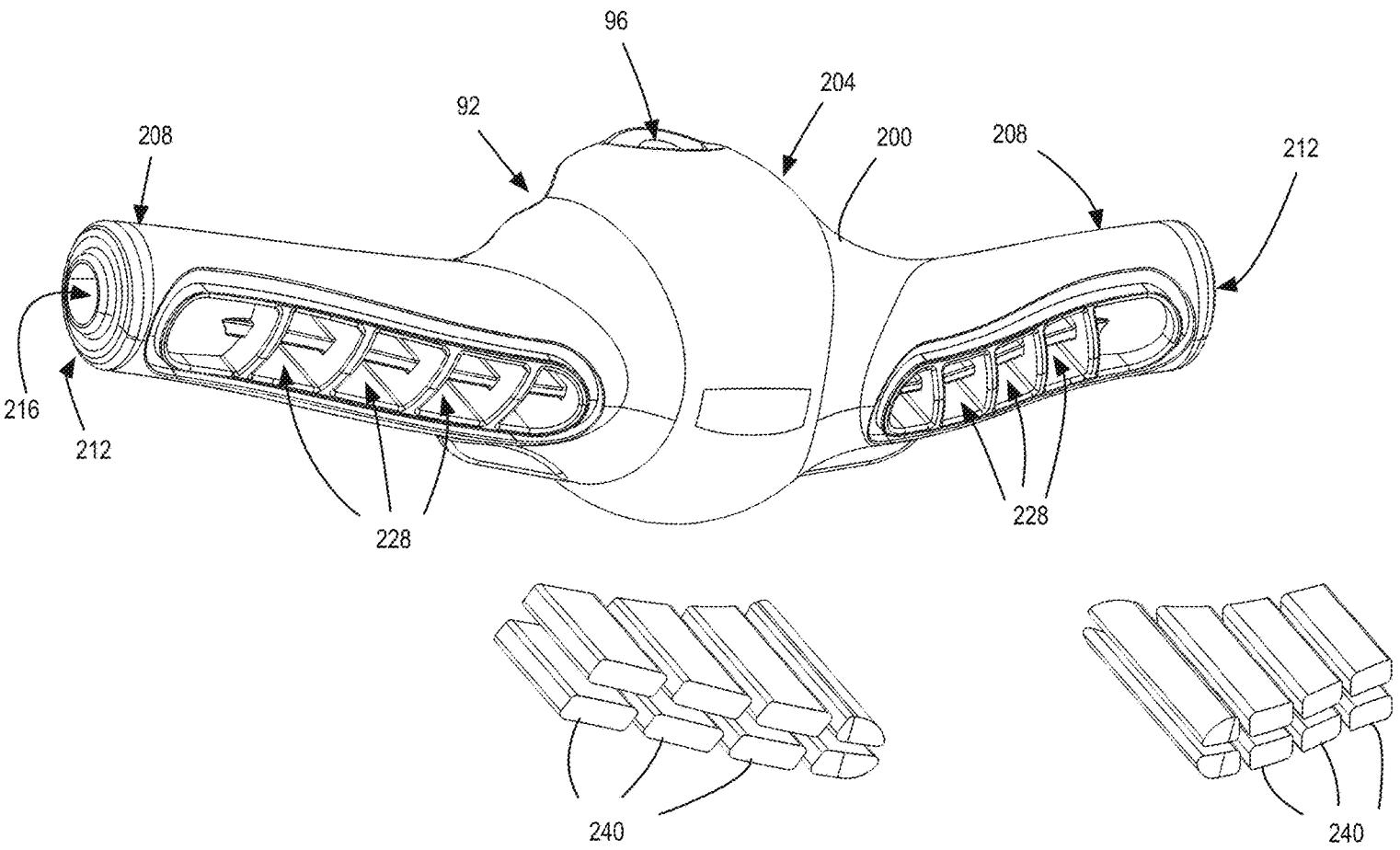
FIG. 10 is an exploded perspective view of a set of accessories of FIG. 9 aligned for deployment in the front wheel support of FIG. 6A to FIG. 8.

FIG. 10 shows a set of inserts 240 being aligned for insertion into the main body 200 of the front wheel support 48. The recess caps 236 have been removed, clearing access to the recesses 228. As the profiles of some of the recess 228 within the large openings 220 vary, the profiles of the corresponding inserts 240 are varied to correspond to thereby permit them to snugly fit within the corresponding recesses 228. Further, as the depth of each recess 228 varies somewhat due to the varying front-to-back (longitudinal) breadth of the lateral arms 208, the inserts 240 also vary correspondingly in length to thereby inhibit flexing of the main body 200 of the front wheel support 48 across its entire longitudinal breadth. The inserts 240 can be visually or otherwise coded to indicate which recess 228 they correspond to.

The inserts 240 are friction-fit into the corresponding recesses 228 of the front wheel support 48. Once placed therein, the snugly-fitting inserts 240 inhibit deformation of the large openings 220 and cellular structure 224 to thereby inhibit flexure (i.e., decrease flexibility) of the lateral arms 208 of the front wheel support 48.

Figure 11A:
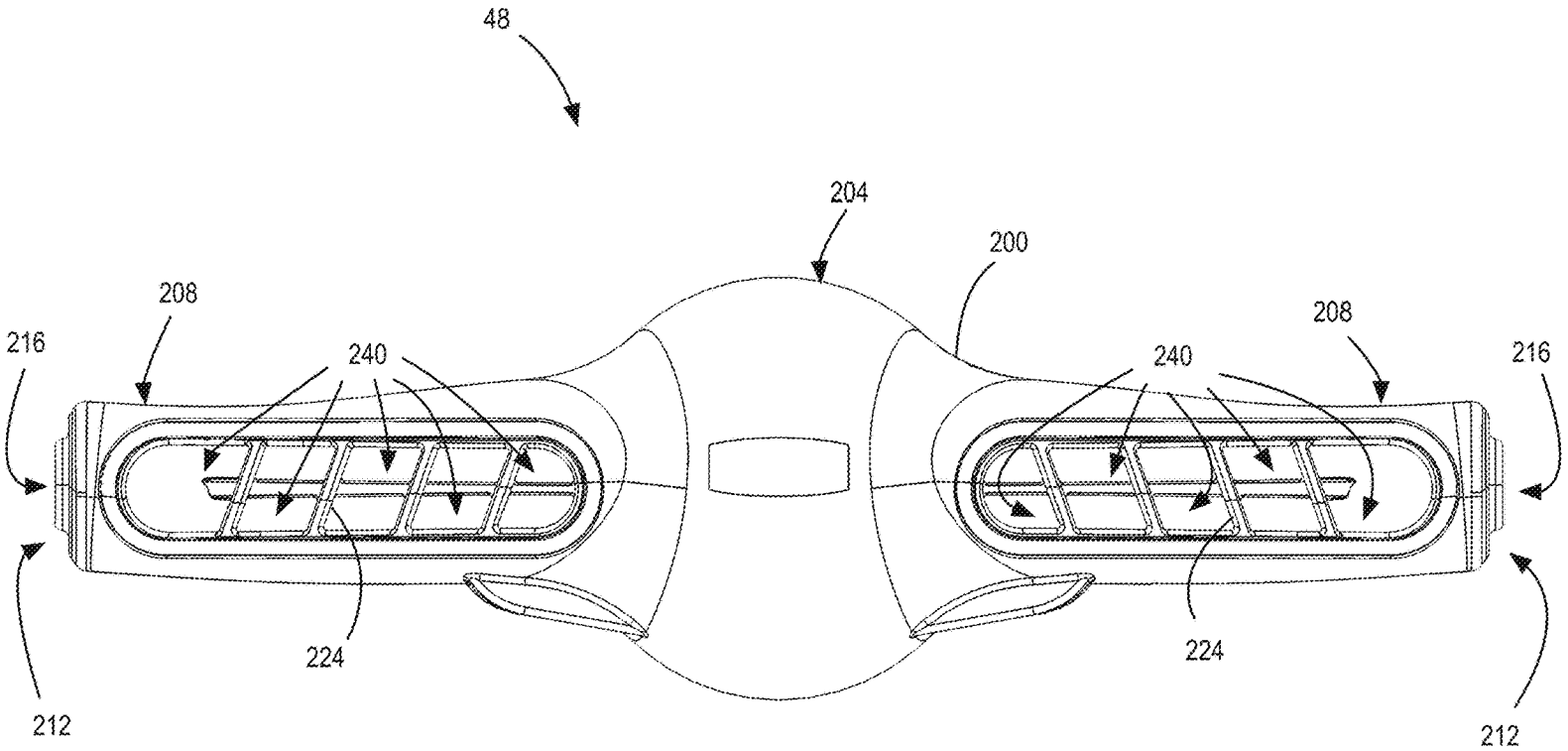
FIG. 11A is a front view of the front wheel support of FIGS. 6A to 8 after insertion of the inserts of FIGS. 9 and 10.
Figure 11B:
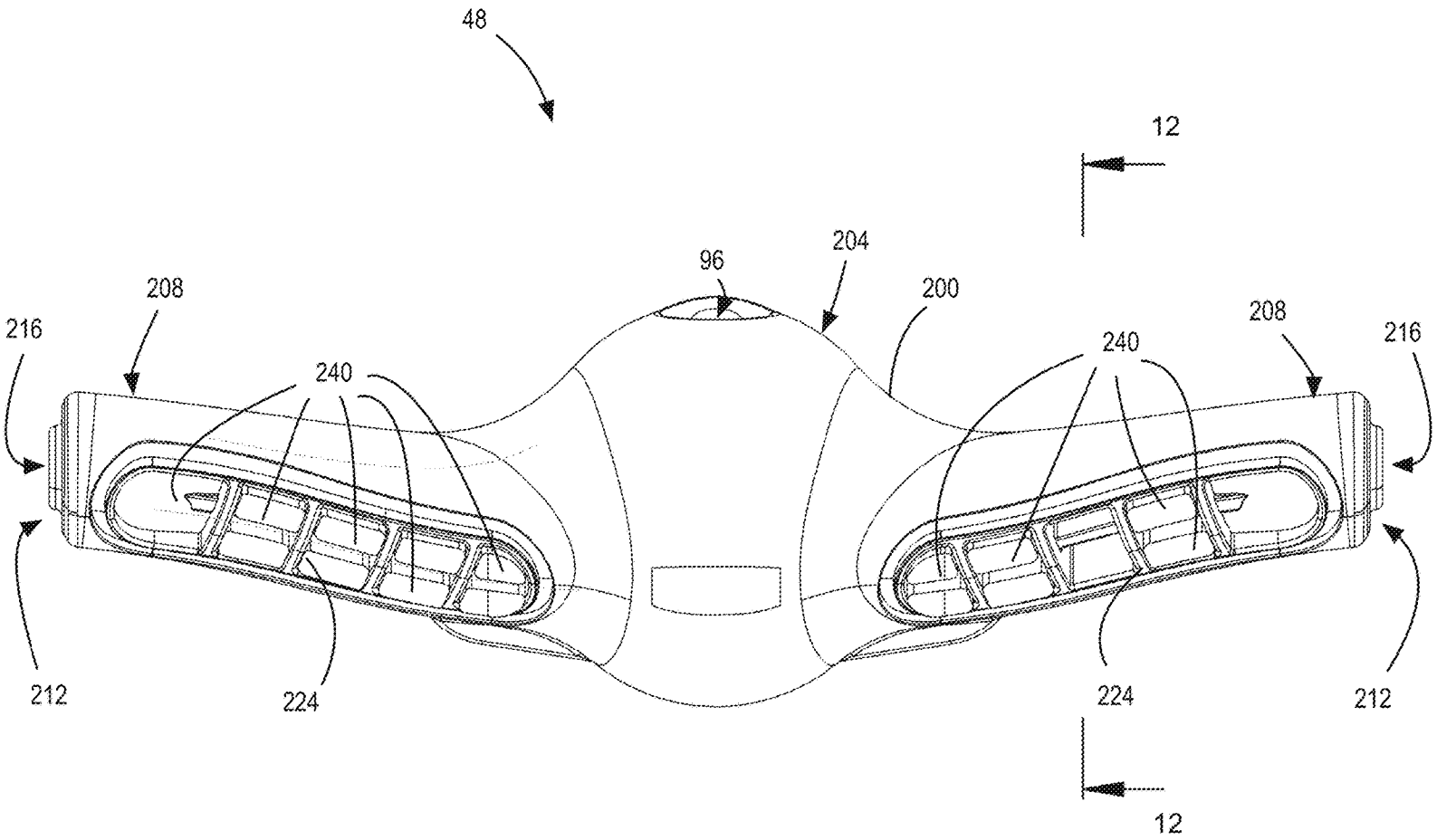
FIG. 11B is a top perspective view of the front wheel support of FIGS. 6A to 8 after insertion of the inserts of FIGS. 9 and 10.
Figure 12:
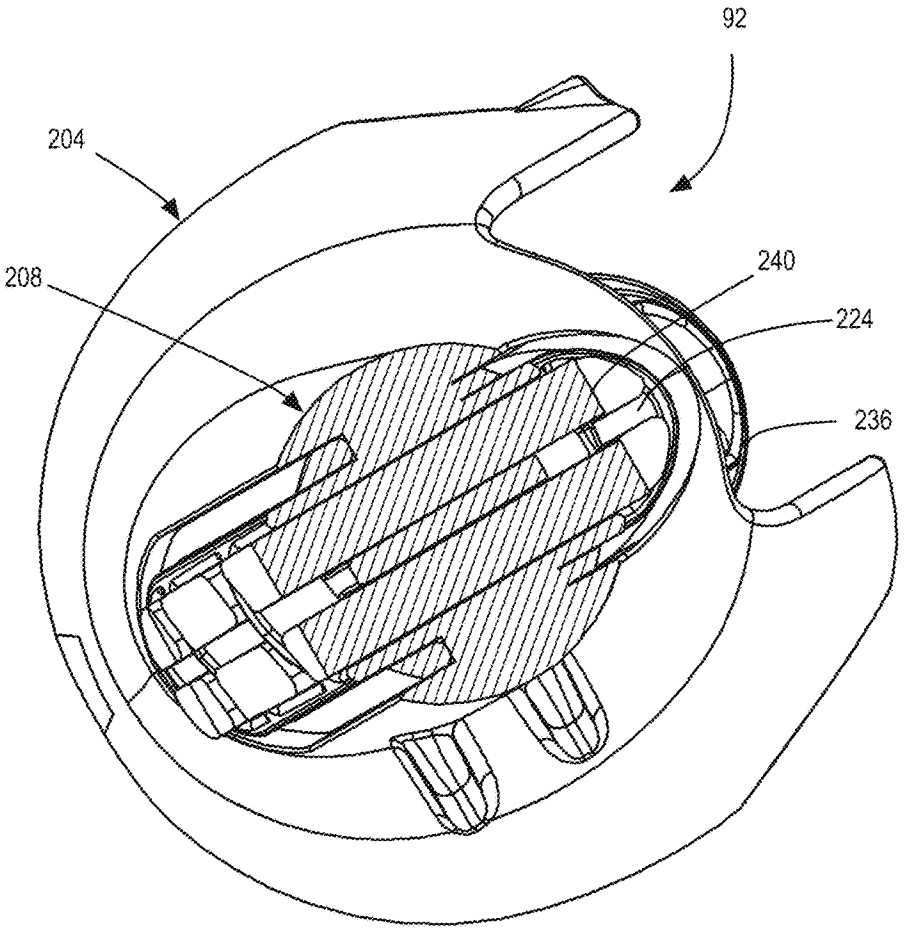
FIG. 12 is a section view of the front wheel support of FIG. 11B along line 12-12.

Upon insertion of the set of inserts 240 into the recesses 228 of the main body 200 of the front wheel support 48, the recess caps 236 are replaced and snapped into place, as is shown in FIGS. 11A, 11B, and 12. As the recess caps 236 extend into the large openings 220, they prevent the inserts 240 from working out of the recesses 228 through continued flexing of the lateral arms 208 of the front wheel support 48.

In order to remove one or more inserts 240, the recess caps 236 can be removed and each insert 240 can be slid out of its recess 228 by application of a push force on one end thereof.

It can be desirable to deploy only some of the inserts where an intermediate amount of flexure is desired for the front wheel support 48.

The recess caps themselves can provide stiffening to the front wheel support in some scenarios by making them of a sufficiently rigid material and/or by having them engage the walls of the large openings and/or recesses, and may optionally be employed in other embodiments.

As will be appreciated, the openings in the front wheel support can be varied in size to provide different flexibility characteristics to the front wheel support. Further, the cellular structure can be varied, such as by making the recesses smaller in profile to stiffen the front wheel support without the inserts. In another embodiment, at least a portion of the cellular structure can be recessed and two or more of the inserts can be connected together so that they may be inserted and removed together.

While the inserts 240 are described as being releasably securable within the recesses 228, the inserts can be made to clip in or otherwise secure permanently within the recesses in other embodiments.

The recesses need not extend fully through the front wheel support, but instead can be any shape that increases the flexibility of the front wheel support. Further, the orientation of the recesses can be varied. For example, in some embodiments, the recesses can at least partially extend generally normal to a travel surface upon which a foot-deck-based vehicle having the front wheel support can travel.

Figure 13:
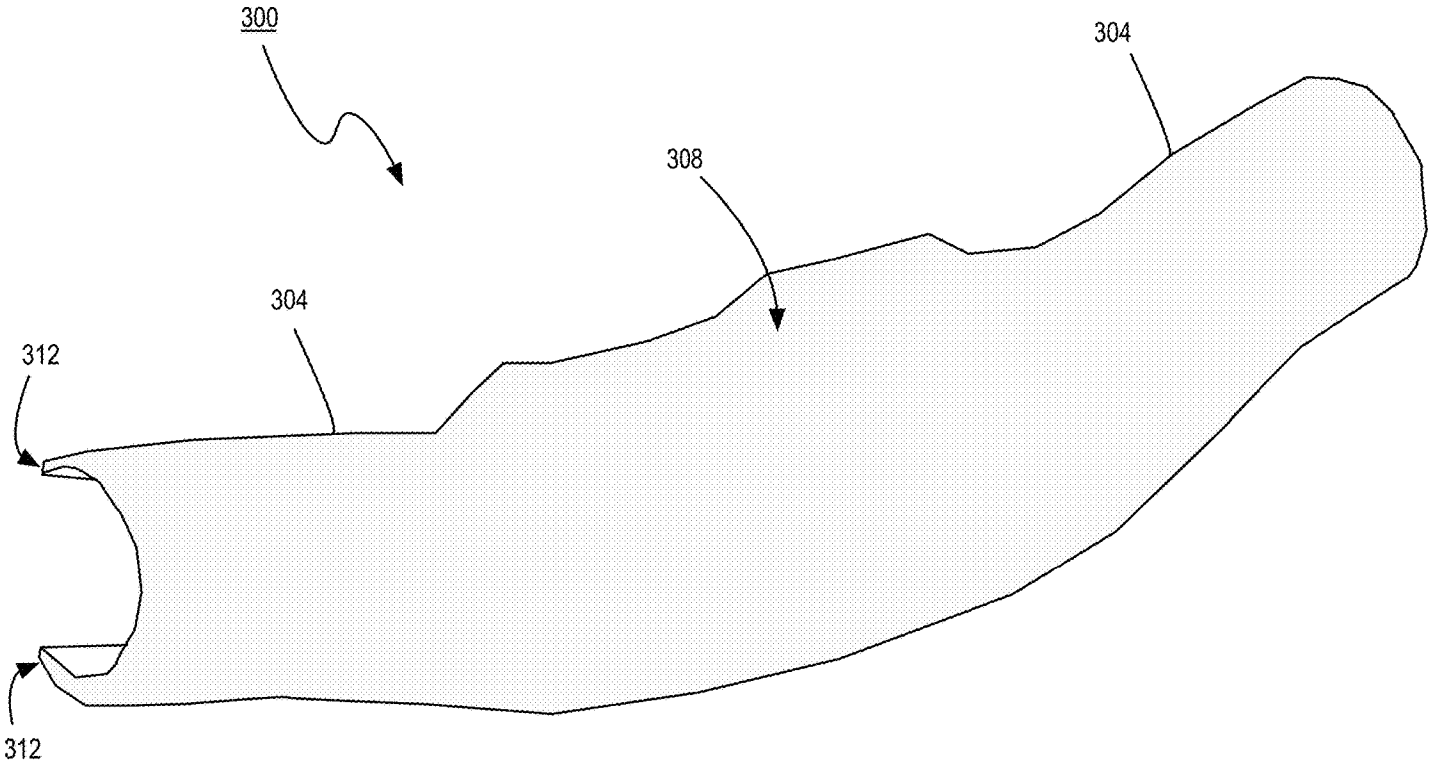
FIG. 13 shows a stiffening accessory in accordance with another embodiment for a front wheel support similar to that of FIG. 6A.

FIG. 13 shows a stiffening accessory 300 for use with a front wheel support of a foot-deck-based vehicle in accordance with another embodiment. The stiffening accessory 300 has at least one engagement element in the form of a pair of clamping portions 304 that extend laterally from a lateral body 308. The clamping portions 304 are designed to clamp into lateral arms of a main body of a front wheel support. The clamping portions have C-shaped longitudinal (front-to-back) cross-sections with overhangs 312 that extend around the lateral arms of the main body of the front wheel support to thereby secure the stiffening accessory 300 to the main body of the front wheel support at at least two securement positions. The lateral body 308 extending between securement positions resists relative movement of the securement positions. The stiffening accessory 300 is made from a material that is sufficiently rigid to increase the stiffness of a front wheel support to which it is secured, but is pliable enough to enable sufficient separation of the overhangs 312 to insert the front wheel support therebetween. Preferably, the stiffening accessory 300 can also be released from the front wheel support once secured thereto.

Figure 14:
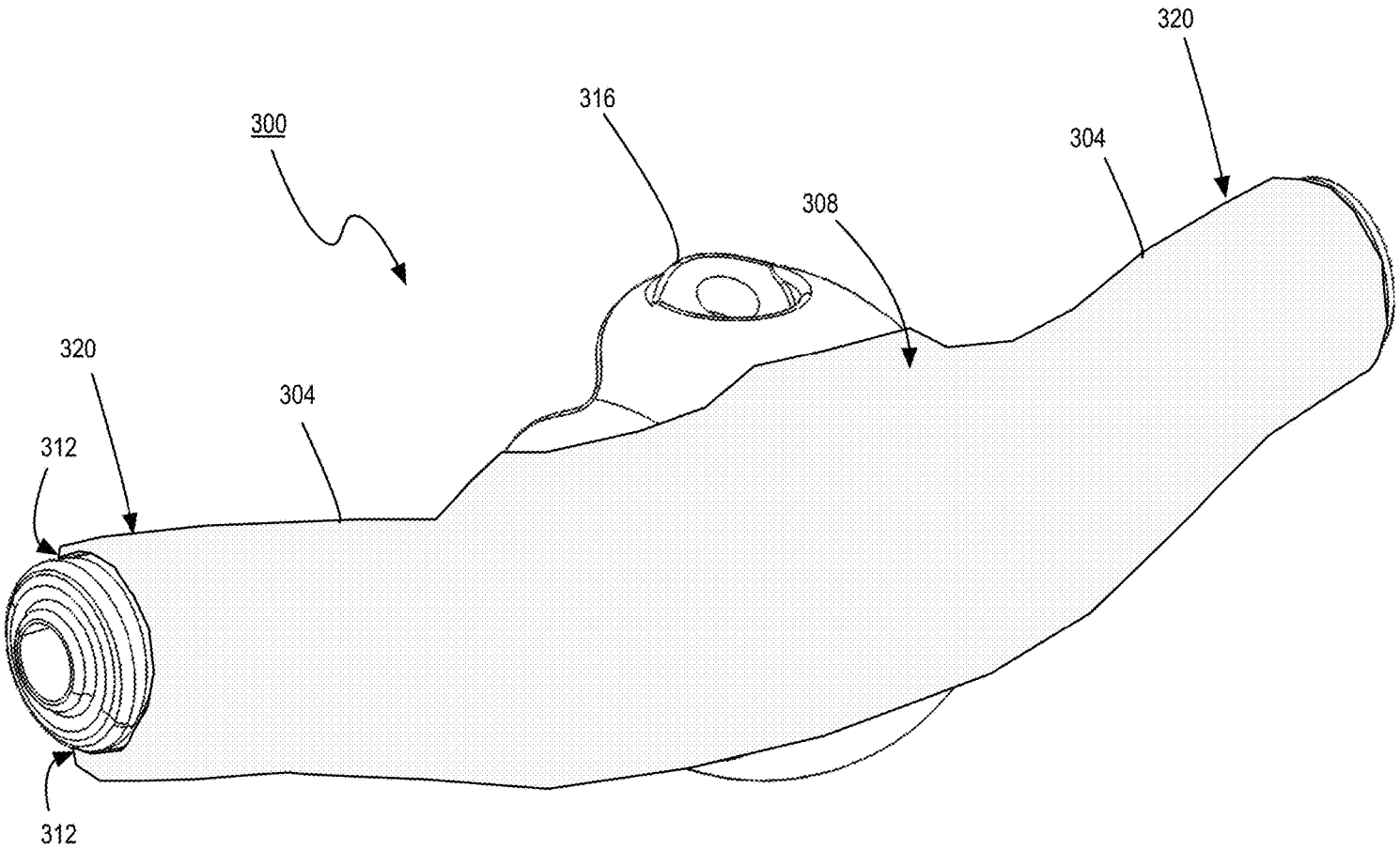
FIG. 14 shows the stiffening accessory of FIG. 13 releasably secured to a front wheel support.

FIG. 14 shows the stiffening accessory 300 secured to a front wheel support 316. The overhangs 312 of the clamping portions 304 have been fitted around the lateral arms of the front wheel support 316 to clamp thereon at at least two securement positions. Due to their construction, a range of securement positions are, in fact, defined by the engagement elements 304. The lateral body 308 of the stiffening accessory 300 extending between securement positions 320 not only stiffens each lateral arm of the front wheel support 316, but also stiffens movement of the lateral arms of the front wheel support 300 relative to one another.

As will be appreciated, the stiffening accessory 300 is configured to work with a front wheel support of a particular design.

Other configurations of a stiffening accessory that is secured about a front wheel support can be tailored for particular front wheel supports and/or needs. For example, the stiffening accessory can take the form of a splint-like element that is secured to the lateral ends of the front wheel support via any suitable means to inhibit flexure of the front wheel support.

While various foot-deck-based vehicles have been described having a front wheel assembly having two front wheels, in other embodiments, the front wheel assembly can have one front wheel. In still further embodiments, the front wheel assembly can have three or more front wheels.

Embodiment Group 2

Described in FIGS. 15-22 are accessories for providing additional features to foot-deck-based vehicles, and foot-deck-based vehicles for using such accessories. The foot-deck-based vehicles include a handlebar member with a recess extending from a front surface to a rear surface thereof. In some embodiments, the recess can be a through-hole that may pass from a front surface of the handlebar member to a rear surface of the handlebar member. The accessories include a front accessory component and a rear accessory component having complementary coupling interfaces enabling them to be coupled together to retain at least one of them engaged with the recess of the handlebar member. At least one of the front accessory component and the rear accessory component has a feature face that is exposed when they are coupled to the handlebar member.

By providing functionality via accessories that can be coupled to the foot-deck-based vehicles after production, such as at a retail location, models of foot-deck-based vehicles can be quickly and economically customized to provide additional desired features.

In various embodiments, the features can include ornamentation, functionality, or a combination of both.

Figure 15:
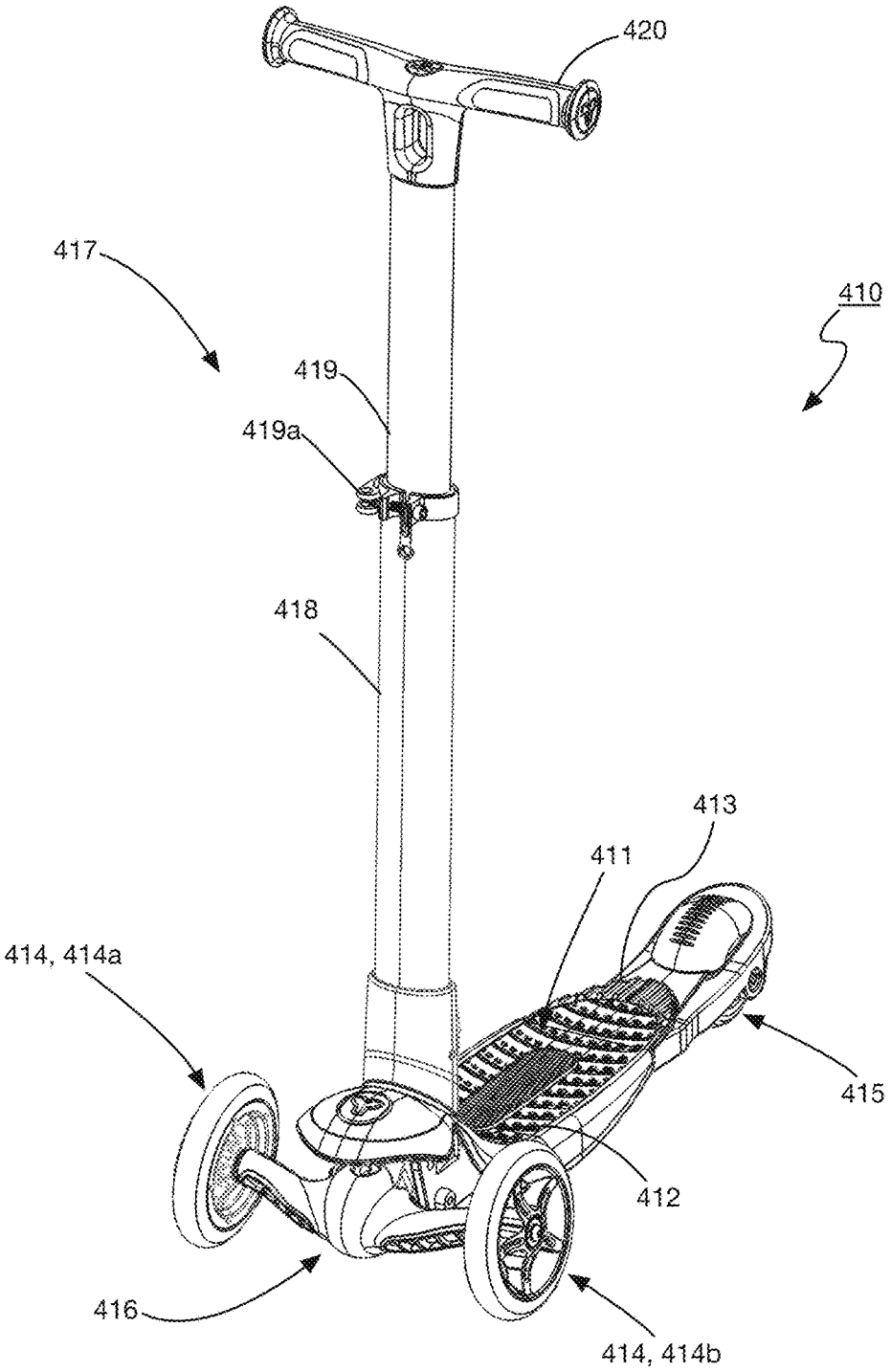
FIG. 15 is a front perspective view of a foot-deck-based vehicle, according to another non-limiting embodiment.
Figure 16A:
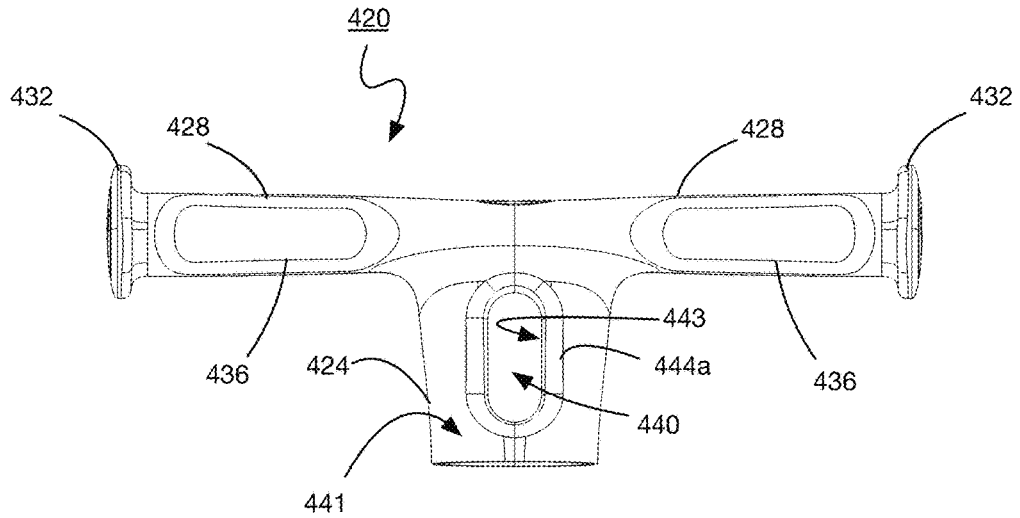
FIG. 16A is a front view of a handlebar member of the foot-deck-based vehicle of FIG. 15.
Figure 16B:
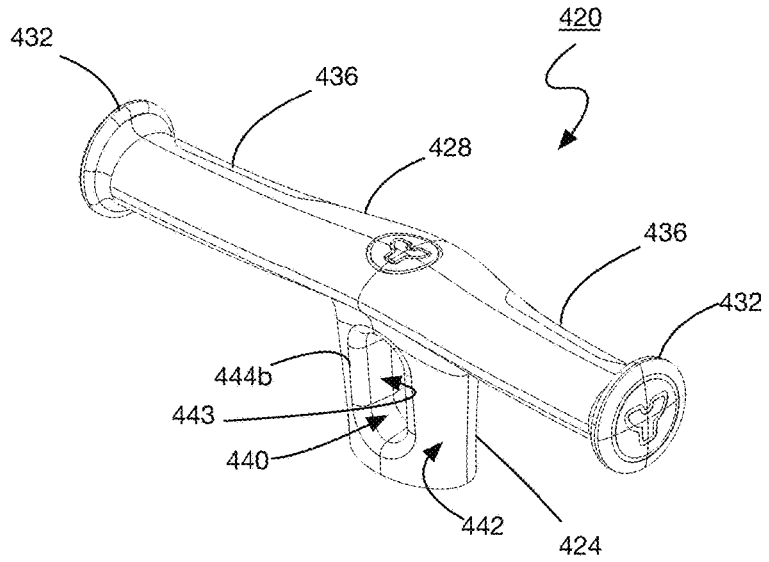
FIG. 16B is a rear perspective view of the handlebar member of FIG. 16A.
Figure 16C:
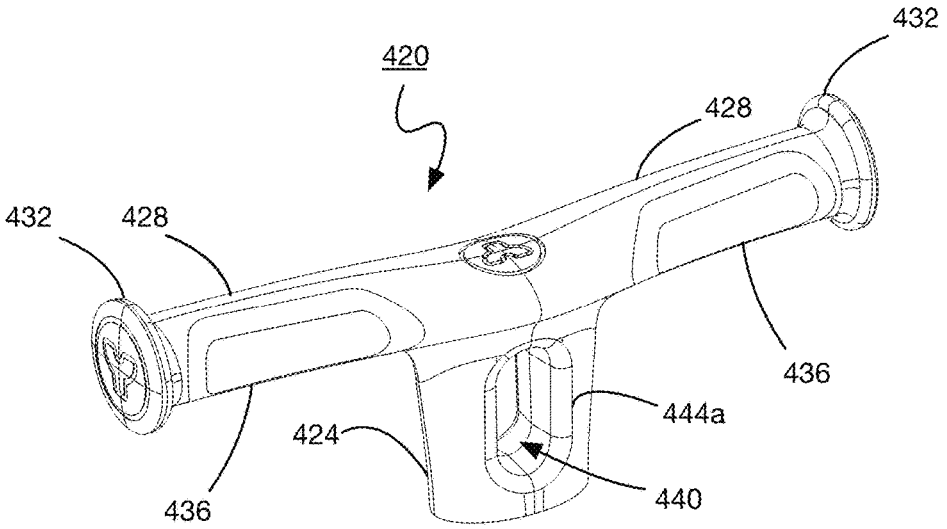
FIG. 16C is a front perspective view of the handlebar member of FIGS. 16A and 16B.
Figure 16D:
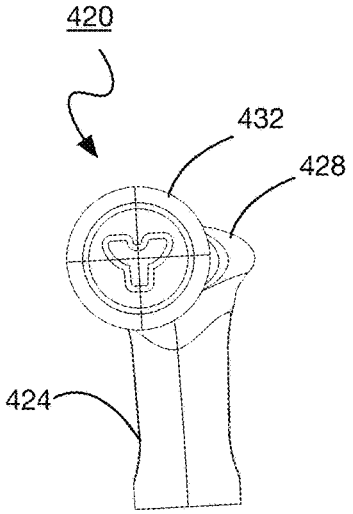
FIG. 16D is a left side view of the handlebar member of FIGS. 16A to 16C.

FIG. 15 depicts an example foot-deck-based vehicle 410, which in the illustrated embodiment is a scooter. Although the example foot-deck-based vehicle 10 is depicted as a scooter, it is understood that the foot-deck-based vehicle 410 is not limited to a scooter and may be, for example, a skateboard, or any other suitable foot-deck-based vehicle. The foot-deck-based vehicle 410 includes a foot-deck 411 having a front end 412 and a rear end 413 and a plurality of wheels. The plurality of wheels includes at least one front wheel 414 proximate the front end 412 and at least one rear wheel 15 proximate the rear end 413. In the example foot-deck-based vehicle 410, the at least one front wheel 414 includes a first front wheel 414*a* and a second front wheel 414*b* that form part of a front wheel assembly 416. However, in some embodiments, the foot-deck-based vehicle 410 may have only one front wheel and, in some other embodiments, the foot-deck-based vehicle 410 may have more than two front wheels. In addition, in the example foot-deck-based vehicle 410, the at least one rear wheel 415 includes a single rear wheel. However, in some embodiments, the foot-deck-based vehicle 10 may have, in some other embodiments, more than one rear wheel.

The front wheel assembly 416 is coupled to the foot-deck 411 at the front end 412 thereof and enables steering of the foot-deck-based vehicle 410 via leaning to a lateral side of the foot-deck 411.

A handlebar assembly 417 extends from the front wheel assembly 416 somewhat perpendicular to the general plane of the foot-deck 411. As steering is performed by leaning on the foot-deck 411, the handlebar assembly 417 is not used to steer the foot-deck-based vehicle 410. The handlebar assembly 417 is thus not rotatable about its main axis that is generally perpendicular to the foot-deck 411 and remains generally aligned with the front wheel assembly 416. In order to facilitate compacting of the foot-deck-based vehicle 10, the handlebar assembly 417 may be locked in an upright position during use, but pivot towards a compacted position adjacent the foot-deck 411 when unlocked.

The handlebar assembly 417 includes a handlebar stem 418 that may be pivotally coupled to the front wheel assembly 416, and a handlebar stem extension 419. The handlebar stem extension 419 is slidably mounted in the handlebar stem 418 and can be fixed at any point within the handlebar stem 418 within a range via a quick-release clamp 419*a*, but may also be set at one of a set of discrete locations therealong in other embodiments. A handlebar member 420 is secured to the handlebar stem extension 419.

The handlebar member 420 is shown in greater detail in FIGS. 16A to 16D. In particular, the handlebar member 420 has a handlebar member base 24 from which two handlebars 428 extend laterally. A handlebar cap 432 terminates each handlebar 428 at its lateral end to prevent slippage of a rider's hand from the handlebar 428. Each handlebar 428 has a rubber grip insert 436 secured therein to enable a rider to more securely grasp the handlebar 428.

The handlebar member 420 has a recess in the form of a through-hole 440 extending from a front surface 441 to a rear surface 442 thereof. The through-hole 440 has a through-hole sidewall 443 that is met by beveled surfaces 444*a*, 444*b* at the front surface 441 and the rear surface 442 respectively. The beveled surfaces 444*a*, 444*b* reduce sharp edges surrounding the through-hole 440.

Figure 17A:
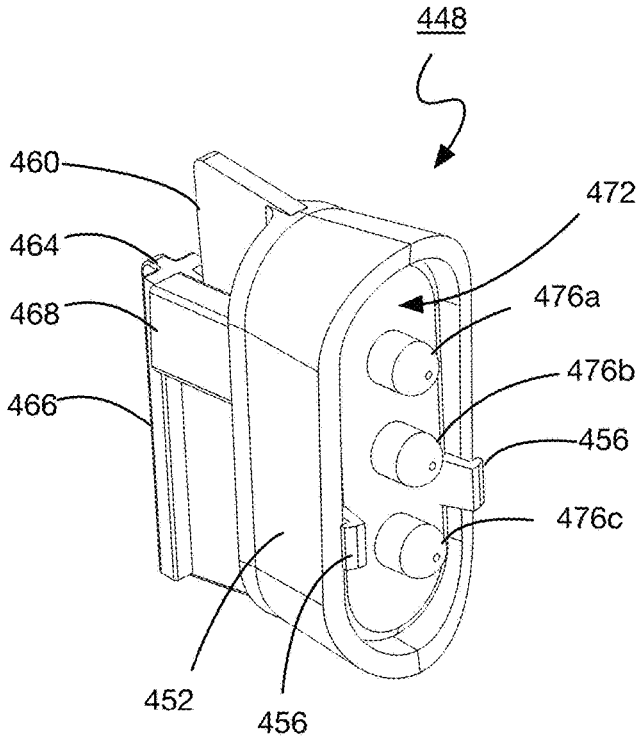
FIG. 17A is a front perspective view of a front accessory component for use with the handlebar member of FIG. 16A.
Figure 17B:
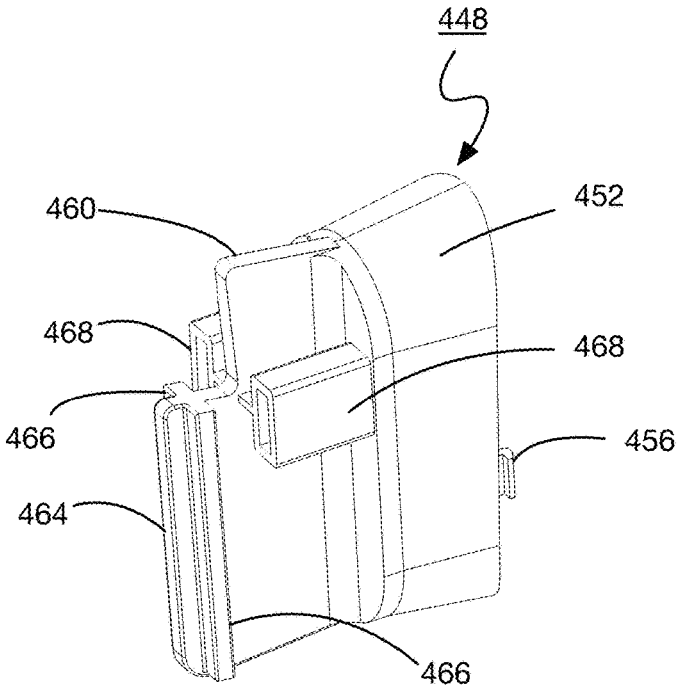
FIG. 17B is a rear perspective view of the accessory component of FIG. 17A.

A front accessory component 448 is shown in FIGS. 17A and 17B. The front accessory component 448 is constructed to be fitted into the through-hole 440 of the handlebar member 420. The front accessory component 448 has a peripheral sidewall 452 that extends around it and corresponds to the shape of the through-hole 440. A pair of limiting elements in the form of limiter tabs 456 extend from a front edge of the peripheral sidewall 452. The limiting elements can take various other suitable forms to limit travel of the accessory component through the through-hole 440. A central fin 460 extends from a back edge of the peripheral sidewall 452 and extends along the height of the front accessory component 448. An upper fin edge 461 of the central fin 460 angles upward and away from the peripheral sidewall 452. The front accessory component 448 has a coupling interface in the form of a stepped rear portion 464 of the central fin 460 has two ridges extending 466 laterally therefrom. A pair of stabilizer blocks 468 extend backwardly alongside the central fin 460.

The front accessory component 448 has a front feature face 472 that includes a set of light-emitting elements 476*a* to 476*c*. The light-emitting elements 476*a* to 476*c* are light-emitting diodes ("LEDs") in the illustrated embodiment, but can be any other type of light-emitting element. The light-emitting elements 476*a* to 476*c* can be switched on and off via a toggle switch that is activated by pressing on the light-emitting elements 476*a* to 476*c*.

Figure 18:
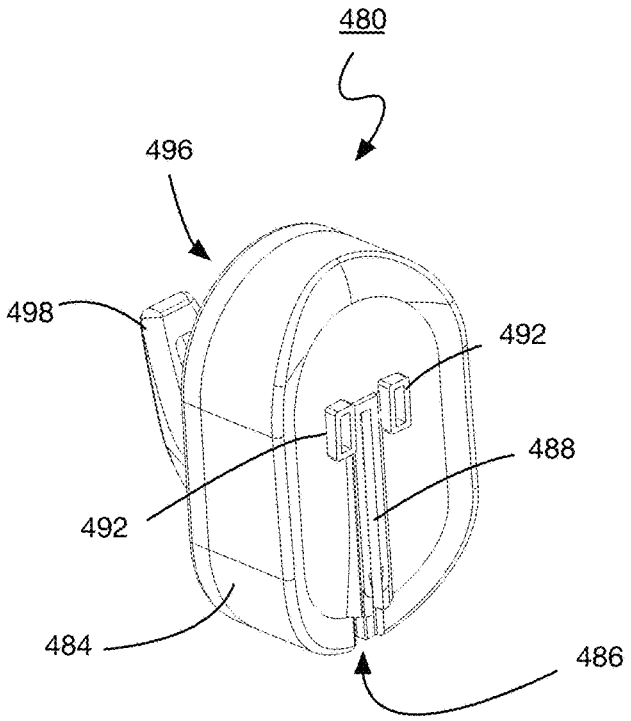
FIG. 18 is a front perspective view of a rear accessory component for use with the front accessory component of FIGS. 17A and 17B and the handlebar member of FIGS. 16A to 16D.

A corresponding rear accessory component 480 is shown in FIG. 18. The rear accessory component 480 has a peripheral sidewall 84 extending around it. The rear accessory component 480 has a coupling interface that is complementary to that of the front accessory component 448, and includes a channel in the form of a cross-shaped slot 486 (not fully shown) that extends upwardly through a bottom portion of the peripheral sidewall 484 and generally perpendicular to a central axis of the through-hole, and through a slotted opening 488 in a front side of the rear accessory component 480. A pair of stabilizer feet 492 are positioned adjacent the slotted opening 488. The rear accessory component 480 has a rearwardly-facing feature face 496. The feature face 496 includes a hook 496 that extends rearwardly and upwardly therefrom.

FIGS. 19A to 19D show the coupling of the rear assembly component 480, the front assembly component 448, and the handlebar member 420. The coupling interface of the front accessory component 448 is aligned with and inserted through the through-hole 440 via the front surface 441 of the handlebar member 420 so that the stepped rear portion 464 extends out of the through-hole 440. The beveled surface 444*a* in the front surface 441 of the handlebar member 420 assists to guide the front accessory component 448 into the through-hole 440. The limiter tabs 456 engage the beveled surface 444*a* and the shape of the front accessory component 448 and the sidewall 441 of the through-hole 440 act to restrict travel of the front accessory component 448 backwards through the through-hole 440.

Figure 19A:
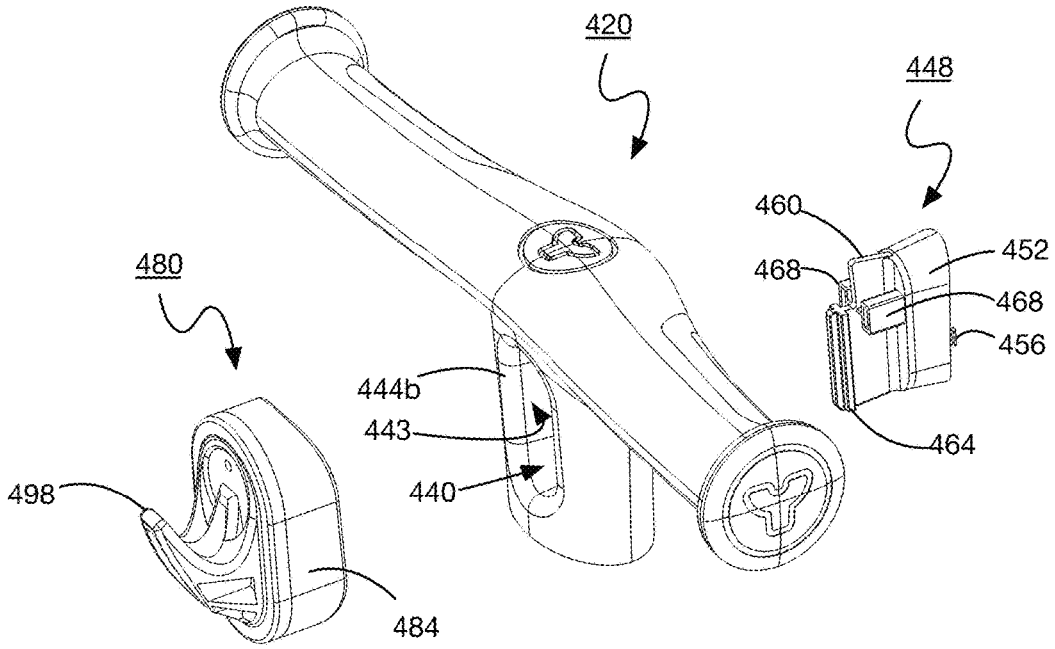
FIG. 19A is a rear perspective view of the front accessory component of FIGS. 17A and 17B and the rear accessory component of FIG. 18 being aligned for coupling with the handlebar member of FIGS. 16A to 16D.
Figure 19B:
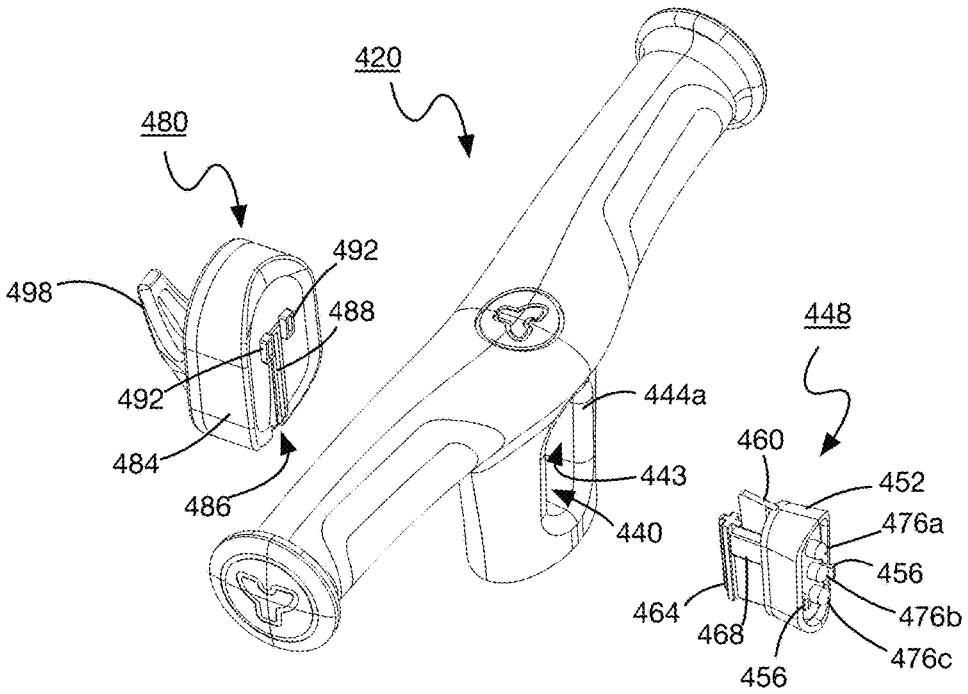
FIG. 19B is a front perspective view of the front accessory component of FIGS. 17A and 17B and the rear accessory component of FIG. 18 being aligned for coupling with the handlebar member of FIGS. 16A to 16D.
Figure 19C:
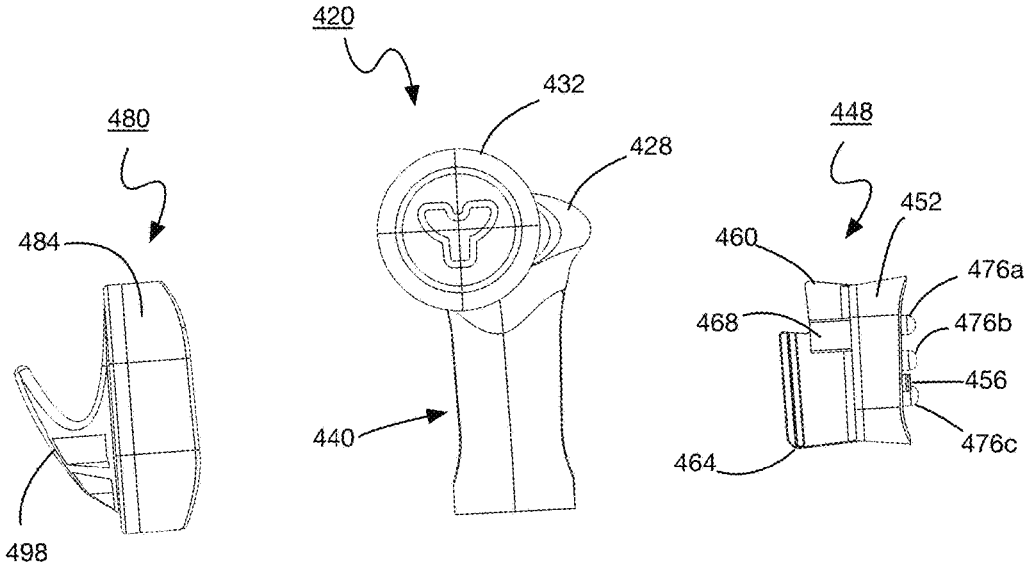
FIG. 19C is a left side view of the front accessory component of FIGS. 17A and 17B and the rear accessory component of FIG. 18 being aligned for coupling with the handlebar member of FIGS. 16A to 16D.
Figure 19D:
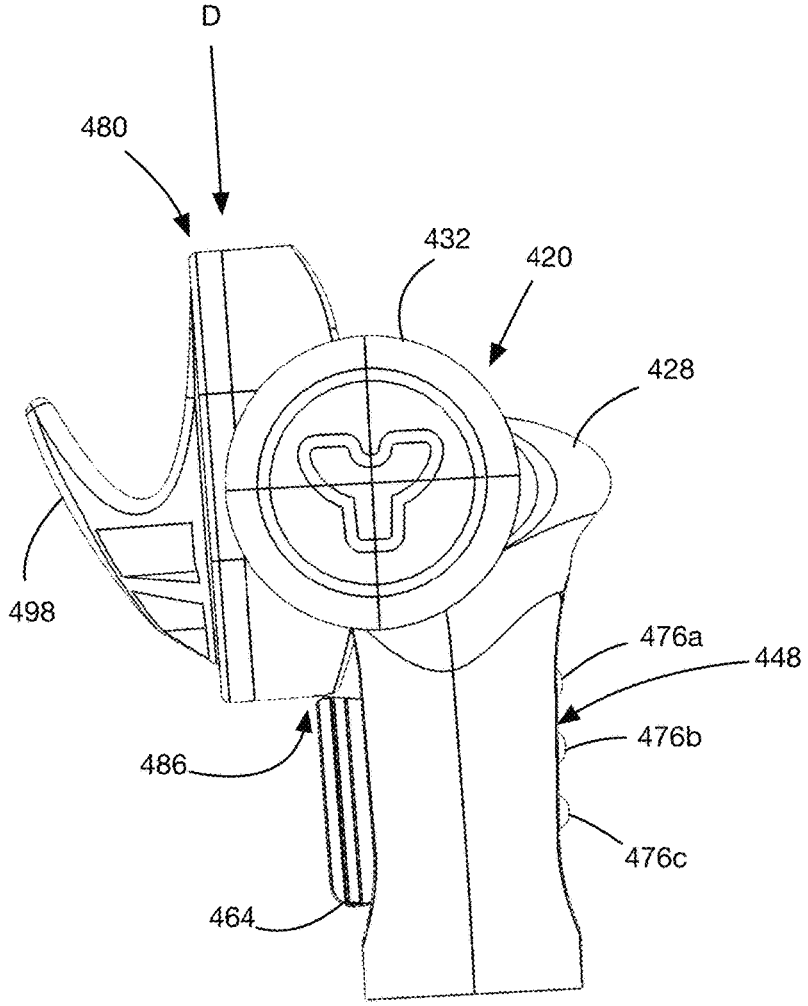
FIG. 19D is a left side view of the rear accessory component of FIG. 18 being fitted onto the front accessory component of FIGS. 17A and 17B protruding from a rear side of the handlebar member of FIGS. 16A to 16D.
Figure 20A:
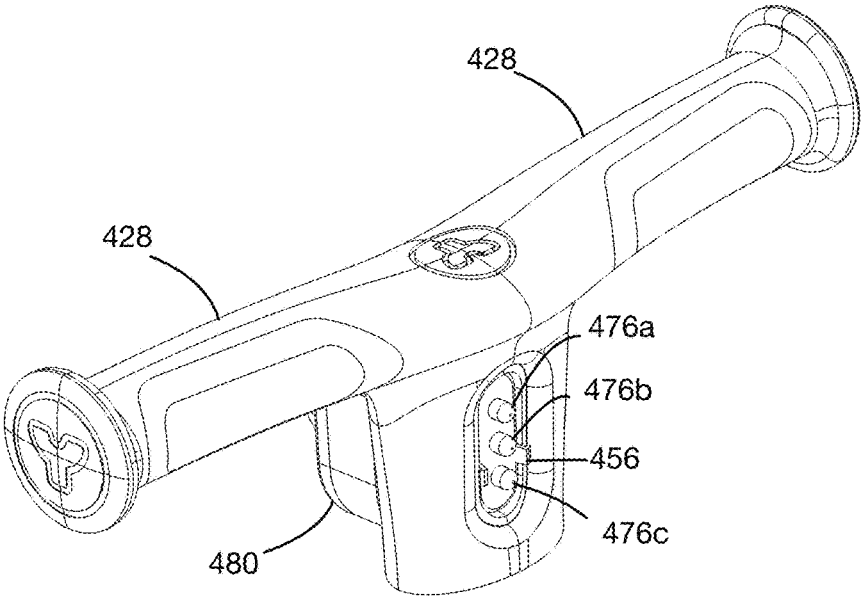
FIG. 20A is a front perspective view of the handlebar member of FIGS. 16A to 16D after coupling of the front accessory component of FIGS. 17A and 17B and the rear accessory component of FIG. 18 thereto.
Figure 20B:
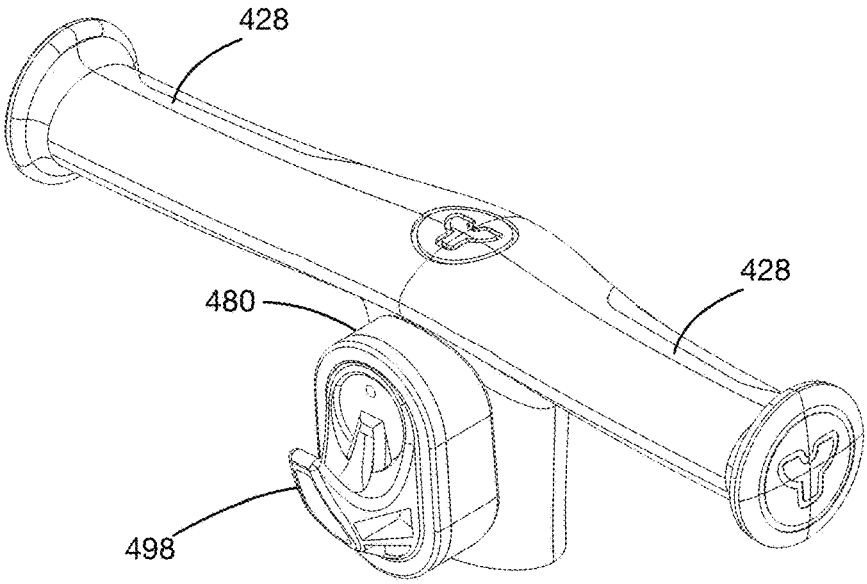
FIG. 20B is a front perspective view of the handlebar member of FIGS. 16A to 16D after coupling of the front accessory component of FIGS. 17A and 17B and the rear accessory component of FIG. 18 thereto.
Figure 20C:
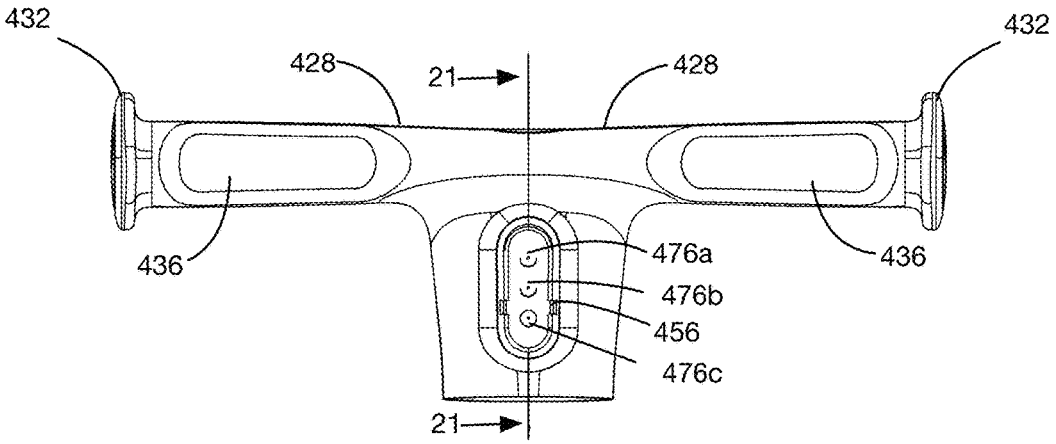
FIG. 20C is a front view of the handlebar member of FIGS. 16A to 16D after coupling of the front accessory component of FIGS. 17A and 17B and the rear accessory component of FIG. 18 thereto.
Figure 20D:
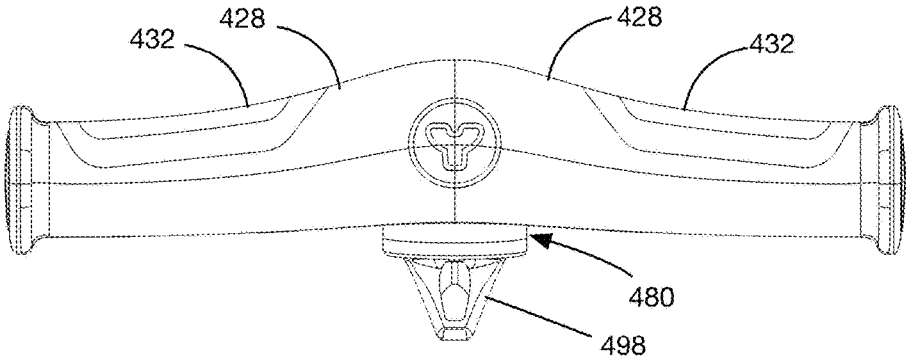
FIG. 20D is a top view of the handlebar member of FIGS. 16A to 16D after coupling of the front accessory component of FIGS. 17A and 17B and the rear accessory component of FIG. 18 thereto.
Figure 20E:
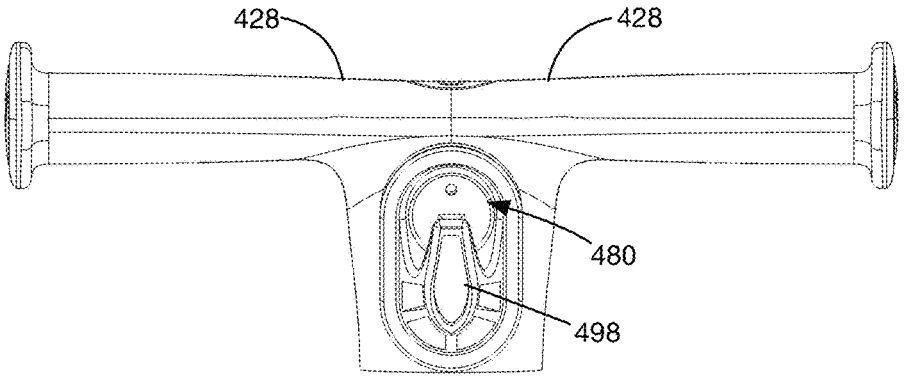
FIG. 20E is a rear view of the handlebar member of FIGS. 16A to 16D after coupling of the front accessory component of FIGS. 17A and 17B and the rear accessory component of FIG. 18 thereto.
Figure 20F:
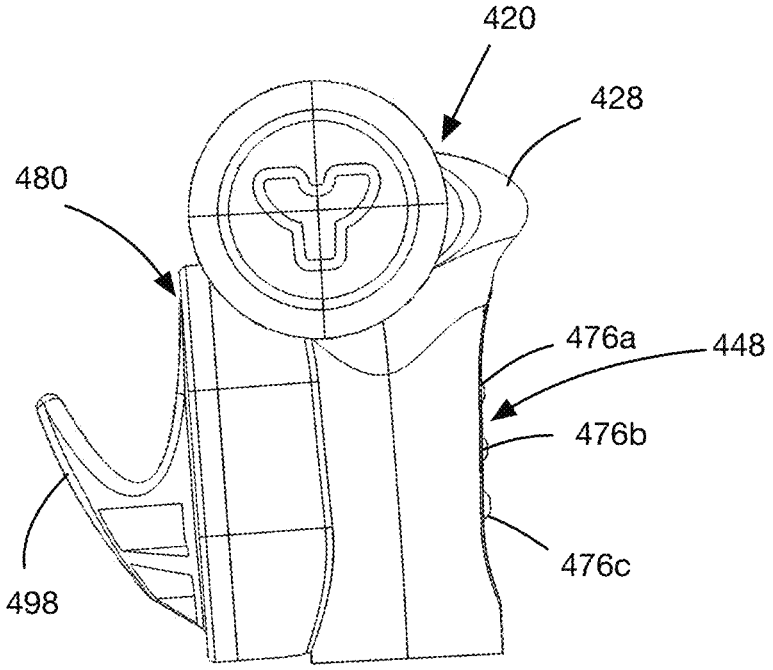
FIG. 20F is a left side view of the handlebar member of FIGS. 16A to 16D after coupling of the front accessory component of FIGS. 17A and 17B and the rear accessory component of FIG. 18 thereto.

Then, the cross-shaped slot 486 of the rear accessory component 480 is aligned with the top of the stepped rear portion 464 of the central fin 460 of the front accessory component 448, as is shown in FIG. 19D. Once aligned, the rear accessory component 480 is pushed downward in a direction D to cause the stepped rear portion 464 of the central fin 460 to enter into the cross-shaped slot 486, with the slotted opening 488 receiving the central fin 460. The height of the slotted opening 488 and the cross-shaped slot 486 limit how far down the rear accessory component 480 can be pushed down onto the stepped rear portion 464. Once the rear accessory component 480 is pushed down as far as permitted into the stepped rear portion 464 of the front accessory component 448, the stabilizer blocks 468 of the front accessory component 448 are aligned with and abut the stabilizer feet 492 of the rear accessory component 480 to restrict play between the two components.

FIGS. 20A to 20F show the assembled accessory coupled to the handlebar member 420. As can be seen, the light-emitting elements 476*a* to 476*c* are at least partially set back in the through-hole 440 to prevent damage to them. Both the feature face 472 of the front accessory component 448 and the feature face 496 of the rear accessory component 480 are exposed when the front accessory component 448 and the rear accessory component 480 are coupled together on the handlebar member 420.

Figure 21:
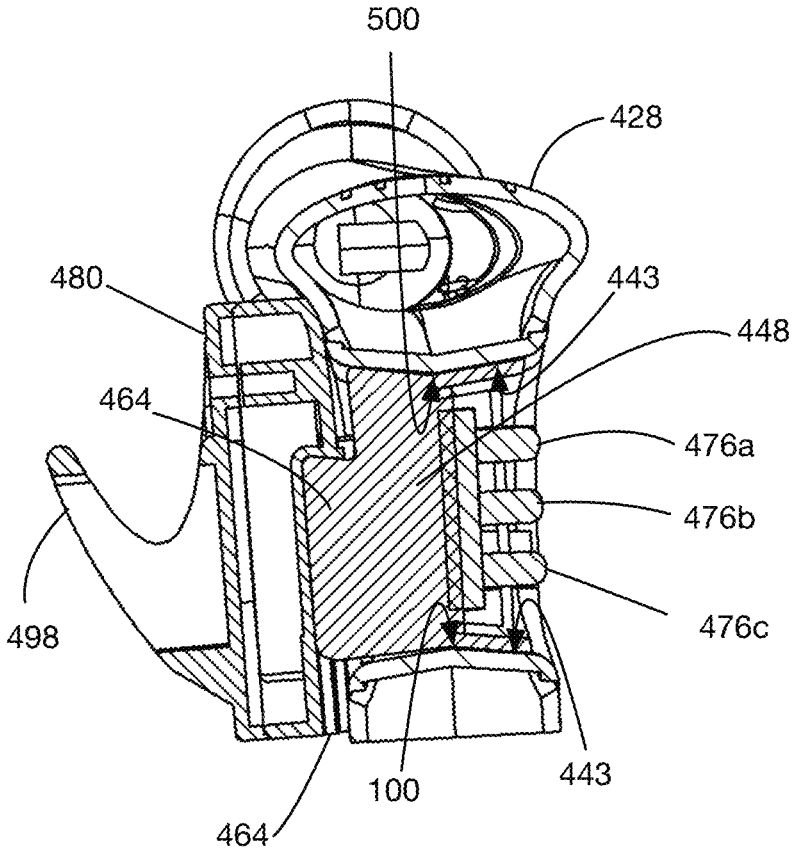
FIG. 21 is a side sectional view of the handlebar member of FIGS. 16A to 16D after coupling of the front accessory component of FIGS. 17A and 17B and the rear accessory component of FIG. 4 thereto along 21-21 in FIG. 20C.

FIG. 21 shows a sectional view of the assembled accessory and handlebar member 420. As can be seen, the sidewall 443 of the through-hole 440 is doubly-tapered towards a smaller diameter 500 centrally located in the through-hole 440. As will be appreciated, when the front accessory component 448 is being inserted into the through-hole 440, it is slightly angled down to enable the upper fin edge 461 to clear the smaller diametered sidewall 443 before it can be reoriented as the front accessory component 448 continues to be inserted through the through-hole 440. The front accessory component 448 is at least partially tapered to correspond to the shape of the through-hole 440. When the front accessory component 448 is fully inserted into the through-hole 440, the smaller diameter 500 acts to restrict play of the front accessory component 448 longitudinally in the through-hole 440.

The accessory is removably coupled to the handlebar member 420. That is, by lifting the rear accessory component 480 in a direction opposite of D, it can be removed from the front accessory component 448, and the front accessory component 448 can be withdrawn forward from the through-hole 440.

The feature faces 472, 496 are lowered and raised with the handlebar member 420, and generally maintain their orientation with respect to the foot-deck 411, as the handlebar assembly 417 does not generally rotate to steer the foot-deck-based vehicle 410. Thus, the light-emitting elements 476 generally always face forward along a longitudinal axis of the foot-deck 411.

In alternative embodiments, the accessory may be coupled to a handlebar member that remains at a fixed height, and/or turns to steer the vehicle.

While, in the embodiment shown in FIGS. 15-22, the recess is illustrated as a through-hole, in other embodiments, the recess can be a channel extending at least partially around the handlebar member 420.

Figure 22:
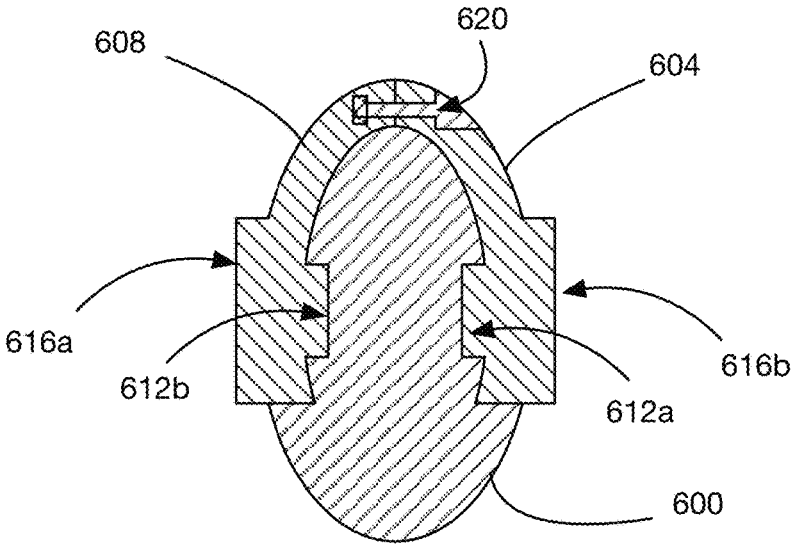
FIG. 22 shows a top sectional view of a handlebar member, a front accessory component, and a rear accessory component in accordance with another embodiment coupled together.

FIG. 22 shows an exemplary embodiment where a handlebar member 600 has a generally elliptical profile and an arcuate channel extending therearound for receiving a front accessory component 604 and a rear accessory component 608. The front accessory component 604 and the rear accessory component 608 are arcuate elements that extend from a front and rear side, respectively, of the handlebar member 600 to a midpoint along a lateral side thereof, where the front accessory component 604 and the rear accessory component 608 have a hole for a screw forming part of the front accessory component 604 to secure them together. The handlebar member 600 has a pair of deeper recesses 612*a* and 612*b* for receiving inward protrusions of the front accessory component 604 and the rear accessory component 612. When coupled together in the recess around the handlebar member 600, the inward protrusions of the front accessory component 604 and the rear accessory component 608 are held in the deeper recesses 612*a*, 612*b* respectively.

Further, while the recess in the illustrated embodiment is in the handlebar member base, in other embodiments, the recess can alternatively and/or additionally be in the handlebars.

The feature faces of the accessory can be any suitable shape or configuration to provide a particular feature. The features can be ornamental, functional, and/or a combination of the two. For example, the accessory can present a licensed image or design. Alternatively and additionally, the features can be functional, such as light-emitting elements, hooks or other devices for holding other objects, a horn, etc.

Batteries to power any of the features can be contained in the accessory in some embodiments. For example, batteries to power the light-emitting elements in the embodiment shown in FIGS. 15 to 22 can be contained in the front accessory component. Alternatively and additionally, batteries can be contained in the rear accessory component, and power can be transferred via leads or the like on the coupling interface.

The accessory can be made from two separate components, as is shown in the embodiment of FIGS. 15 to 22, or alternatively can be a single component or three or more components. By providing different features on different assembly components, where there are two or more, the features can be mixed and matched as desired.

In embodiments where there are two or more accessory components, the accessory components can be coupled together in a variety of manners. The accessory components can all engage the recess in some embodiments. In other embodiments, one of the accessory components can engage the recess, and the coupling with the other accessory component(s) can retain the one accessory component therein.

The various elements can be made of any suitable material, such as plastic, rubber, or metal or any combination thereof.

While the accessory can be made to be coupled permanently to the handlebar member, it can be desirable to make the accessory removably couplable to the handlebar member, as is shown in FIGS. 15 to 22.

Embodiment Group 3

Described herein are accessories for customizing foot-deck-based vehicles, and foot-deck-based vehicles for using such accessories.

In some embodiments, the foot-deck-based vehicles include at least one wheel having a hub, a travel surface, and a gapped support structure between the hub and the travel surface. The gapped support structure has at least one gap that is visible when the wheel is mounted on the foot-deck-based vehicle. The accessory comprises a set of at least one wheel inserts. Each wheel insert is constructed to be securable within one of the at least one gaps.

In other embodiments, the foot-deck-based vehicle has a front wheel assembly. The accessory comprises a nose guard that is securable to the front wheel assembly.

By providing accessories that can secured to the foot-deck-based vehicle, the foot-deck-based vehicles can be easily customized after production.

In various embodiments, the accessories can include ornamentation, functionality, or a combination of both.

Figure 23:
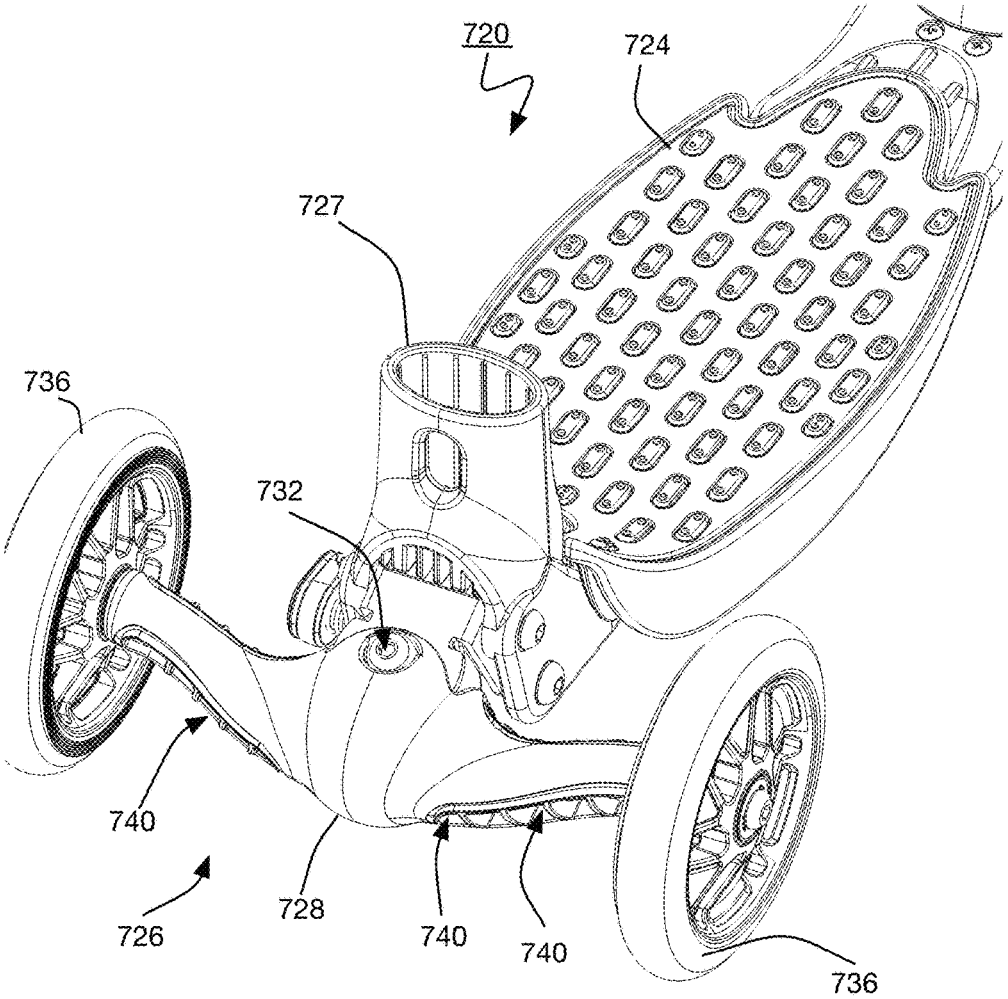
FIG. 23 is a front perspective view of a part of a foot-deck-based vehicle, in particular a scooter, according to another non-limiting embodiment.

FIG. 23 depicts a portion of an example foot-deck-based vehicle, which in the illustrated embodiment is a scooter 720. Although the example foot-deck-based vehicle is depicted as a scooter, it is understood that the foot-deck-based vehicle is not limited to a scooter and may be, for example, a skateboard, or any other suitable foot-deck-based vehicle. The scooter 720 includes a foot-deck 724 coupled to a front wheel assembly 726 and a rear wheel assembly (not shown). The front wheel assembly 726 and the rear wheel assembly are each coupled to at least one wheel. The scooter 720 is a lean-to-steer scooter, wherein a rider shifts their center of gravity to one lateral side of the foot-deck 724 to cause the front wheel assembly 726 to pivot in the direction of the lateral shift in the center of balance. A steering assembly base 727 extends upwardly from a front end of the foot-deck 724.

The front wheel assembly 726 includes a front axle 728 to which a pair of front wheels 736 are rotatably coupled. The front axle 728 has a set of through-holes 740 passing therethrough, the through-holes 740 being generally perpendicular to the front axle 728 and the rotation axis of the wheels 736.

Although not shown in FIG. 23, the rear wheel assembly includes one rear wheel.

While in the example foot-deck-based vehicle, the at least one front wheel includes two wheels 736, in some embodiments, the foot-deck-based vehicle may have only one front wheel and, in some other embodiments, the foot-deck-based vehicle may have more than two front wheels. In addition, in the example foot-deck-based vehicle, the at least one rear wheel includes a single rear wheel. However, in some embodiments, the foot-deck-based vehicle may have, in some other embodiments, more than one rear wheel.

Figure 24A:
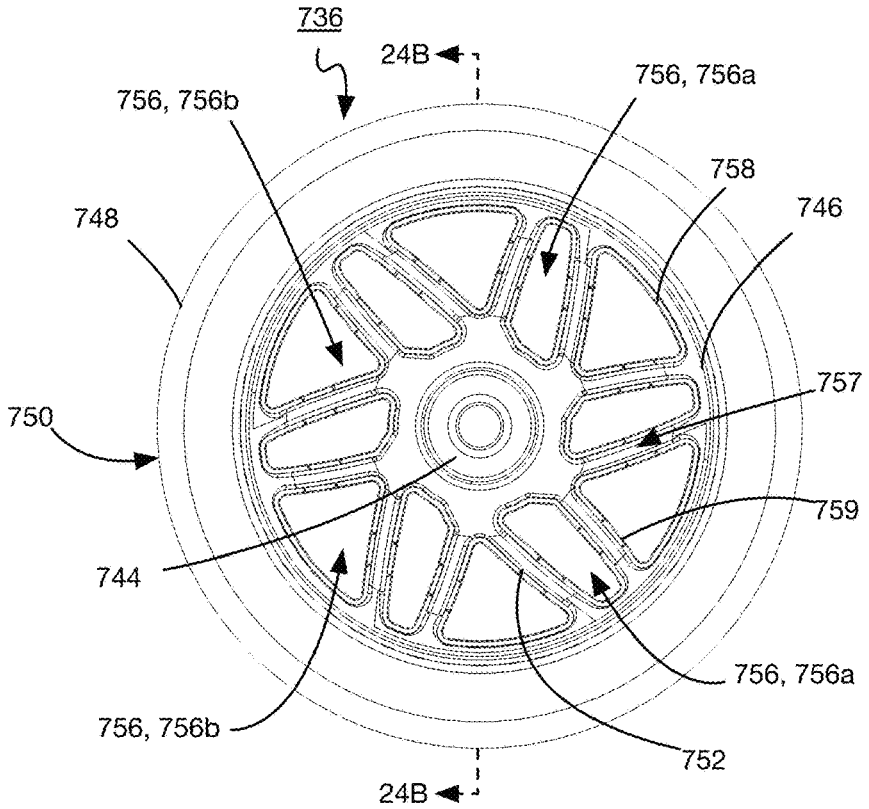
FIG. 24A is an outer side view of a front wheel of the scooter of the foot-deck-based vehicle of FIG. 23.

FIG. 24A shows one of the front wheels 736 of the scooter 736 in greater detail. The wheel 736 has a central hub 744, a rim 46 that supports a tire 748 having a travel surface 750, and a gapped support structure 752 coupling the rim 746 to the central hub 744 to support the rim 746 and the tire 748 thereon. As used herein "gapped support structure" means any structure that couples a travel surface of a wheel to a hub, and having a set of one or more gaps. The gapped support structure may extend directly from the hub to the travel surface, or, alternatively, may couple the hub and the travel surface via a rim, etc. The gaps may extend fully from an outer side of the gapped support structure to an inner side, or at least partially. The gaps may reduce the overall weight of the wheel and provide a certain appearance that is appealing. Further, the gapped support structure, depending on the structure and materials, can enable the wheel to provide some shock absorption.

As shown, in this particular example, the gapped support structure 752 comprises a set of semi-rigid spokes with gaps 756 therebetween extending fully from the outer side of the gapped support structure to the inner side thereof. The set of gaps 756 are of varying dimensions. A first subset of gaps 756*a* are smaller in size than a second subset of gaps 756*b*. All of the gaps 756*a* in the first subset are like-dimensioned, and all of the gaps 756*b* in the second set are like-dimensioned. The gapped support structure 752 has an outer surface 757. Within each gap 756 is a ledge 758 that is recessed relative to the outer surface 757. The ledge 758 within each gap 756 has two clip locks 759 defined by two thinner portions of the ledge 758.

Figure 24B:
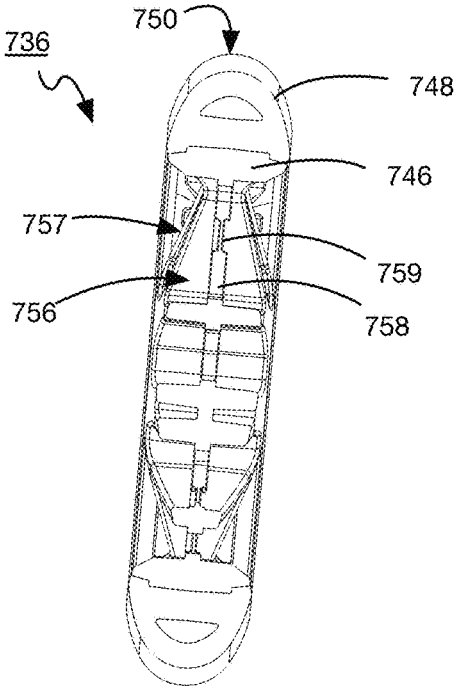
FIG. 24B is a section view of the wheel of FIG. 24A along line 24B-24B.

FIG. 24B is a sectional view of the wheel that shows the slope of the outer surface of the gapped support structure 752. The thinness of the clip lock 759 relative to that of the ledge 758 is more visible.

Figure 25A:
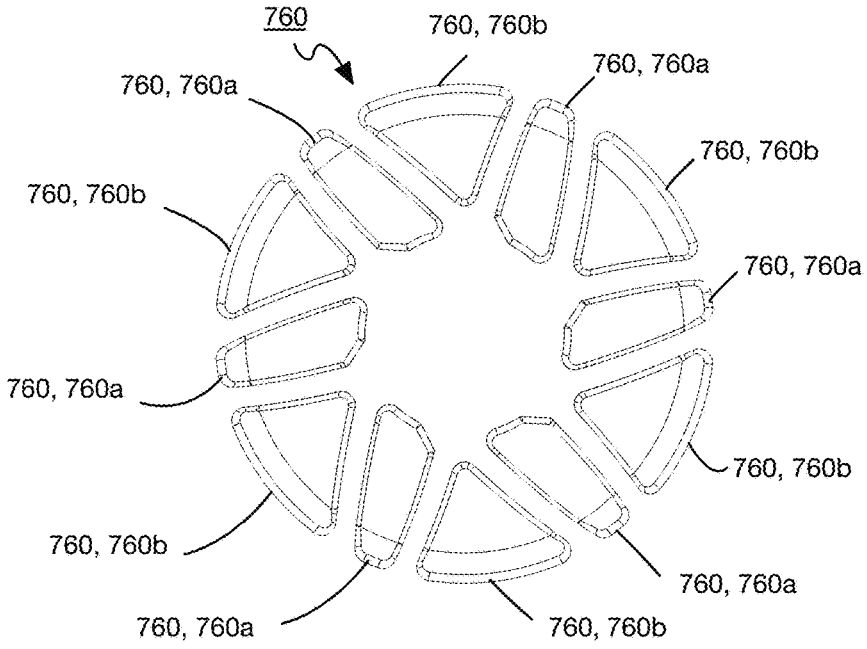
FIG. 25A shows an outer side view of a set of wheel inserts for use with the wheel of FIG. 24A.
Figure 25B:
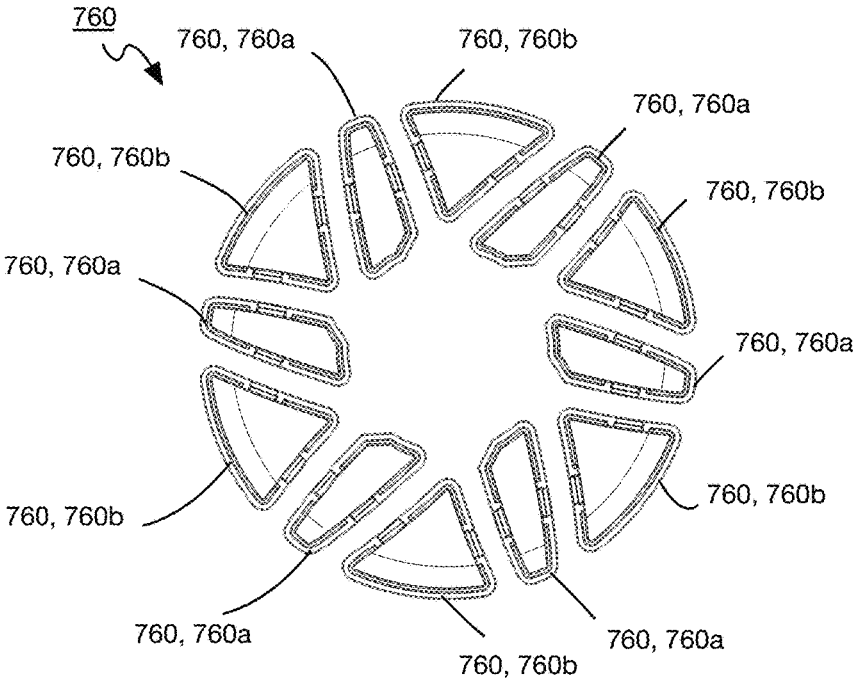
FIG. 25B shows an inner side view of the set of wheel inserts of FIG. 25A.
Figure 25C:
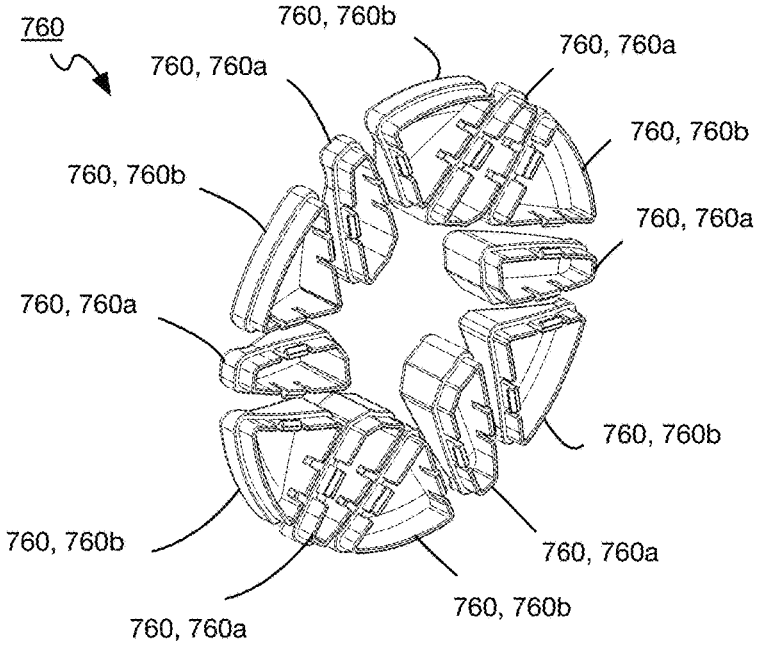
FIG. 25C shows an inner side perspective view of the set of wheel inserts of FIGS. 25A and 25B.

An accessory for the scooter 720 is shown in FIGS. 25A to 25C. The accessory is a set of wheel inserts 760. The wheel inserts 760 are spaced to match the pattern of gaps 756 in the wheel 736. A first subset of the wheel inserts 760*a* are dimensioned to fit within the first subset of gaps 756*a*, and are smaller in dimension than a second subset of the wheel inserts 760*b*. The second subset of the wheel inserts 760*b* are dimensioned to fit within the second subset of gaps 756*b*.

Figure 26A:
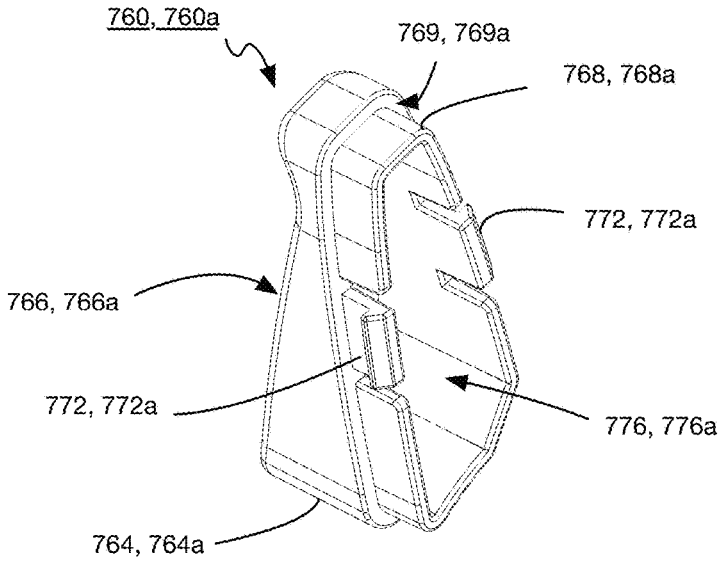
FIG. 26A is a rear perspective view of a first permutation of the wheel inserts of FIGS. 25A to 25C.

FIG. 26A shows one of the wheel inserts 760*a* in greater detail. The wheel insert 760*a* has an external insert portion 764*a* having an exterior surface 766*a*, and a smaller-dimensioned internal insert portion 768*a*, thereby defining a step 769*a* where the external insert portion 764*a* and the internal insert portion 768*a* meet. The internal insert portion 768*a* is punctuated by two clips 772*a* with outwardly facing sloped ridges. The clips 772*a* are separated from the internal insert portion 768*a* to permit flexing of the clips 772*a*. The wheel inserts 760*a* are empty, having a hollow 776*a* to reduce their weight and cost.

Figure 26B:
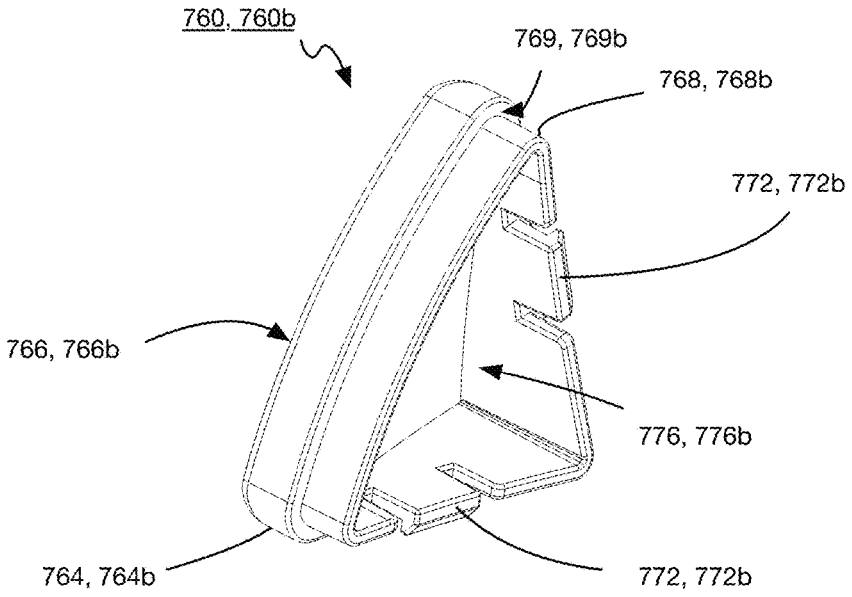
FIG. 26B is a rear perspective view of a second permutation of the wheel inserts of FIGS. 25A to 25C.

FIG. 26B shows one of the wheel inserts 760*b* in greater detail. The wheel insert 760*b* has an external insert portion 764*b* having an exterior surface 766*a*, and a smaller-dimensioned internal insert portion 768*a*, thereby defining a step 769*b* where the external insert portion 764*b* and the internal insert portion 768*b* meet. The internal insert portion 768*b* is punctuated by two clips 772*b* with outwardly facing sloped ridges. The clips 772*b* are separated from the internal insert portion 768*b* to permit flexing of the clips 772*b*. Like the wheel inserts 760*a*, the wheel inserts 760*b* are empty, having a hollow 776*b* to reduce their weight and cost.

Figure 27:
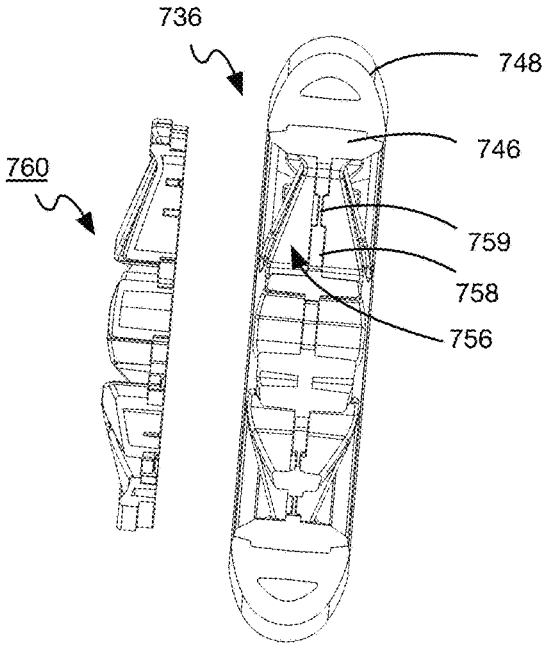
FIG. 27 is a rear view of the set of wheel inserts of FIGS. 25A to 25C before insertion into the wheel of FIGS. 24A and 24B.

FIG. 27 shows the set of the wheel inserts 760 being aligned for insertion into the wheel 736. The wheel 736 is shown in isolation from the remainder of the scooter 720 merely for illustration purposes. In practice, each wheel insert 760 is aligned manually and inserted into a corresponding gap 756. As the wheel insert 760 is pushed into the gap 756, the clips 772 of the wheel insert 760 are biased inwardly by the impingement of the clip locks 759 against the outwardly facing sloped ridges of the clips 772. Upon passage of the clip locks 759, the clips 772 clamp onto the clip locks 759 to hold the wheel insert 760 in place in the gap 756. Further travel of the wheel insert 760 into the gapped support structure 752 is stopped by abutment of the step 769 of the wheel insert 760 against the ledge 758 of the gapped support structure 752. As a result, the wheel insert 760 is secured in place in the gap 756.

Figure 28:
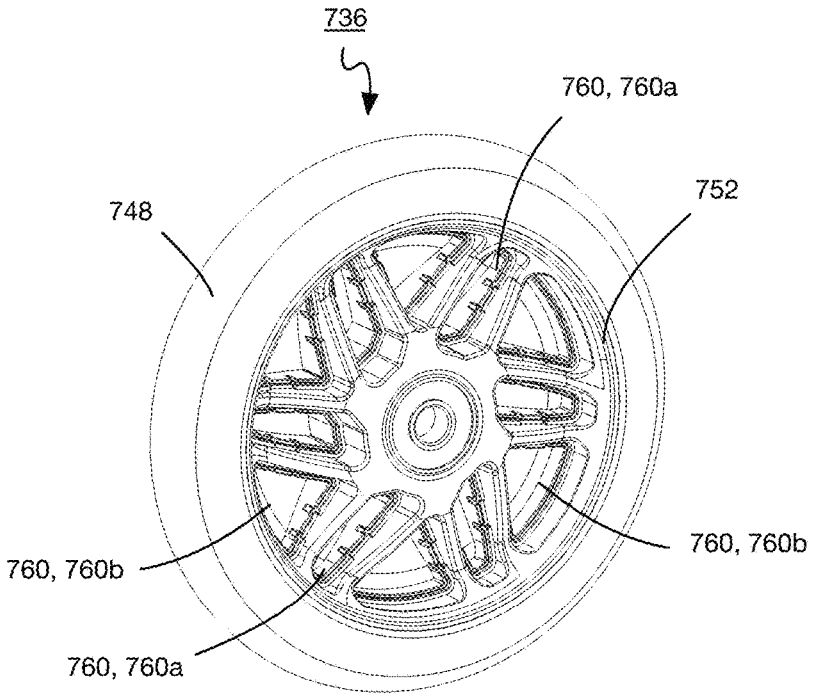
FIG. 28 is an inner side view of the wheel of FIGS. 24A and 24B after insertion of the set of inserts of FIGS. 25A to 25C.

FIG. 28 shows the wheel 736 after insertion of the wheel inserts 760. While not shown, the exterior surface 766 of the wheel inserts 760 are flush with the outer surface 757 of the gapped support structure 752, thereby providing an attractive appearance.

The wheel inserts 760 are releasably coupled into the gaps 756, as the clips 772 can be manually biased inwards to clear the clip locks 759, thereby enabling the wheel inserts to be pushed out from the inner side of the wheel 736.

The wheels 736 have an attractive appearance both with and without the insertion of the wheel inserts 760. The clip locks 759 are generally not visible when the wheel inserts 760 are in place or absent in the gapped support structure 752. The wheel inserts 760 may be sold as an accessory for customizing the appearance of the scooter 720.

Different wheel inserts 760 or sets of wheel inserts 760 can be colored differently and may be sold as a set, or separately, enabling a purchaser to mix and match wheel insert colors.

Other variations for the wheel inserts are possible. For example, the wheel inserts can be made from transparent or colored transparent plastic.

In some embodiments, the wheel inserts can include light-emitting elements, such as light-emitting diodes ("LEDs").

In other embodiments, two or more wheel inserts can be dimensioned to be securable within a single gap. The wheel inserts can have different exterior surfaces. For example, protuberances or studs can be present on their exterior surfaces. Alternatively, the wheel inserts can lack a full exterior surface, thus providing a colored outline for each gap.

Further, where the gapped support structure is relatively flexible, providing a "soft" ride, insertion of wheel inserts into the gapped support structure can stiffen the shock absorption characteristics of the wheel.

While the wheel inserts in the above-described embodiment are secured to the wheel via clips, any other type of suitable means for securing the wheel inserts to the wheel can be employed. For example, the wheel inserts can include an outer portion that fits into gaps of the gapped support structure, and an inner portion that is coupled to the outer portion from an inner side of the wheel to secure the wheel insert to the wheel.

The wheel inserts and the wheels can be constructed so that the wheel inserts are inserted into the gaps of the gapped support structure from an inner side of the wheels, and secured in place via similar coupling means as described above. Further, two or more wheel inserts can be coupled together so that they are held in formation for insertion into two or more gaps.

Figure 29:
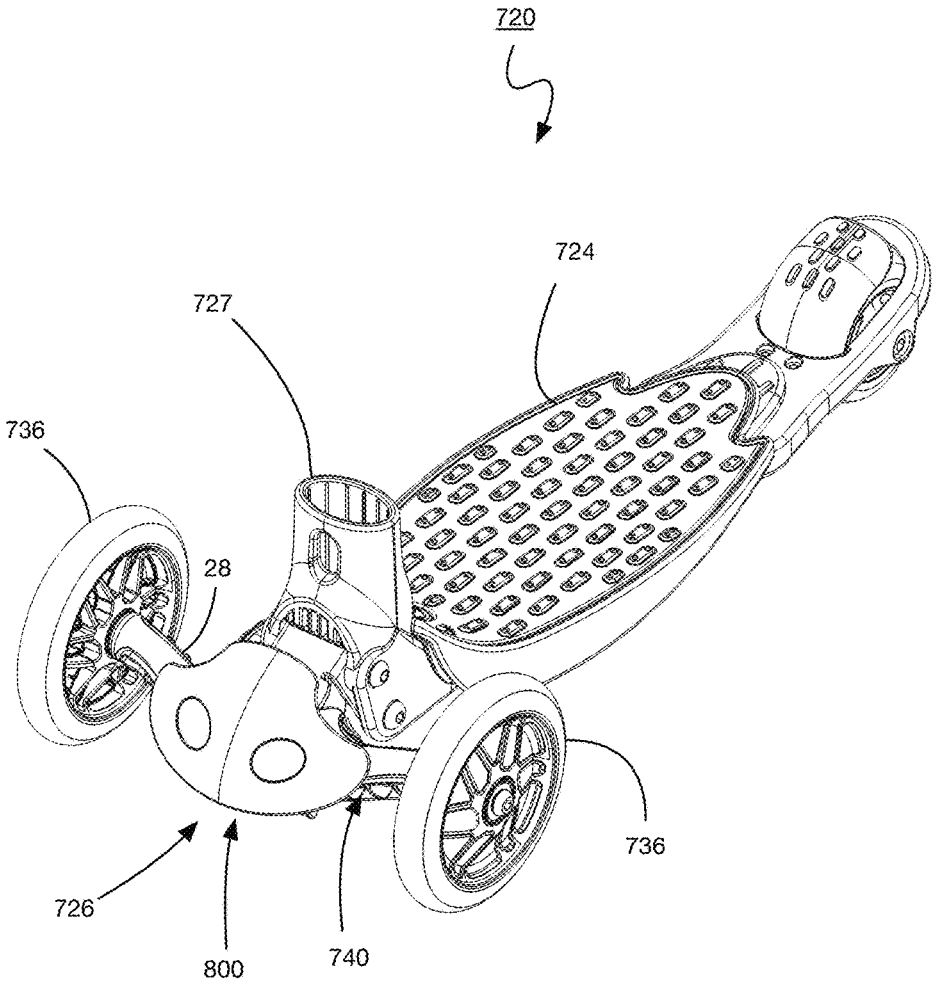
FIG. 29 shows the partial scooter of FIG. 23 after attachment of a nose guard accessory in accordance with another embodiment.

FIG. 29 shows another accessory for customizing a foot-deck-based vehicle in accordance with another embodiment, and, in particular, the scooter 720. The accessory in this illustrated embodiment is a nose guard accessory 800 that is coupled to the front wheel assembly 726 of the scooter 720. The nose guard accessory 800 can change the aesthetic appearance of the scooter 720 and provide additional functionality.

Figure 30A:
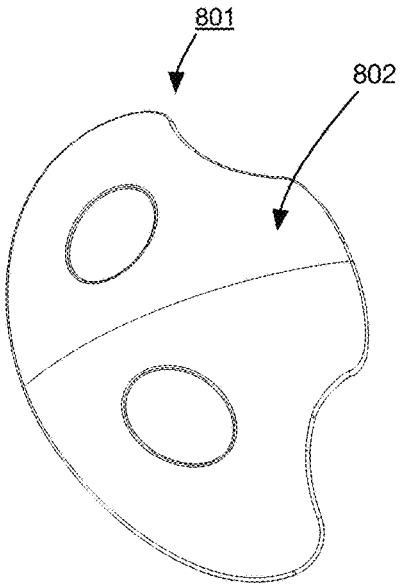
FIG. 30A is a top view of the nose guard of the nose guard accessory of FIG. 29.
Figure 30B:
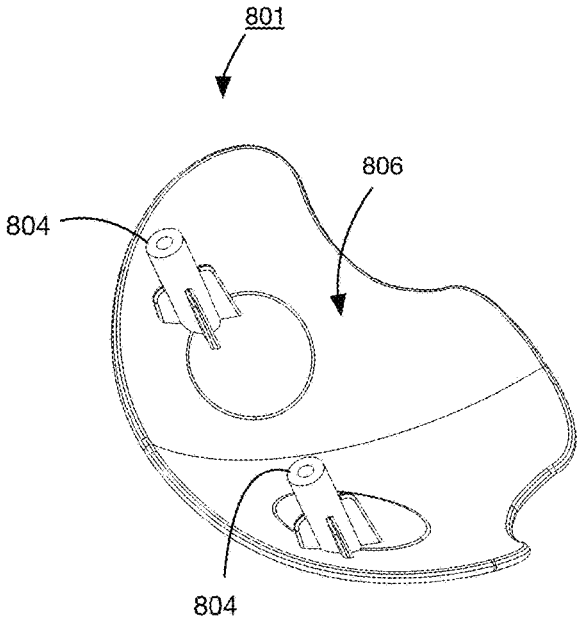
FIG. 30B is a bottom view of the nose guard of the nose guard accessory of FIG. 30A.
Figure 30C:
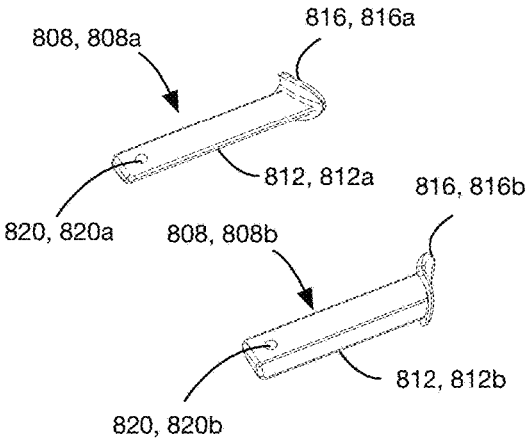
FIG. 30C is a top view of two anchors forming part of the nose guard accessory of FIG. 29.

FIGS. 30A to 30C show the various components of the nose guard accessory 800 in greater detail. The nose guard accessory 800 includes a nose guard 801 that is a cladding that at least partially covers the front wheel assembly 726. An outer surface 802 of the nose guard 801 provides a large area for customization. Two fastener posts 804 extend from an inner surface 806 of the nose guard 801 to provide a coupling interface.

The nose guard accessory 800 also includes a right nose guard anchor 808*a* and a left nose guard anchor 808*b* (collectively nose guard anchors 808). The right nose guard anchor 808*a* has a rod 812*a* with a stop 816*a* proximal to one end thereof, and a fastener hole 820*a* proximal to another end thereof. Similarly, the left nose guard anchor 808*b* has a rod 812*b* with a stop 816*b* proximal to one end thereof, and a fastener hole 820*b* proximal to another end thereof. The fastener holes 820*a*, 820*b* provide a coupling interface to the right and left nose guard anchors 808*a*, 808*b*.

Figure 31A:
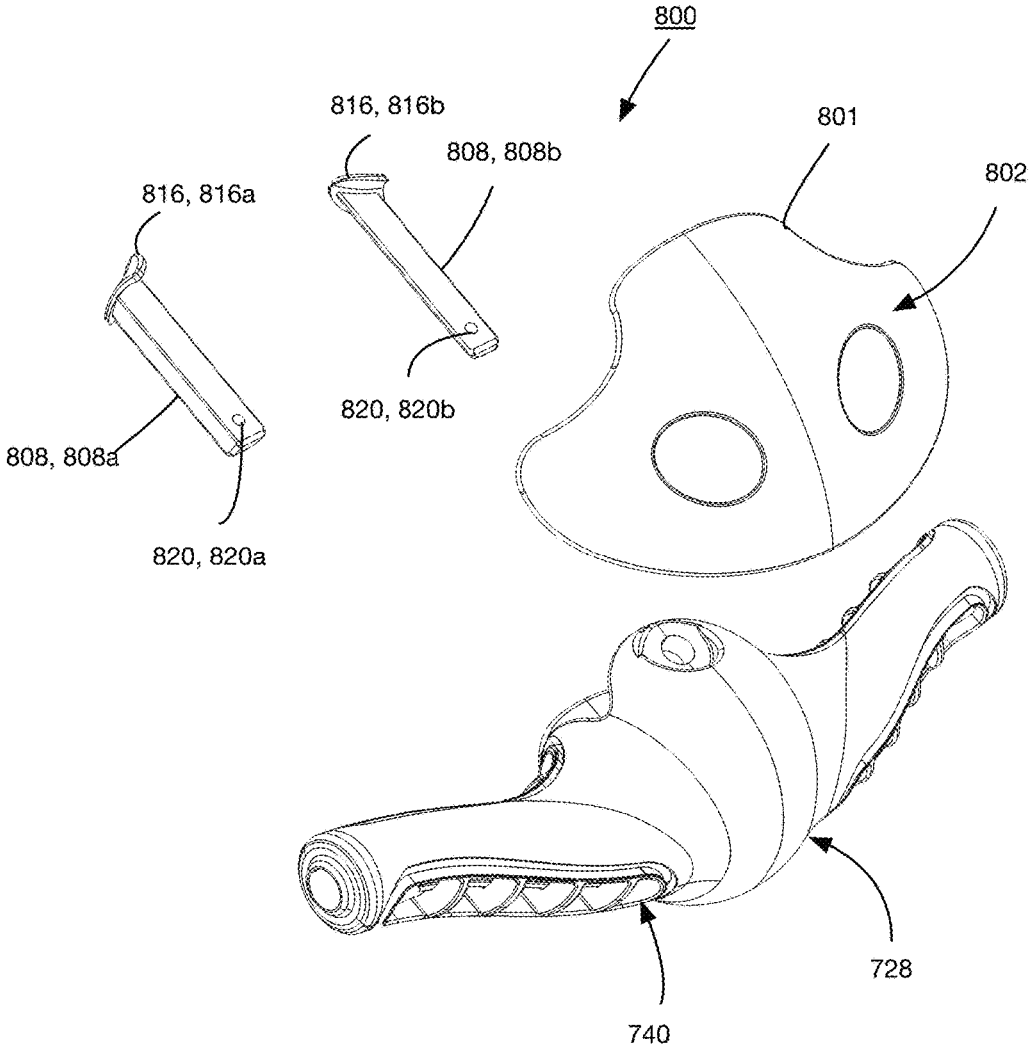
FIG. 31A is a top perspective view of the components of the nose guard accessory of FIGS. 30A and 8B before coupling to a front axle of the scooter of FIG. 29.
Figure 31B:
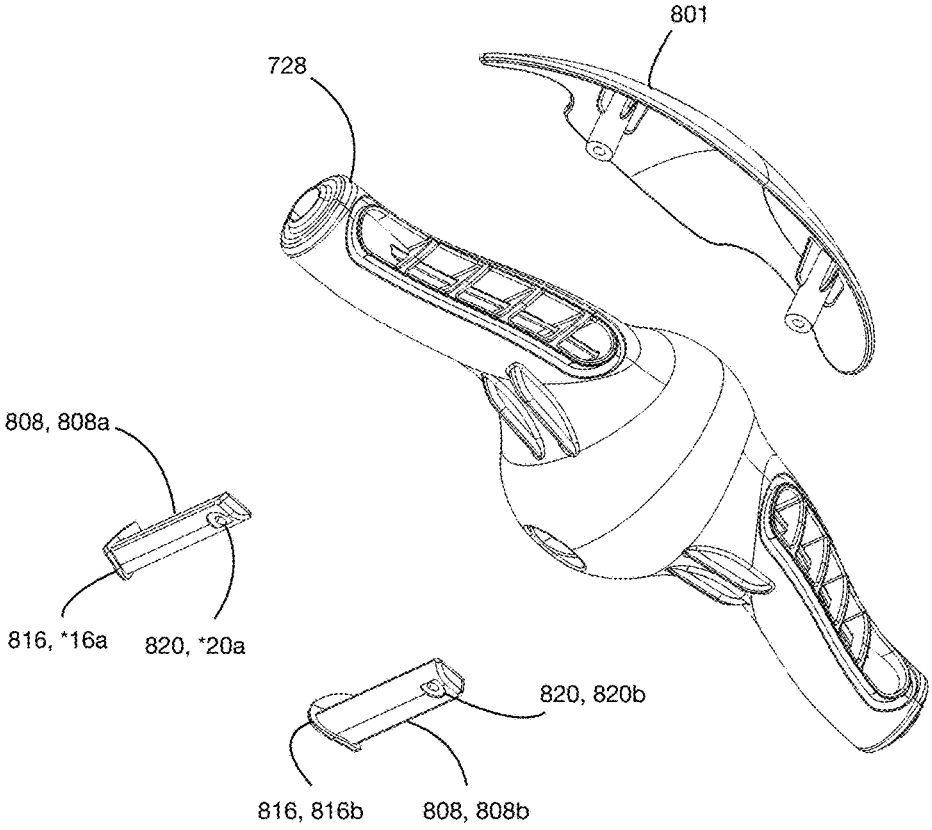
FIG. 31B is a bottom perspective view of the components of the nose guard accessory of FIGS. 30A and 30B before coupling to a front axle of the scooter of FIG. 29.
Figure 32A:
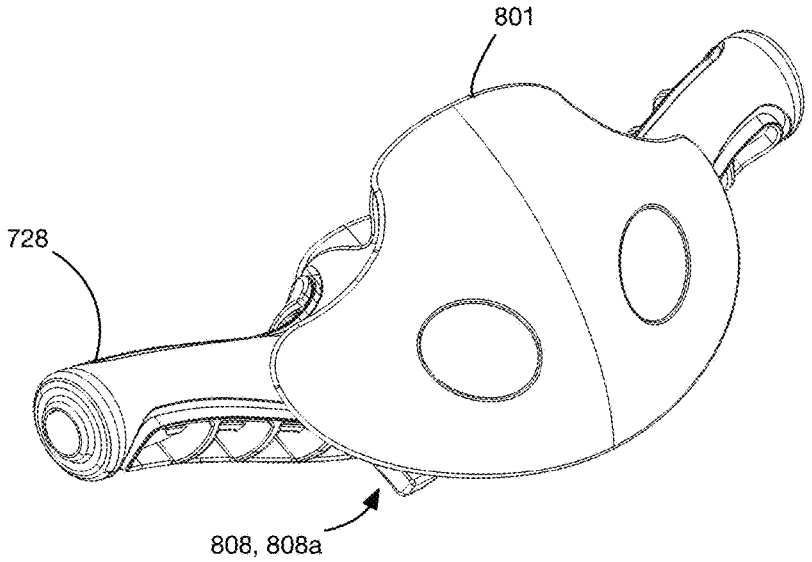
FIG. 32A is a top perspective view of the components of the nose guard accessory of FIGS. 30A and 30B after coupling to a front axle of the scooter of FIG. 23.
Figure 32B:
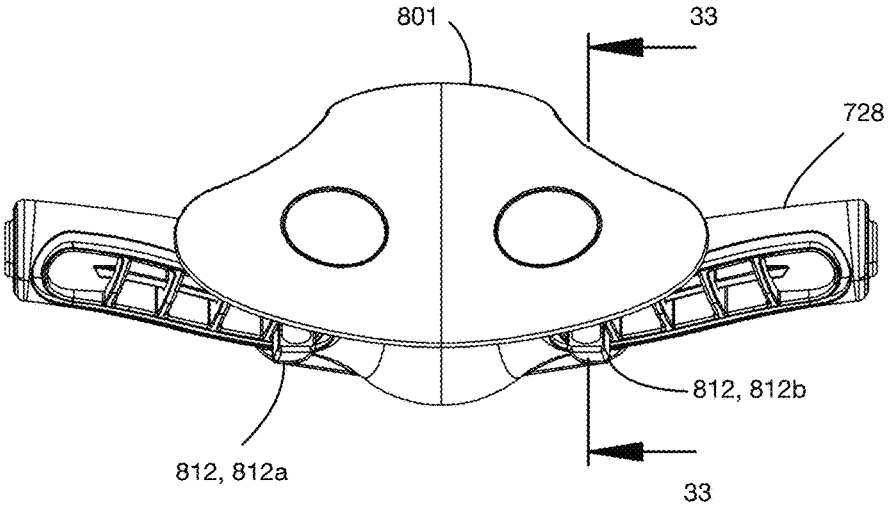
FIG. 32B is a front perspective view of the components of the nose guard accessory of FIGS. 30A and 30B after coupling to a front axle of the scooter of FIG. 23.
Figure 32C:
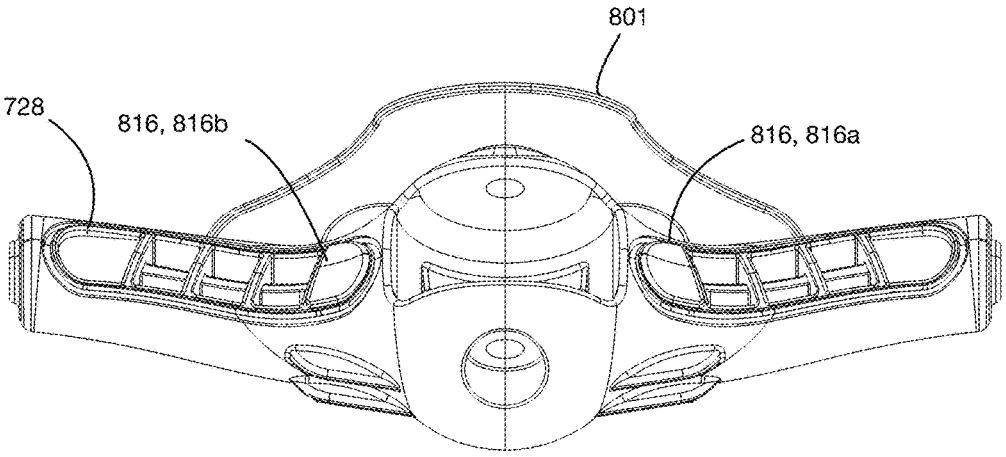
FIG. 32C is a bottom perspective view of the components of the nose guard accessory of FIGS. 30A and 30B after coupling to a front axle of the scooter of FIG. 23.
Figure 32D:
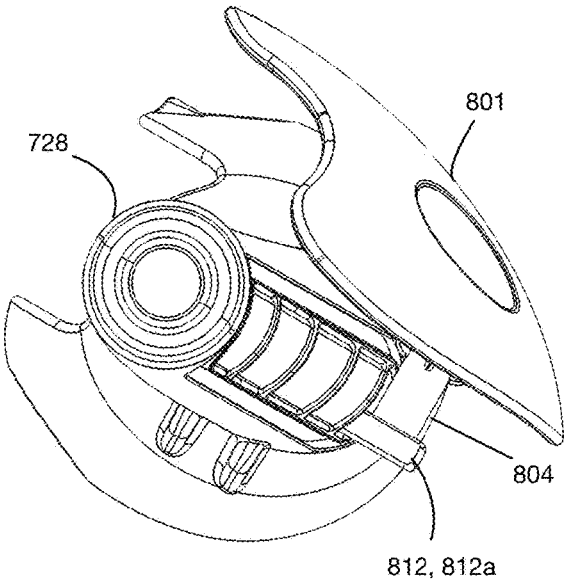
FIG. 32D is a side view of the components of the nose guard accessory of FIGS. 30A and 30B after coupling to a front axle of the scooter of FIG. 23.
Figure 33:
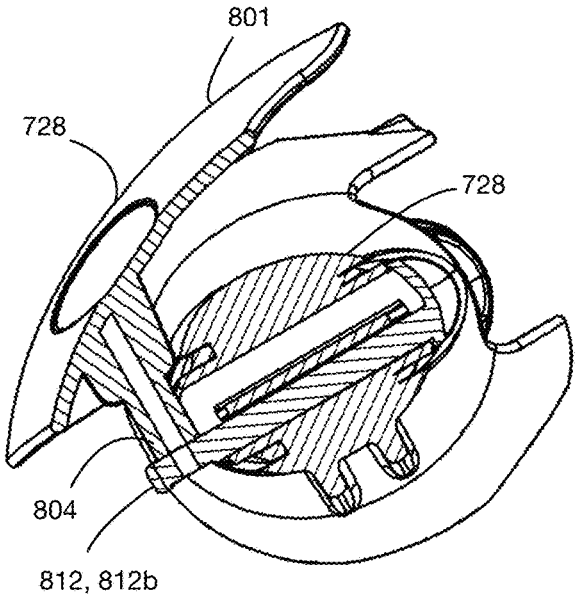
FIG. 33 is a side sectional view of the front axle of the scooter and the nose guard accessory coupled thereto in FIG. 32B along line 33-33.

FIGS. 31A and 31B show the nose guard 801 and the nose guard anchors 808 being aligned for coupling to the axle 728 of the front wheel assembly 726 of the scooter 720. The front axle 728 is shown in isolation from the remainder of the scooter 720 merely for illustration purposes. As can be seen, the stop 816*a* of the right nose guard anchor 808*a* and the stop 816*b* of the left nose guard anchor 808*b* are sloped at similar angles but in opposite directions. The right nose guard anchor 808*a* is aligned with and inserted through the through-hole 740 on a right side of the front axle 728 closest to the center thereof until the stop 816*a* abuts against the rear of the front axle 728. Similarly, the left nose guard anchor 808*b* is aligned with and inserted through the through-hole 740 on a left side of the front axle 728 closest to the center thereof until the stop 816*b* abuts against the rear of the front axle 728. The rods 812 of the nose guard anchors 808 extend sufficiently out of the through-holes 740 of the front axle 728.

Once the nose guard anchors 808 are fully inserted into the through-holes 740, the fastener posts 804 are aligned with the fastener holes 820 of the nose guard anchors 808 and a fastener, such as a screw, is inserted through the fastener holes 820 and into corresponding holes in the fastener posts 804. Upon tightening the fasteners, the nose guard 801 is securely coupled to the nose guard anchors 808 and to the front axle 728. The fastener posts 804 of the nose guard 801 are coupled to the rods 812, prohibiting the nose guard anchors from being withdrawn from the through-holes 740.

FIGS. 32A to 32D and 33 show the assembled nose guard accessory 800 coupled to the front axle 728.

If it is desired to change the nose guard 801 for another nose guard, or to remove it altogether, the fasteners can be removed from the fastener posts 804 and fastener holes 820, freeing the nose guard 801 from the nose guard anchors 808. If it is desired to remove the nose guard entirely, the nose guard anchors 808 can be withdrawn rearwardly from the through-holes 740.

While, in the illustrated embodiment, the nose guard is of a particular shape and generally free of design, the actual shape, color, and design of the nose guard can be varied in a number of ways. For example, the nose guard may be rectangular, round, oval, or any other suitable shape.

In some embodiments, the nose guard can be designed to serve as a mud guard.

The outer surface of the nose guard can be one color, or multiple colors in any design, either as a result of the color of the material from which the nose guard is made, a paint or lacquer applied thereon, or decals applied thereon corresponding to a particular theme. Further, the nose guards may be made so as to have surface features, such as, for example, heads of current children's film characters, or the front profile of a particular vehicle.

By providing nose guards of different colors and/or designs, and/or having different surface features, a food-deck-based vehicle can be made to appeal to a particular market segment, such as age, gender, interest (animals, cars, etc.).

One or more light-emitting elements can be placed as part of a light fixture, such as a headlight, on the nose guard. As the nose guard is secured to the front wheel assembly, it will pivot when the front wheel assembly pivots, and the light fixture, or other ornament or functional feature, will turn with the steering of the foot-deck-based vehicle.

The nose guard anchors can be made integrally as part of the nose guard and may be inserted backwards through the through-holes of the front axle. Clips at the rear ends of the nose guard anchors, somewhat similar to those of the wheel inserts described above, can releasably secure the nose guard anchors in the through-holes.

Other types of coupling interfaces can be provided to the nose guard to either couple it directly to the front wheel assembly or to other components to secure the nose guard assembly to the front wheel assembly. For example, in some embodiments, the nose guard can be coupled directly to the front wheel assembly, such as via a releasable clamp or a profiled protrusion that slidably engages a corresponding groove on the front wheel assembly. In other embodiments, the nose guard can be coupled to anchors via clips, clamps, etc. In still other embodiments, the nose guard can be coupled to a clamp constructed to be securable to the front wheel assembly. Various other approaches for securing the nose guard to the front wheel assembly will occur to those skilled in the art.

Embodiment Group 4

A wheel structure for a foot-deck-based vehicle and a foot-deck-based vehicle employing the same are provided herein. The wheel structure has a rim comprising a tire support structure and having a first rigidity. A rim support structure is secured to the rim and extends towards a wheel support around which the rim support structure freely rotates, the rim support structure having a second rigidity that is less than the first rigidity. The rim support structure has a second rigidity that is less than the first rigidity. By constructing the rim of the wheel structure to be more rigid than the rim support structure, the rim can resist significant deformation to prevent deformation while the rim support structure can deform as required to at least partially absorb any shocks as a result of irregularities in a travel surface over which the foot-deck-based vehicle is travelling. Further, the rim support structure can better resist cracking than if it were as rigid as the rim.

Figure 34:
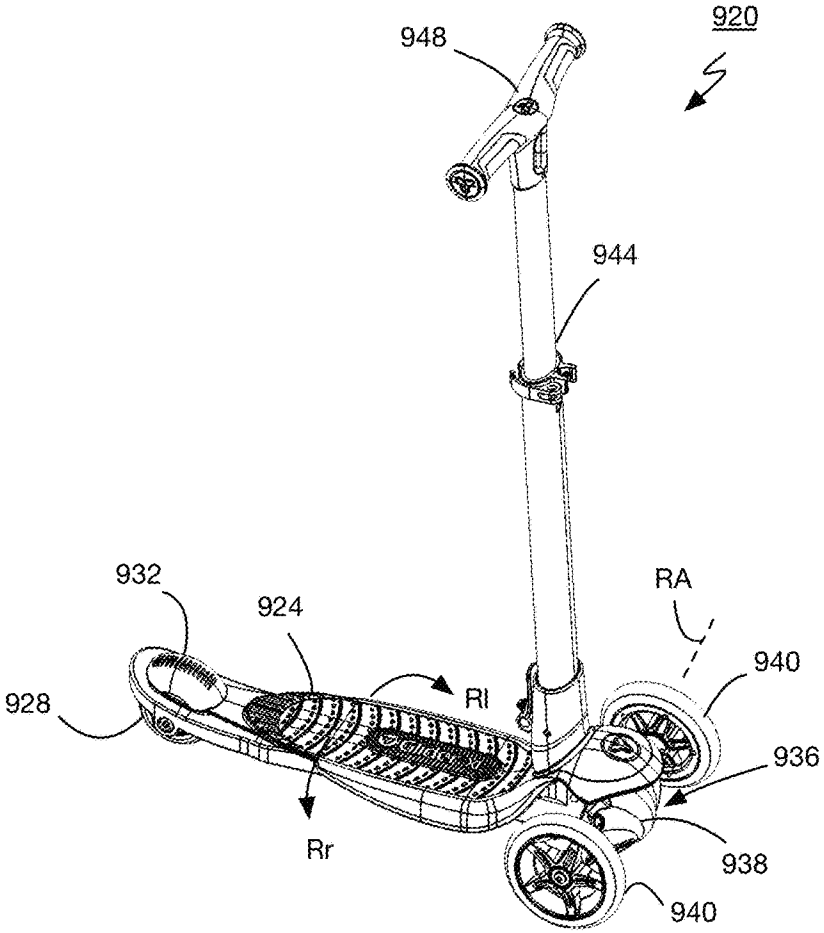
FIG. 34 is an isometric view of a foot-deck-based vehicle that is, in particular, a scooter in accordance with another embodiment of the present disclosure.

FIG. 34 shows a foot-deck-based vehicle in the form of a scooter 920 in accordance with an embodiment. The scooter 920 has a foot-deck 924 that extends longitudinally. A single rear wheel 928 is positioned at a rear end of the foot-deck 924.

A front wheel assembly 936 is pivotally coupled to the foot-deck 924 at a front end thereof to pivot relative to the foot-deck 924 about a front wheel assembly pivot axis. The front wheel assembly 936 includes a front wheel support in the form of a hanger 938 to which are rotatably coupled a pair of front wheels 940. The front wheels 940 are spaced axially apart.

A handlebar post 944 extends generally vertically from a top surface of the foot-deck 924 when the scooter 920 is upright. A handlebar 948 is secured to a top end of the handlebar post 944.

The scooter 920 is a lean-to-steer type vehicle. Steering is achieved by a rider by shifting their center-of-gravity laterally left or right of a central longitudinal axis of the foot-deck 924. Thus, the handlebar 948 is provided for the safety of a rider and not to directly steer the scooter 920. Due to the configuration of the scooter 920 described herein, a shift in a rider's center-of-gravity to a right lateral side of the foot-deck 924 causes the foot-deck 924 to roll in a direction Rr and the front wheel assembly 936 to pivot right (i.e., clockwise, when viewed from a rider's perspective on the foot-deck 924), causing the scooter 920 to turn right. Similarly, a shift in a rider's center-of-gravity to a left lateral side of the foot-deck 924 causes the foot-deck 924 to roll in a direction Rl and the front wheel assembly 936 to pivot left (i.e., counter-clockwise, when viewed from a rider's perspective on the foot-deck 924), causing the scooter 920 to turn left.

Figure 35:
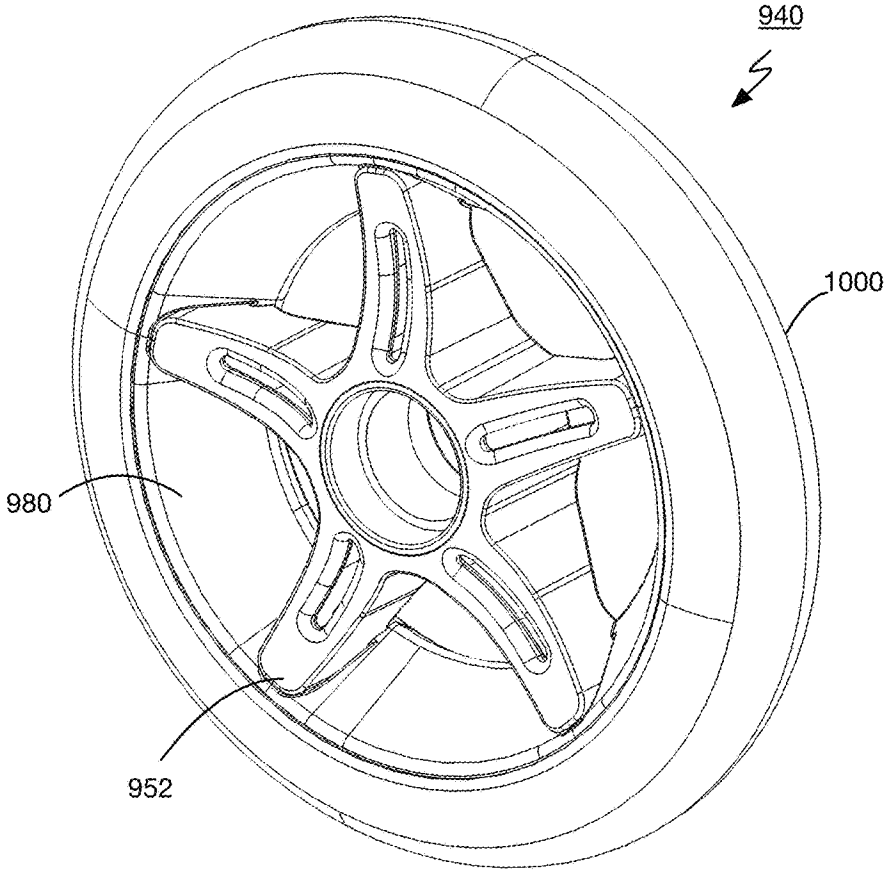
FIG. 35 is an isometric view of a front wheel of the scooter of FIG. 34 in isolation.
Figure 36:
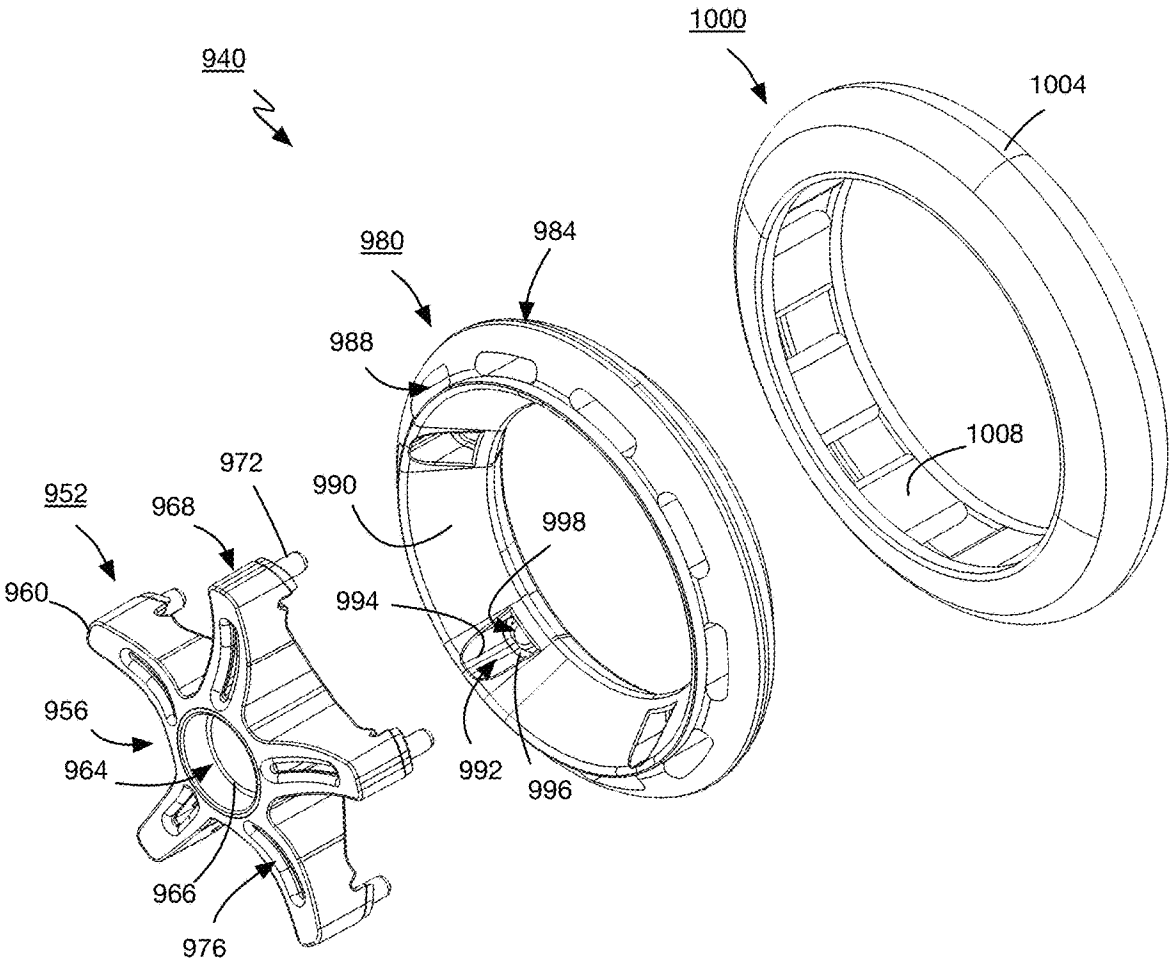
FIG. 36 is an exploded isometric view of the front wheel of the scooter of FIG. 34.

Referring now to FIGS. 35 and 36, one of the front wheels 940 is shown in greater detail. The front wheel 940 includes a rim support structure 952 in the form of a spider that has a hub portion 956 from which extends a set of five spokes 960. The hub portion 956 has a circular central recess 964 having a circumferentially extending ridge 966 positioned therein. Each spoke 960 has a spoke peripheral surface 968 that has a profile that is generally uniform axially. A stud 972 extends from an inwardly facing surface of each spoke 960 and is slightly thicker at its end. A cutout 976 extends axially through each spoke 960.

A rim 980 of the front wheel 940 has a tire support structure 984 that is semi-toroidal, in that its outer periphery is generally arcuate. A plurality of channels 988 extend axially through the tire support structure 984 about its circumference. A rim body 990 extends inwardly from the tire support structure 984 and has a frustoconical outer surface. A set of five recesses 992 are spaced about the circumference of the rim body 990 and correspond to the angular positions of the spokes 960 of the rim support structure 952. Each of the recesses 992 has a peripheral wall 994 with a profile that corresponds to the spoke peripheral surface 968 of the spokes 960, and terminates at an end wall 996 that has a stud-receiving aperture 998 that extends axially through it.

A tire 1000 is molded about the tire support structure 984 and has a tire surface 1004 for rolling along a travel surface. When the tire 1000 is molded about the tire support structure 984, the material of the tire flows into and through the channels 88. The tire 1000 so molded becomes secured to the tire support structure 984 both via the semi-toroidal shape of the outer periphery of the tire support structure 984 over which the tire 1000 is molded and the channels through which the tire 1000 extends. In this manner, both lateral and angular slippage of the tire 1000 relative to the rim 980 is generally prevented.

The rim support structure 952 is secured to the rim 980 and extends towards a wheel support around which the rim support structure 952 freely rotates.

Figure 37:
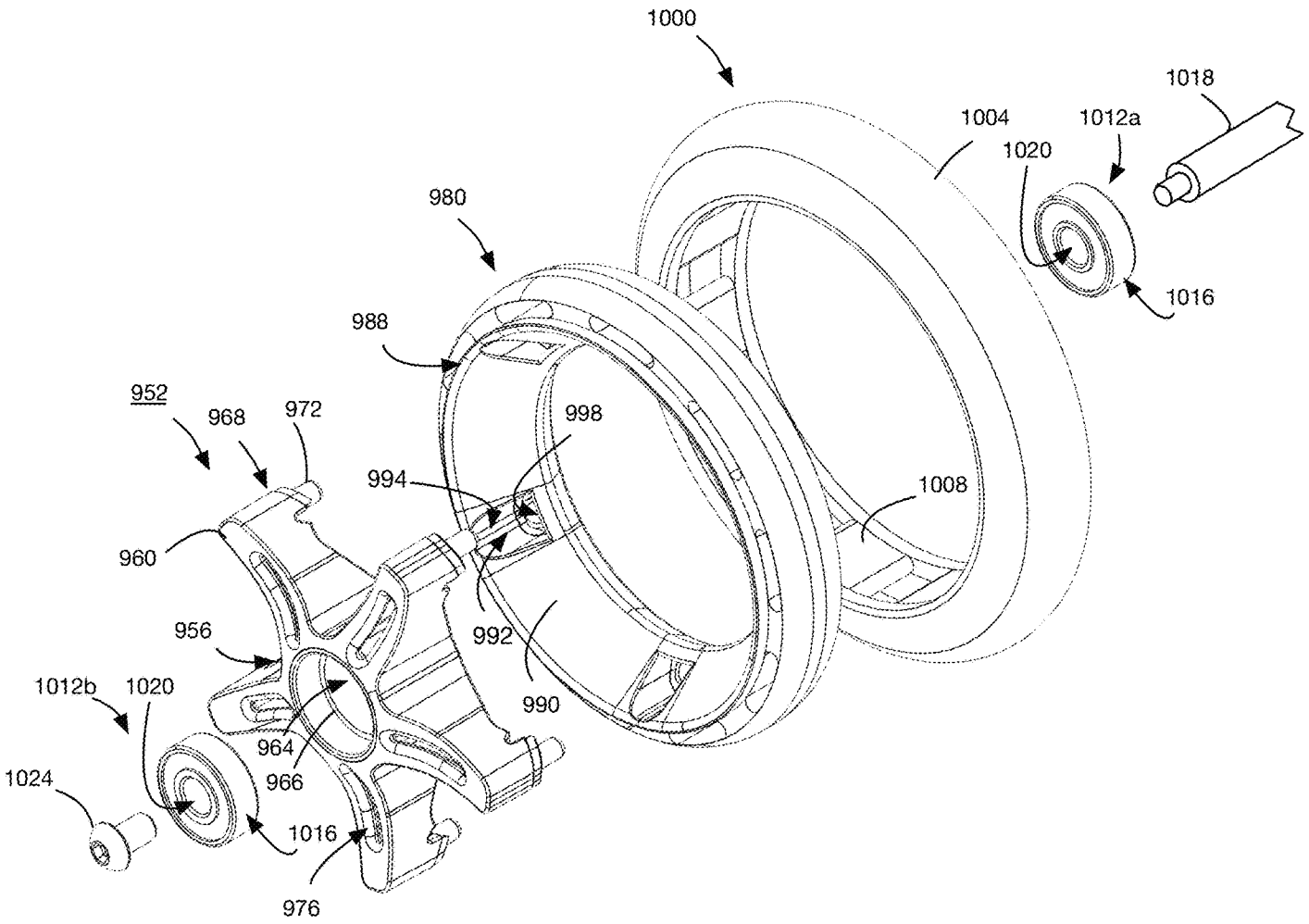
FIG. 37 is an exploded isometric view of the front wheel and bearings of the scooter of FIG. 34.

Now with reference to FIG. 37, a pair of bushings 1012*a*, 1012*b* (alternatively referred to as bushings 1012) are shown. Each of the bushings 1012*a*, 1012*b* has a circular circumferential periphery 1016 that generally corresponds to the size of the circular central recess 964 of the rim support structure 952. An axial through-hole 120 extends through both of the bushings 1012.

In order to assemble the wheel 940, the tire 1000 is molded over the tire support structure 984 of the rim 980. Next, the spokes 960 of the rim support structure 952 are aligned with the recesses 992 of the rim body 990. The spoke peripheral surface 968 of the spokes 960 snugly fit within the peripheral walls 994 of the rim body 990. The studs 972 and the through-holes are mating engagement structures that enable the rim 980 to be secured to the rim support structure 952. The studs 972 are pushed through the stud-receiving apertures 998 in the end walls 996 of the rim body 990. As the ends of the studs 972 are slightly thicker than the stud-receiving apertures 998, they can be pushed through the stud-receiving apertures 998 with sufficient force. The studs 972 are dimensioned to extend through the stud-receiving apertures 998, with the thicker ends thereof protruding through on the opposite side of the rim body 990. In this position, the thicker ends of the studs 972 prevent the studs 972 from exiting the stud-receiving apertures 998, thereby securing the rim support structure 952 to the rim 980.

The two bushings 1012*a*, 1012*b* are then frictionally fit snugly within the central recess 964. The bushing 1012*a* is inserted into the central recess 964 from an inside side of the rim support structure 952 and urged into contact with the circumferentially extending ridge 966. As the circumferentially extending ridge 966 has a smaller diameter than the circumferential periphery 1016 of the bushing 1012*a*, it prevents further travel of the bushing 1012. Similarly, the bushing 1012*b* is inserted into the central recess 964 from an outside side of the rim support structure 952 and urged into contact with the circumferentially extending ridge 966 which prevents it from further travel through the central recess 964. The bushings 1012 are then mounted atop of a wheel support in the form of an axle rod 1018 that is inserted through their axial through-holes 1020. The bushings 1012 freely rotate about the axle rod 1018 to enable the front wheels 940 to rotate thereon. A securing nut 1024 is then threaded screwed atop of the axle rod 1018 to secure the front wheel 40 thereon.

It is desirable to have the wheel maintain its peripheral round shape to ensure smooth travel of the scooter 920 across a travel surface in the absence of irregularities in the travel surface. Further, it is desirable to impart a suspension between the rim 980 and the foot-deck 924 to absorb some of the jarring from irregularities in the travel surface and some of the weight from the foot-deck 924 being applied to the rim 980.

In the particular embodiment, the rim 980 is molded from a solid plastic, but in other embodiments can be made from other relatively rigid materials. The rigidity of the rim 980 enables it to resist deformation as a result of irregularities in the travel surface and weight of a rider borne by it.

The rim support structure 952 is secured to the rim positioned between the axle rod 1018 around which the rim support structure 952 freely rotates and the rim 980, and has a rigidity that is less than the rigidity of the rim 980. In the particular embodiment, the rim support structure 952 is made from a polyurethane, but can be made from any other suitable material that enables deformation of the rim support structure 952 under force while returning to its original shape once the force is removed.

The tire 1000 is constructed from a rubber compound, but can also be constructed from a polyurethane or other suitable material for providing traction on a travel surface.

The bearings 1012*a*, 1012*b* are constructed from a plastic or other suitable material that enables the front wheels 940 to freely rotate about the axle rods 1018.

Light-transmissive plastics typically are more brittle and subject to cracking compared to coloured plastics. Thus, by making the rim support structure 952 from a less rigid material, it can be made light transmissive to provide a desirable appearance to the front wheels 940, wherein the rims and tires appear to be floating, while decreasing the risk of cracking of the front wheels 940.

During operation of the scooter 920, when a rider stands on top of the foot-deck 924, a downward force is transferred through the axle rod 1018 to the bearings 1012*a*, 1012*b*. The bearings 1012 generally do not deform under a force. The downward force is transferred from the axle rod 1018 through the bearings 1012 to the front wheels 940. The downward force of the bearings 1012 causes the rim support structure 952 of each front wheel 940 to deform slightly, allowing the axle rod 1018 and bearings 1012 to shift downwards toward the travel surface upon which the scooter 920 is positioned. The spoke peripheral surface 968 of the spokes 960 is in contact and engages the peripheral walls 994 of the recesses 992 of the rim 980, and the downward force is spread across these surfaces for two or three spokes 960. The peripheral surface 968 has a varying radius from the rotation axis RA of the rim support structure 952 and, thus, the wheel 940.

The studs 972 securing the rim support structure 952 to the rim 980 and the portion of the frame support structure 952 that are positioned above the axle rod 1018 can deform via stretching as the axle rod 1018 is biased downwards as the rim support structure 952 is sufficiently flexible to enable such deformation without cracking. Further, by having some play between the rim 980 and the rim support structure 952, the stress placed on the relatively rigid rim 980 when the rim support structure 952 is deformed is reduced. Above the elevation of the axle rod 1018, the spoke peripheral surface 968 of the spokes 960 may pull away from the peripheral walls 994 of the recesses 992 of the rim 980 as the axle rod 1018 and bearings are pushed downwards, thus biasing the central recess 964 of the hub portion 956 downwards.

In some embodiments, the rim support structure can be a solid disk. In other embodiments, the rim support structure can be any other structure and material that can deform in response to a downward force transferred from a wheel support around which the rim support structure freely rotates.

In some preferred embodiments, the rim support structure has a peripheral surface that has a profile that is generally uniform axially. This feature allows the rim support structure to be readily coupled to the rim and distribute the weight placed on the axle rod that is transferred to the rim across the axially uniform profile of the rim support structure in order to decrease the chance of fracturing of the rim support structure. In other embodiments, the peripheral surface of the rim support structure can include one or more steps or slopes separating axially uniform peripheral surface portions. It is conceived that the rim support structure can have elements that extend radially beyond the axially uniform peripheral surface(s) and do not generally provide load transmission from the axle to the rim.

Although described in the above-described embodiment as being semi-toroidal, the tire support structure of a rim can be any suitable structure for securely mounting a tire thereon to enable rolling travel on the tire over a travel surface. For example, the tire support structure can take the form of a longitudinal channel about the peripheral circumference of the rim into which is fit a tire having an at least somewhat toroidal shape. Another exemplary tire support structure includes a pair of generally radially extending flanges such as those used in clincher rims. Various other tire support structures will occur to those skilled in the art.

The rim and the rim support structure can have other types of mating engagement structures for securing the rim to the rim support structure. For example, the rim can have overhanging lips to snap-fit the rim support structure thereto.

In other embodiments, the peripheral surface can have a uniform radius from the rotation axis of the rim support structure, forming arcuate cross-sectioned support surfaces or a single cylindrical support surface.

Preferably, the mating engagement structures enable some play between the rim and the rim support structure so that when the rim support structure is deformed during use, the rim is not strained because it is tightly secured to the rim support structure.

Persons skilled in the art will appreciate that there are yet more alternative implementations and modifications possible, and that the above examples are only illustrations of one or more implementations. The scope, therefore, is only to be limited by the claims appended hereto.

What is claimed is:

1. A foot-deck-based vehicle, comprising:

a foot-deck with a front end, a rear end, and at least one rear wheel proximal to the rear end;

a front wheel support comprising a pair of wheel interfaces, each of which is couplable to a separate at least one of at least two front wheels, a main body extending between the wheel interfaces and coupled to the foot-deck, and at least one recess in the main body; and at least one accessory snugly securable within the at least one recess of the front wheel support, wherein the main body has a first stiffness when the at least one accessory is removed from the at least one recess, and has a second stiffness that is greater than the first stiffness when the at least one accessory is snugly secured within the at least one recess, wherein the first stiffness and the second stiffness are resistances to bending under a bending load applied to the front wheel support through the foot-deck when the foot-deck supports a person.

2. A foot-deck-based vehicle according to claim 1, wherein the at least one accessory is releasably securable within the at least one recess.

3. A foot-deck-based vehicle according to claim 2, wherein the main body comprises a cellular structure defining the at least one recess.

4. A foot-deck-based vehicle according to claim 3, wherein the at least one accessory is dimensioned to inhibit deformation of the main body when the at least one accessory is fitted in the at least one recess.

5. A foot-deck-based vehicle according to claim 4, wherein the at least one accessory has a portion of uniform profile that engages walls of the at least one recess.

6. A front wheel support of a foot-deck-based vehicle, the foot-deck-based vehicle having a foot-deck with a front end, a rear end, and at least one rear wheel proximal to the rear end, comprising:

a pair of wheel interfaces, each of which is couplable to a separate at least one of at least two front wheels;

a main body extending between the wheel interfaces and coupleable to the foot-deck;

at least one recess in the main body; and at least one accessory snugly securable within the at least one recess of the front wheel support, wherein the main body has a first stiffness when the at least one accessory is removed from the at least one recess, and has a second stiffness that is greater than the first stiffness when the at least one accessory is snugly secured within the at least one recess, wherein the first stiffness and the second stiffness are resistances to bending under a bending load applied to the front wheel support through the foot-deck when the foot-deck supports a person.

7. A foot-deck-based vehicle according to claim 6, wherein the at least one accessory is releasably securable within the at least one recess.

8. A foot-deck-based vehicle according to claim 7, wherein the main body comprises a cellular structure defining the at least one recess.

9. A foot-deck-based vehicle according to claim 8, wherein the at least one accessory is dimensioned to inhibit deformation of the main body when the at least one accessory is fitted within the at least one recess.

10. A foot-deck-based vehicle according to claim 9, wherein the at least one accessory has a portion of uniform profile that engages walls of the at least one recess.

11. An accessory for a foot-deck-based vehicle, the foot-deck-based vehicle having a foot-deck with a front end, a rear end, and at least one rear wheel proximal to the rear end, and a front wheel support that is couplable to the foot-deck and comprises a pair of wheel interfaces each of which is couplable to a separate at least one of at least two front wheels and a main body extending between the wheel interfaces and coupled to the foot-deck, the accessory comprising:

at least one engagement element that is securable to the main body of the front wheel support, the at least one engagement element defining at least two securement positions; and a lateral body extending at least along and over a top surface of the front wheel support between the at least two securement positions and resisting relative movement of the at least two securement positions.

12. An accessory according to claim 11, wherein the at least one engagement element comprises at least two engagement elements.

13. An accessory according to claim 11, wherein the at least one engagement element is dimensioned to clamp fit onto the front wheel support.

14. An accessory according to claim 11, wherein the lateral body has an opening for receiving the front wheel support, the opening facing one of forwardly and rearwardly when the accessory is mounted on the front wheel support.

* * * * *